US006299113B1

(12) United States Patent
Yamashita et al.

(10) Patent No.: US 6,299,113 B1
(45) Date of Patent: Oct. 9, 2001

(54) TELESCOPIC MEMBER, CYLINDRICAL BODY AND MOLDED BODY

(75) Inventors: Yoshinobu Yamashita; Tadanobu Yamashita, both of Sakai (JP)

(73) Assignee: Koyo Giken Co., Ltd., Sakai (JP)

( * ) Notice: Subject to any disclaimer, the term of this patent is extended or adjusted under 35 U.S.C. 154(b) by 0 days.

(21) Appl. No.: 09/459,571

(22) Filed: Dec. 13, 1999

(30) Foreign Application Priority Data

| | | |
|---|---|---|
| Dec. 18, 1998 | (JP) | 10-361553 |
| Jan. 11, 1999 | (JP) | 11-004686 |
| Jul. 30, 1999 | (JP) | 11-218162 |
| Oct. 28, 1999 | (JP) | 11-307828 |

(51) Int. Cl.[7] ..... F16M 11/00
(52) U.S. Cl. ..... 248/161; 248/188.5
(58) Field of Search ..... 248/157, 158, 248/161, 188.1, 188.5, 414

(56) References Cited

U.S. PATENT DOCUMENTS

| | | | |
|---|---|---|---|
| 2,010,306 | 8/1935 | Leech . | |
| 2,710,048 | 6/1955 | Dawson . | |
| 3,871,780 | 3/1975 | Svensson . | |
| 4,867,406 | 9/1989 | Lengacher . | |
| 5,323,695 | 6/1994 | Borgman et al. . | |
| 6,092,771 * | 7/2000 | Fich | 248/188.5 |

FOREIGN PATENT DOCUMENTS

| | | |
|---|---|---|
| 405 651 | 7/1966 | (CH) . |
| 29509264U1 | 10/1996 | (DE) . |
| 19745494A1 | 5/1998 | (DE) . |
| 29811921U1 | 10/1998 | (DE) . |
| 1 057 955 | 2/1967 | (GB) . |
| 1 514 698 | 6/1978 | (GB) . |
| 2 238 572 A | 6/1991 | (GB) . |
| 62-38967 | 8/1987 | (JP) . |
| 2-19060 | 5/1990 | (JP) . |
| 4-25003 | 6/1992 | (JP) . |
| 4-44117 | 10/1992 | (JP) . |

OTHER PUBLICATIONS

European Search Report dated Nov. 2, 2000.

* cited by examiner

*Primary Examiner*—Ramon O. Ramirez
(74) *Attorney, Agent, or Firm*—Burns, Doane, Swecker & Mathis, LLP

(57) ABSTRACT

The invention provides a telescopic member having an inner cylinder slidably fitted into an outer cylinder in the axial direction and a lock mechanism, placed between the cylinders, for holding relative movements therebetween. A holder is secured to the outer cylinder and allows its inner circumferential surface to slide on the outer circumferential surface of the inner cylinder so that a frictional force is applied to the relative movements between the cylinders. The holder has a braking chamber on the side facing the inner cylinder to contain a friction body that rolls on the circumferential surface of the inner cylinder. The braking chamber has a taper surface so as to have a space that becomes narrower in the push-in direction of the inner cylinder, and first and second moving end surfaces that are separated with a predetermined distance in the push-in direction so as to intersect the taper surface, and is formed into a reversed trapezoidal shape in its cross-section viewed at one side. Therefore, it is possible to provide a stable frictional force against the movement of the inner cylinder in the push-in direction.

68 Claims, 39 Drawing Sheets

TELESCOPIC MEMBER, CYLINDRICAL BODY AND MOLDED BODY

BACKGROUND OF THE INVENTION

The present invention relates to a telescopic member for mainly adjusting the height of legs of a desk, a chair, a table, a bed, etc., and also relates a cylindrical body for applying a frictional force to the telescopic operation of the telescopic member and a molded body that is installed in the cylindrical body.

FIG. 1 is a partial longitudinal cross-sectional view that shows the configuration of a conventional telescopic member. This telescopic member 100 has a step-wise height adjusting mechanism that has been disclosed in Japanese Patent Application Laid-Open No. 62-38967 (1987), and is attached to the lower end of each leg of, for example, a table T. In FIG. 1, for convenience of explanation, a screw portion S used for securing the leg, which is mounted at each corner of the bottom surface of the table T so as to stick out downward, is threadedly engaged directly with a screw hole 21*a* to be secured thereto. Here, the screw hole 21*a* is formed in the center portion of an end cap 21 welded to the upper end of its inner cylinder 2.

This telescopic member 100 is provided with an outer cylinder 3 that is externally fitted onto the inner cylinder 2 so as to allow it to slide freely inside thereof. A bottom cap 31 made of synthetic resin is attached to the lower end of the outer cylinder 3 with its one portion fitted therein. A screw 32 is inserted through the bottom cap 31 in the center thereof from the bottom side, (and threadedly engaged with a screw hole 34*a* formed in the base portion 34 of a pillar-shaped body 33 that is inserted into the inner cylinder 2 so that the base portion 34 is secured on the upper surface of the bottom cap 31.

The pillar-shaped body 33 is provided with an upright portion 35 formed on the upper side of the base portion 34 so as to stick out therefrom, and a plurality of engaging portions 36 provided as holes are formed in the upright portion 35 in its longitudinal direction (in the up-and-down direction in the FIG. 1) with appropriate intervals. A lock lever motion mechanism 22 is mounted with screws 23 to the inner circumferential surface of the inner cylinder 2 so as to oppose these engaging portions 36.

The lock lever motion mechanism 22 is provided with a frame body 24 that has a securing surface to the inner cylinder 2 in the vicinity of the center thereof and that has a channel shape in its cross-section when viewed from above or below, and the frame body 24 is arranged with its opening side of the channel shape facing the upright portion 35. Inside the frame body 24, a lock lever 25, which engages with the engaging portions 36, is swingably supported by a horizontal shaft 26 in the front to rear direction in its center portion shown in FIG. 1. FIG. 1 shows a state in which a pawl portion 25*a*, which is a lower end of the swing lever 25, is engaged with one of the engaging portions 36. The rotation of the lock lever 25 in the clockwise direction from the engaged state as shown in FIG. 1 is regulated by a contact of a holding portion 25*b* that is the other end of the lock lever 25 with the inner wall surface of the inner cylinder 2 of the frame body 24 on the securing side, and also regulated by a contact of its upper side moving end with one portion of a slider 27, as illustrated in FIG. 1; thus, its engaged state is maintained. Moreover, the rotation of the lock lever 25 in the counterclockwise direction is allowed although it goes against a spring 28 that applies a pressing force to the lock lever 25 in the opposite direction.

Therefore, as the inner cylinder 2 is slidden inside the outer cylinder 3 in the pull-out direction, that is, as the telescopic member 100 is extended, the lock lever motion mechanism 22 is raised relative to the outer cylinder 3 together with the inner cylinder 2 so that the pawl portion 25*a* of the lock lever 25 is allowed to contact the upper end of the engaging portion 36 with which it is currently engaged. As the inner cylinder 2 is further raised, the lock lever 25 is rotated counterclockwise in FIG. 1 against the pressing force of the spring 28, with the result that the engagement with the corresponding engaging portion 36 is released. Then, when the pawl portion 25*a* has reached the position of another engaging portion 36 right above of the above-mentioned engaging portion 36, the pressing force of the spring 28 allows the lock lever 25 to rotate clockwise, thereby again bringing the lock lever 25 into an engaged state with the new engaging portion 36.

As described above, the engagement between the lock lever 25 and the engaging portions 36 makes it possible to adjust the length of the telescopic member 100 with intervals in which the engaging portions 36 are provided. Moreover, as the lock lever motion mechanism 22 is raised with the inner cylinder 2 beyond the engaging portion 36 at the uppermost stage, the upper end of the slider 27 is allowed to contact a control piece 37*a* that is formed on an appropriate position above this engaging portion 36 so as to stick out toward the lock lever motion mechanism 22. The slider 27, which has its protruding portion 27*a* fitted to a longitudinally elongated hole 24*a* that is formed in the end walls of the channel shape of the frame body 24 in the thickness direction (in the front to rear direction in FIG. 1), is pressed downward by the control piece 37*a* along this elongated hole 24*a*. The slider 27, which has been pressed downward to the lower end position of the elongated hole 24*a*, forces the lock lever 25 to rotate counterclockwise against the pressing force of the spring 28, and also intervenes with the pawl portion 25*a* and the engaging portion 36 so as to prevent the engagement between them.

This arrangement allows the inner cylinder 2 to descend together with the lock lever motion mechanism 22, that is, to slide in the push-in direction. The lock lever motion mechanism 22, which descends together with the inner cylinder 2, has its slider 27 pushed up by a control piece 37*b* that is the same as the control piece 37*a* and that is formed in an appropriate position below the engaging portion 36 at the lowermost stage so as to stick out therefrom, through the motion opposite to that as described above; thus, the lock lever 25 is released from its engagement prevented state by the slider 27. Then, the lock lever motion mechanism 22 is again raised together with the inner cylinder 2 so that the lock lever 25 is engaged with the engaging portion 36 at the lowermost stage, and returned to the original state as shown in FIG. 1.

FIGS. 2A, 2B, and 2C are explanatory drawings that show the movements of a friction body in the conventional telescopic member. A cylindrical holder 4 is attached to the upper end of the outer cylinder 3 with its inner circumferential surface contacting the outer circumferential surface of the inner cylinder 2. This holder 4 maintains the inner cylinder 2 along its inner circumferential surface in a concentric manner with respect to the outer cylinder 3, and also applies frictional resistance to the movement of the inner cylinder 2 to a certain extent. Moreover, a braking chamber 42, which has a taper surface 41 opposing the outer circumferential surface of the inner cylinder 2, is placed along the inner circumferential surface of the holder 4, and a friction body 43 made of an O-ring is embedded in the braking chamber 42.

As illustrated in FIG. 2A, when the inner cylinder 2 is moved in the pull-out direction from the outer cylinder 3, the friction body 43 is moved upward until it contacts an upper-end moving end surface 44 (see FIGS. 2B and 2C) that is an upper end position of the braking chamber 42, following the movement of the inner cylinder 2. When the inner cylinder 2 is slidden in the push-in direction into the outer cylinder 3, as shown in FIG. 2B, the friction body 43 is moved to a lower position of the braking chamber 42 following the movement of the inner cylinder 2, and soon allowed to contact the taper surface 41. This contact allows the friction body 43 to roll while being sandwiched and deformed appropriately between the outer circumferential surface of the inner cylinder 2 and the taper surface 41, and this rolling movement provides an appropriate frictional force (braking force) when the inner cylinder 2 is moved in the push-in direction; thus, upon shortening the length of the telescopic member 100, it is possible to prevent the inner cylinder 2 from being abruptly moved in the push-in direction. Such a braking mechanism using the braking chamber 42 having the taper surface 41, and the frictional body 43 is disclosed in Japanese Utility Model Examined Patent Publication No. 25003 (1992) by the inventors of the present application.

FIG. 3A is a partial longitudinal cross-sectional view when seen from the right side that shows a holding portion for holding the pillar-shaped body, and FIG. 3B is a partial cross-sectional view taken along line D—D of FIG. 3A. At positions properly spaced in the longitudinal direction of the inner cylinder 2, holding portions 29, which are formed by means of pressing so as to protrude inside of the inner cylinder 2, are aligned so as to face each other at the respective positions in the longitudinal direction, and the total number of four of them are placed. These holding portions 29 press the upright portion 35 of the pillar-shaped body 33 to the inner circumferential surface of a semi-circular portion so as to secure it, the semi-circular portion being located in the inner cylinder 2 on the side opposite to the side on which the lock lever motion mechanism 22; thus, the pillar-shaped body 33, secured by a screw 32 (see FIG. 1), is prevented from rotating on the longitudinal axis so that the pawl portion 25*a* and the engaging hole 36 are held in such a position as to provide easy engagement of them.

However, in the above-mentioned conventional telescopic member 100, the braking chamber 42, placed along the holder 4, is formed into a reversed right triangle shape by a taper surface 41 in a cross-sectional view seen at one side; therefore, as the inner cylinder 2 is moved further in the push-in direction from the state shown in FIG. 2B, the friction body 43 is moved to a further lower position of the taper surface 41, that is, to a space in which the size of the braking chamber 42 becomes extremely smaller than the diameter of the friction body 43, as illustrated in FIG. 2C so that the deformation becomes too great to make a rolling movement, with the result that the frictional force to be applied to the inner cylinder 2 moving in the push-in direction tends to become unstable.

Moreover, since the holding portions 29 are formed in the inner cylinder 2 by means of pressing, the semicircular space between the paired holding portions 29 and the inner circumferential surface of the inner cylinder 2 tends to be comparatively poor in dimensional precision, and since this results in a greater range inside this space in which the upright portion 35 is allowed to freely move, it is not possible to prevent the rotation of the upright portion 35, thereby causing noise due to a contact between the inner circumferential surface of the inner cylinder 2 and the upright portion 35.

Moreover, in the attached state of the telescopic member 100 to the table T as illustrated in FIG. 1, for example, in the case when a rotational moment is applied to the table T so as to twist along in its plane direction, the inner cylinder 2 is rotated together with the table T, with the result that the holding portions 29 installed in the inner cylinder 2 twist the pillar-shaped body 33; this tends to cause a problem in which the table T becomes very unstable. This problem is particularly aggravated when this telescopic member 100 is applied to a so-called one-leg table T. For example, in most cases, since the base portion 34 of the pillar-shaped body 33 is secured on the floor through the bottom cap 31, etc., the rotational moment applied to the pillar-shaped body 33 is directly exerted on the base portion 34 causing its plastic deformation.

BRIEF SUMMARY OF THE INVENTION

The present invention has been devised so as to solve the above-mentioned problems, and one of the objectives of the present invention is to provide a telescopic member, a cylinder-shaped body such as a holder and a molded body such as a friction body that can apply a stable frictional force to an inner cylinder that is being moved in the push-in direction, for example, by forming a braking chamber that allows the friction body such as an O-ring to freely move inside the braking chamber without intervention.

The telescopic member of the present invention has an arrangement, in which: an inner cylinder is fitted inside an outer cylinder so as to freely slide in the axial direction; a lock mechanism is placed between the outer cylinder and inner cylinder so as to hold the relative movement therebetween; a braking chamber is installed in either one of the outer cylinder or inner cylinder opposing to the other, the braking chamber being provided with a taper surface providing a space that becomes narrower toward the relative sliding direction of the other cylinder; the braking chamber has a friction body installed therein; and, when the other cylinder is relatively slidden, the friction body is allowed to move in the relative sliding direction with respect to the one cylinder, so that it is fitted between the taper surface and the other cylinder so as to apply a braking force to the relative movements. In this arrangement, the telescopic member is characterized in that the braking chamber is formed so that, when the friction body reaches a moving end in the relative sliding direction inside the braking chamber, it is allowed to roll between the taper surface and the other cylinder.

In this invention, in the telescopic member wherein: an inner cylinder is fitted into an outer cylinder so as to freely slide in the axial direction; a lock mechanism is placed between the outer cylinder and inner cylinder so as to hold the respective movements; a braking chamber is installed in either one of the outer cylinder or inner cylinder opposing to the other, the braking chamber being provided with a taper surface providing a space that becomes narrower toward the relative sliding direction of the other cylinder; the braking chamber has a friction body installed therein; and, when the other cylinder is relatively slidden, the friction body is allowed to move in the relative sliding direction with respect to the one cylinder, so that it is fitted between the taper surface and the other cylinder so as to apply a braking force to the relative movements, the braking chamber is designed so that, even when the friction body is located at the moving end in the relative sliding direction inside the braking chamber, the friction body is allowed to roll between the taper surface and the other cylinder; therefore, the rolling movement of the friction body is allowed all through the telescopic movement so that, upon extending or shortening the outer cylinder and inner cylinder, it is possible to provide a braking force (frictional force) stably.

Here, the braking chamber may be one, as in the conventional case, that is circumferentially provided around the one cylinder, or a plurality of braking chambers may be circumferentially provided the one cylinder with friction bodies being installed in the respective braking chambers. Moreover, besides the O-ring as will be described later, any shape such as a roller shape and a spherical shape may be used as long as it is allowed to roll on the circumferential surface of the other cylinder; in other words, the shape of the friction body is not particularly limited.

Moreover, the above-mentioned braking chamber may be formed into a trapezoidal shape (or reversed trapezoidal shape) in its longitudinal cross-section viewed at one side as described earlier in which the opposing bases of the trapezoid are allowed to regulate the both of the moving ends of the friction body. Alternatively, it may be designed so that the conventional braking chamber having a reversed right triangle shape is provided with a protruding portion that sticks out from the lower portion of the taper surface in the direction toward the opposing cylinder.

Moreover, in the present invention, the braking chamber may be formed on the inner cylinder so that the friction body is allowed to slide on the inner circumferential surface of the outer cylinder. Furthermore, as illustrated in FIG. 1, in another preferable arrangement, the inner cylinder is stretched upward while tho outer cylinder is provided on the lower side, or on the contrary, the outer cylinder is stretched upward while the inner cylinder is provided on the lower side. Further, not only a load applied from above, but also a load applied downward may be supported; for example, the telescopic member of the present invention is hanged down from the ceiling by attaching the base portion of the outer cylinder thereto. Thus, the orientation of the telescopic member is not particularly limited. Therefore, the orientation of the telescopic member and the generating direction of the braking force of the braking chamber may be set in any directions respectively, and the orientation of the braking chamber may be set depending on the application of the telescopic member.

Moreover, in the telescopic member in each of the above-mentioned respective inventions, besides the conventional cylinder shape, the outer and inner cylinder may be formed into various shapes in their cross-section such as a square shape or an elliptical shape.

In another telescopic member of the present invention, the braking chamber has two moving end surfaces at both of the moving ends of the friction body, placed in the direction intersecting the circumferential surface of the other cylinder, and is formed by at least the two moving end surfaces, the taper surface, and the circumferential surface of the other cylinder.

In this invention, since the braking chamber has the two moving end surfaces at both of the moving ends of the friction body, the end surfaces are placed in the direction intersecting the circumferential surface of the other cylinder, and is formed by at least the two moving end surfaces, the taper surface, and the circumferential surface of the other cylinder, the space of the braking chamber, which has the reversed right triangle shape in its cross-section when viewed at one side in the conventional configuration, is formed into a reversed trapezoidal shape in its same cross-sectional view so as to occupy its small space portion: thus, it becomes possible to obtain the above-mentioned effects by only slightly modifying the conventional configuration of the braking chamber.

Still another telescopic member of the present invention is characterized in that the above-mentioned frictional body is an O-ring.

In this invention, since an O-ring is used as the friction body, the same O-ring used in the conventional configuration may also be applied.

In still another telescopic member of the present invention, the friction body has a ring shape, and is characterized in that at least a portion of its cross-section intersecting the axis along the circumferential direction of the ring shape is formed into a portion of a circular shape.

In this invention, the friction body has the ring shape and at least a portion of its cross-section intersecting the axis along the circumferential direction of the ring shape is formed into a circular shape; therefore, in the case when the friction body is in contact with the other cylinder in the range of the circular shape, it is allowed to freely roll, while in the case when it is in contact with the other cylinder in the range other than the circular shape, a greater braking force (frictional force) is applied to the rolling movement. Therefore, for example, the former case is applied to the extending operation of the outer cylinder and inner cylinder, and the latter case is applied to the shortening operation thereof so that the extending operation is carried out with a comparatively small force, and so that at the time of a shortening operation requiring a comparatively great force, it is possible to suppress an abrupt shortening operation of the telescopic member due to the weight of a table, etc.

In still another telescopic member of the present invention, each of the outer cylinder and inner cylinder has a cross-section having an oval shape with opposing linear portions lying along its major-axis direction, and they are fitted and inserted with their major-axes coincident with each other, and a pair of the braking chambers and the friction bodies are placed at the opposing linear portions.

In this invention, each of the outer cylinder and inner cylinder is designed so as to have the cross-section having an oval shape with opposing linear portions lying along its major-axis direction, and they are fitted and inserted with their major-axes coincident with each other, and a pair of the braking chambers and the friction bodies are placed at the opposing linear portions; therefore, the pair of the braking chambers and the friction bodies are placed at each of the opposing positions of the cross-section of the outer cylinder and inner cylinder so that the frictional force of the friction body is exerted in a well-balanced fashion.

Still another telescopic member of the present invention is characterized in that the friction body has a column shape.

In this invention, the friction body is designed to have the column shape so that when this is applied to the telescopic member constituted by the outer cylinder and inner cylinder each having the linear portions in its cross-section as described above, it becomes possible to obtain a preferable rolling movement of the friction body.

Moreover, in still another telescopic member of the present invention having an arrangement in which: the inner cylinder is inserted into the outer cylinder so as to freely slide in the axial direction; between the outer cylinder and inner cylinder, a lock mechanism for holding the relative movements therebetween is installed; a cylindrical body is secured to the circumferential surface of one of the outer cylinder or the inner cylinder; and the cylindrical body allows its inner circumferential surface or its outer circumferential surface to slide on the circumferential surface of the other cylinder so that a braking force is applied to the relative movements of the outer cylinder and inner cylinder.

This arrangement is characterized in that the cylindrical body is provided with a recess portion that is placed on the side facing to the circumferential surface of the other cylinder and that holds a molded body so as to allow it to roll on the circumferential surface of the other cylinder, and the recess portion is provided with at least a taper surface that narrows the space toward the relative sliding direction of the other cylinder and two surfaces that are spaced with a predetermined distance in the relative sliding direction and formed so as to intersect the taper surface.

In this invention, in the telescopic member in which: the inner cylinder is inserted into the outer cylinder so as to freely slide in the axial direction; between the outer cylinder and inner cylinder, a lock mechanism for holding the relative movements thereof is installed; a cylindrical body such as a holder is secured to the circumferential surface of one of the outer cylinder or the inner cylinder; and the cylindrical body allows its inner circumferential surface or its outer circumferential surface to slide on the circumferential surface of the other cylinder so that a braking force is applied to the relative movements of the outer cylinder and inner cylinder, the cylindrical body is provided with a recess portion such as a braking chamber that is placed on the side facing to the circumferential surface of the other cylinder and that holds a molded body such as a friction body and allowed to roll on the circumferential surface of the other cylinder, and the recess portion is provided with at least a taper surface that narrows the space toward the relative sliding direction of the other cylinder and two surfaces that are spaced with a predetermined distance in the relative sliding direction and formed so as to intersect the taper surface; therefore, upon extending or shortening the outer cylinder and inner cylinder, it is possible to prevent the molded body (friction body) from being extremely deformed, and consequently to stabilize the braking force (frictional force).

Here, the recess portion may be one as in the conventional case, and formed along the circumferential surface of the other cylinder, or, for example, a plurality of them may be placed along the circumferential direction of the other cylinder so as to include the molded bodies in the respective recess portions. Moreover, with respect to the molded body, besides the O-ring used in the conventional arrangement, any shape such as a roller shape and a spherical shape may be used as long as it is allowed to roll on the circumferential surface of the other cylinder; in other words, the shape thereof is not particularly limited.

Moreover, the above-mentioned recess portion may be formed into a trapezoidal shape (or reversed trapezoidal shape) in its longitudinal cross-section viewed at one side as described earlier in which the opposing bases are allowed to regulate the both moving ends of the friction body.

Moreover, in the present invention, the cylindrical body is secured to the inner cylinder so that the cylindrical body and the molded body are allowed to slide on the inner circumferential surface of the outer cylinder. Furthermore, as illustrated in FIG. 1, in another preferable arrangement, the inner cylinder is stretched upward while the outer cylinder is installed in the lower side, or on the contrary, the outer cylinder is stretched upward while the inner cylinder is installed in the lower side. Alternatively, not only a load applied from above, but also a load applied downward may be supported; for example, the telescopic member of the present invention is hanged down from the ceiling by attaching the base portion of the outer cylinder thereto. Thus, the orientation of the telescopic member is not particularly limited. Therefore, the orientation of the telescopic member and the generating direction of the braking force of the recess portion and the molded body may be set in any directions, and the orientation of the recess portion may be set depending on the application of the telescopic member.

Moreover, in the telescopic member in each of the above-mentioned respective inventions, besides the conventional cylinder shape, the outer and inner cylinder may be formed into various shapes in their cross-section such as a square shape or an elliptical shape.

Still another telescopic member of the present invention is characterized in that the cylindrical body is provided with one portion having one of the above-mentioned two surfaces and the other portion having the other surface as separate portions.

In this invention, since the cylindrical body is provided with one portion having one of the above-mentioned two surfaces and the other portion having the other surface as separated portions, the installation of the molded body to the recess portion formed in the cylindrical body is easily carried out, and the molding process of the cylindrical body having a comparatively complicated shape including the recess portion can be carried out more easily.

Still another telescopic member of the present invention is characterized in that one of the two surfaces on the side having a larger space is formed so as to be tapered so that it is gradually separated from the other surface (on the side having a smaller space) as it proceeds in the separating direction from the circumferential surface of the other cylinder.

In this invention, one of the two surfaces on the side having a larger space is tapered so that it is gradually separated from the other surface as it goes in the separating direction from the circumferential surface of the other cylinder; therefore, in the case of the orientation of the telescopic member and the recess portion (braking chamber) as described in the conventional arrangement, when the molded body has reached the moving end on the side having the larger space inside the recess portion while the extending operation of the outer and inner cylinder, the molded body is allowed to separate from the circumferential surface of the other cylinder, with the result that the frictional force with the molded body is reduced, thereby making it possible to carry out the extending operations with a smaller force.

Still another telescopic member of the present invention is characterized in that the above-mentioned molded body is an O-ring.

In this invention, since an O-ring is used as the molded body, the same O-ring used in the conventional configuration may also be applied.

In still another telescopic member of the present invention, the molded body has a ring shape, and is characterized in that at least a portion of a cross-section intersecting the axis along the circumferential direction of the ring shape is formed into a portion of a circular shape.

In this invention, the molded body has the ring shape and at least a portion of the cross-section intersecting the axis along the circumferential direction of the ring shape is formed into a circular shape; therefore, in the case when the molded body is in contact with the other cylinder in the range of the circular shape, it is allowed to approximately freely roll, while in the case when it is in contact with the other cylinder in the range other than the circular shape, a greater braking force (frictional force) is applied to the rolling movement. Therefore, for example, the former case is applied to the extending operation of the outer cylinder and inner cylinder, and the latter case is applied to the shortening operation thereof so that the extending operation is carried out with a comparatively small force, and so that at the time of a shortening operation requiring a comparatively great force, it is possible to suppress an abrupt shortening operation of the telescopic member due to the weight of a table, etc.

Still another telescopic member of the present invention is characterized in that the molded body is formed by connecting a plurality of ball-shaped bodies or roller-shaped bodies, and in that by allowing these to roll on the circumferential surface of the other cylinder, a braking force is applied to the relative movements of the outer cylinder and inner cylinder.

In this invention, the molded body is formed by connecting a plurality of ball-shaped bodies or roller-shaped bodies and the braking force is applied to the relative movements of the outer cylinder and inner cylinder by allowing these to roll in the gap with the other circumferential surface; therefore, the molded body and the other cylinder as well as the taper surface are allowed to make approximately point contacts with each other so that uniform pressing forces are easily obtained at the respective contact positions; thus, it becomes possible to stabilize the braking force (frictional force) at the time of extending or shortening the outer cylinder and inner cylinder.

Still another telescopic member of the present invention is characterized in that the molded body is made of urethane resin.

In this invention, since the molded body is made of urethane resin, the rolling movement of the molded body against the circumferential surface of the other cylinder and the taper surface is carried out more smoothly, thereby making it possible to stabilize the breaking force (frictional force) at the time of extending or shortening the outer cylinder and inner cylinder.

Still another telescopic member of the present invention is characterized in that the molded body has a ring shape.

In this invention, since the molded body has a ring shape, it is possible to apply a uniform braking force (frictional force) over the entire circumference of the outer cylinder and inner cylinder in the same manner as the conventional configuration.

Still another telescopic member of the present invention is characterized in that the molded body has a pillar shape.

In this invention, the molded body is designed to have the pillar shape so that when this is applied to the telescopic member constituted by the outer cylinder and inner cylinder each having the linear portion in its cross-section as described above, it becomes possible to obtain a preferable rolling movement of the molded body.

In still another telescopic member of the present invention, each of the outer cylinder and inner cylinder has a cross-section having an oval shape with opposing linear portions lying along its major-axis direction, and they are fitted with their major-axes coincident with each other, and a pair of the recess portions and the molded bodies are placed at the opposing linear portions.

In this invention, each of the outer cylinder and inner cylinder is designed so as to have the cross-section having an oval shape with opposing linear portions lying along its major-axis direction, and they are fitted with their major-axes coincident with each other, and a pair of the recess portions and the molded bodies are Placed at the opposing linear portions; therefore, the pair of the braking chambers and the friction bodies are placed at opposing positions of the cross-section of the outer cylinder and inner cylinder so that the frictional force of the friction body is exerted in a well-balanced fashion.

The telescopic member of the present invention has an arrangement, in which: an inner cylinder is fitted into an outer cylinder so as to freely slide in the axial direction; a lock mechanism is provided between the outer cylinder and inner cylinder so as to hold the relative movements therebetween; a braking chamber is installed in either one of the outer cylinder or inner cylinder facing to the other, the braking chamber being provided with a taper surface providing a space that becomes narrower toward the relative sliding direction of the other cylinder; the braking chamber has a friction body installed therein; and, when the other cylinder is relatively slidden, the friction body is allowed to move in the relative sliding direction with respect to the one cylinder, so that it is fitted between the taper surface and the other cylinder so as to apply a braking force to the relative movements. In this arrangement, the telescopic member is characterized in that the friction body has such a shape that it allows to fit in a portion of the braking chamber when it is located at a predetermined position in the sliding direction.

In this invention, in the telescopic member wherein: an inner cylinder is fitted into an outer cylinder so as to freely slide in the axial direction; a lock mechanism is placed between the outer cylinder and inner cylinder so as to hold the relative movements therebetween; a braking chamber is provided on either one of the outer cylinder or inner cylinder facing the other, the braking chamber being provided with a taper surface providing a space that becomes narrower toward the relative sliding direction of the other cylinder; the braking chamber has a friction body installed therein; and, when the other cylinder is relatively slidden, the friction body is allowed to move in the relative sliding direction with respect to the one cylinder, so that it is fitted between the taper surface and the other cylinder so as to apply a braking force to the relative movements, the friction body has such a shape that it allows to fit in a portion of the braking chamber when it is located at a predetermined position in the sliding direction; therefore, the friction body is allowed to make face-contacts with the other cylinder and the taper surface so that, upon extending or shortening the outer cylinder and inner cylinder, it is possible to provide a braking force (frictional force) more stably.

Still another telescopic member of the present invention is characterized in that the friction body is made of a ring-shaped elastic member having a notch at a position in its circumferential direction, and in that this is elastically deformed so as to allow both of the notch ends to contact each other so that its inner diameter or outer diameter is adjusted.

In this invention, the friction body is made of a ring-shaped elastic member having a notch at a position in its circumferential direction, and this is elastically deformed so as to allow both of the notch ends to contact each other so that its inner diameter or outer diameter is adjusted; therefore, in accordance with a shortening operation of the outer cylinder and inner cylinder, the friction body, which is shifted toward the portion with a smaller space in the braking chamber, is sandwiched between the other cylinder and the taper surface, and allowed to deform so as to fill the space of the braking chamber. Following this deformation, the inner diameter or the outer diameter of the friction body is changed so as to strengthen the contact against the other cylinder, with the result that, for example, in the case of the orientation of the telescopic member and the formation direction of the braking chamber as shown in the conventional configuration, the frictional force at the time of shortening the outer cylinder and inner cylinder is further stabilized. In contrast, at the time of extending the outer cylinder and inner cylinder, since the friction body tends to return to its original shape, the frictional force is reduced so that the extending operation can be carried out by a using smaller force.

Still another telescopic member of the present invention is characterized in that the braking chamber is formed so that, when the friction body is located at the moving end on the side opposite to the above-mentioned moving direction inside the braking chamber, it is separated from the circumferential surface of the other cylinder.

In this invention, since the braking chamber is formed so that, when the friction body is located at the moving end on the side opposite to the above-mentioned moving direction inside the braking chamber, it is separated from the circumferential surface of the other cylinder; therefore, for example, in the case of the orientation of the telescopic member and the formation direction of the braking chamber as shown in the conventional configuration, when, upon extending the outer cylinder and inner cylinder, the friction body has reached the moving end on the side opposite to the sliding direction inside the braking chamber, the friction body is separated from the circumferential surface of the other cylinder so that the frictional force exerted by the friction body is reduced, thereby making it possible to carry out the extending operation by using a smaller force.

Moreover, the cylindrical body of the present invention, which is secured to the circumferential surface of either one of a hole or a pillar body that is fitted into the hole so as to relatively slide freely in the axial direction and which applies a braking force to the relative movements of the hole and the pillar body by allowing its inner circumferential surface or outer circumferential surface to slide on the circumferential surface of the other, is provided with a recess portion that is placed on the side facing the circumferential surface of the other cylinder and that holds a molded body so as to allow it to roll on the circumferential surface of the other cylinder, and the recess portion is provided with at least a taper surface that narrows the space toward the relative sliding direction of the other cylinder and two surfaces that are spaced with a predetermined distance in the relative sliding direction and formed so as to intersect the taper surface.

In this invention, the cylindrical body such as a holder, which is secured to the circumferential surface of either one of a hole or a pillar body that is fitted into the hole so as to relatively slide freely in the axial direction and which applies a braking force to the relative movements of the hole and the pillar body by allowing its inner circumferential surface or outer circumferential surface to slide on the circumferential surface of the other, is provided with a recess portion such as a braking chamber that is placed on the side facing the circumferential surface of the other cylinder and that holds a molded body such as a friction body so as to allow it to roll on the circumferential surface of the other cylinder, and the recess portion is provided with at least a taper surface that narrows the space toward the relative sliding direction of the other cylinder and two surfaces that are spaced with a predetermined distance in the relative sliding direction and formed so as to intersect the taper surface; therefore, upon moving the hole and the pillar body relative to each other, it becomes possible to prevent the molded body (friction body) from being extremely deformed, and consequently to stabilize the braking force (frictional force).

Here, the recess portion may be one as in the conventional case, and formed along the circumferential surface of the other cylinder, or, for example, a plurality of them may be placed along the circumferential direction of the other cylinder so as to include the molded bodies in the respective recess portions. Moreover, with respect to the molded body, besides the O-ring used in the conventional arrangement, any shape such as a roller shape or a spherical shape may be used as long as it is allowed to roll on the circumferential surface of the other cylinder; in other words, the shape thereof is not particularly limited.

Moreover, the above-mentioned recess portion may be formed into a trapezoidal shape (or reversed trapezoidal shape) in its longitudinal cross-section viewed at one side as described earlier in which the opposing bases are allowed to regulate the both moving ends the friction body.

Here, in the present invention, the objects to be relatively slidden are not intended to be limited to the cylindrical members; and any arrangement including a member having a hole and a pillar body (or a cylindrical body) to be inserted into this hole are allowed to relatively slide in the axial direction may be adopted, and the range of application thereof is not intended to be limited to the telescopic member.

Moreover, another arrangement in which the cylindrical member is secured to the hole side so as to slide on the outer circumferential surface of the pillar body may be used, or still another arrangement in which, in contrast, it is secured to the outer circumference surface of the pillar body so as to slide on the circumferential surface of the hole may be used.

Still another cylindrical body of the present invention is characterized in that the cylindrical body is provided with one portion having one of the above-mentioned two surfaces and the other portion having the other surface as separated portions.

In this invention, since the cylindrical body is provided with one portion having one of the above-mentioned two surfaces and the other portion having the other surface as separated portions, the installation of the molded body to the recess portion formed therein is easily carried out, and the molding process of the cylindrical body having a comparatively complicated shape including the recess portion can be carried out more easily.

Still another cylindrical body of the present invention is characterized in that one of the two surfaces on the side having a larger space is formed so as to be tapered so that it is gradually separated from the other surface (on the side having a smaller space) as it proceeds in the separating direction from the circumferential surface of the other cylinder.

In this invention, one of the two surfaces on the side having a larger space is tapered so that it is gradually separated from the other surface on the side having a smaller space as it goes in the separating direction from the circumferential surface of the other cylinder; therefore, in the case of the orientation of the telescopic member and the formation direction of the recess portion (braking chamber) as described in the conventional arrangement, when the molded body has reached the moving end on the side having the larger space inside the recess portion while the extending operation of the outer and inner cylinder, the molded body is allowed to separate from the circumferential surface of the other cylinder, with the result that the frictional force with the molded body is reduced, thereby making it possible to carry out the extending operations with a smaller force.

In the present invention, the molded body, which is interpolated between a hole and a pillar body to be inserted into the hole in the axial direction so as to relatively slide freely therein and applies a braking force to the relative movements of the hole and the pillar body, is made by connecting a plurality of ball-shaped bodies or roller-shaped bodies.

In this invention, the molded body, which is interpolated between a hole and a pillar body to be inserted into the hole in the axial direction so as to relatively slide freely therein and applies a braking force to the relative movements of the hole and the pillar body, is formed by connecting a plurality of ball-shaped bodies or roller-shaped bodies so that they make approximately point contacts with the circumferential surface of the hole and/or the pillar body; thus, it is possible to easily obtain uniform pressing forces at the contact positions, and consequently to apply a stable braking force (frictional force) to the relative movements of the hole and the pillar body.

Here, in the present invention, various arrangements may be provided in which: the above-mentioned molded body is directly interpolated between the hole and the pillar body; a recess portion is formed in either one of the hole or pillar body on the side facing the other with the molded body being installed in the recess portion; and the molded body is held through a cylindrical body (holder).

Still another molded body of the present invention is characterized in that it is connected in a ring shape.

In this invention, since the molded body has a connected structure in a ring shape, it is possible to apply a uniform braking force (frictional force) to the entire circumference of the hole or the pillar body.

Still another molded body of the present invention is characterized in that it has a pillar shape.

In this invention, the molded body is designed to have the pillar shape so that when this is applied to the telescopic member constituted by the outer cylinder and inner cylinder each having the linear portions in its cross-section as described above, it becomes possible to obtain a preferable rolling movement of the molded body.

Still another molded body of the present invention is characterized in that it is made of urethane resin.

In this invention, since the molded body is made of urethane resin, the rolling movement of the molded body against the circumferential surface of the hole and/or the pillar body is carried out more smoothly, thereby making it possible to stabilize the breaking force (frictional force) to be applied to the relative movements of the hole and the pillar body.

Another objective of the present invention is to provide a telescopic member in which: for example, a holding body mounted through the wall of the inner cylinder; and the pillar body is held by the holding body so as to freely slide in the axial direction of the outer and inner cylinders and the pillar body is held so as not to move in the direction intersecting the axial direction so that the holding body is produced as a separated member from the inner cylinder, thereby making it possible to construct the member that is replaceable with the holding portion of the conventional arrangement with higher precision; thus, it is possible to prevent the pillar body from contacting the inner circumferential surface of the inner cylinder and consequently to reduce the generation of noise.

The telescopic member of the present invention has an arrangement, in which: an inner cylinder is inserted into an outer cylinder so as to freely slide in the axial direction; a pillar body having a plurality of engaging portions placed along the axial direction is provided on either one of the outer cylinder or inner cylinder with its longitudinal direction being coincident with the axial direction; and an stopper portion for stopping the respective engaging portions so as to hold the relative movements of the outer cylinder and inner cylinder is placed on the other cylinder, and this arrangement is characterized in that a holding body, which is mounted through the other cylinder so as to hold the pillar body in a freely slidable manner in the axial direction and which also holds the pillar body so as not to move in the direction intersecting the axial direction of the pillar body, is installed.

In this invention, in the telescopic member in which: an inner cylinder is inserted into an outer cylinder so as to freely slide in the axial direction; a pillar body having a plurality of engaging portions placed along the axial direction is installed in either one of the outer cylinder or inner cylinder with its longitudinal direction being coincident with the axial direction; and a stopper portion for successively stopping the respective engaging portions so as to hold the relative movements of the outer cylinder and inner cylinder is placed on the other cylinder, the holding body is mounted through the other cylinder so as to hold the pillar body in a freely slidable manner in the axial direction and also holds the pillar body so as not to move in the direction intersecting the axial direction of the pillar body. Thus, the holding portion of the conventional arrangement is produced as a separated member from the inner cylinder, thereby making it possible to construct the holding body with higher precision, and it is possible to prevent the pillar body from contacting the inner circumferential surface and the upright portion of the inner cylinder and consequently to reduce the generation of noise.

Still another telescopic member of the present invention is characterized in that the holding body is provided with a spacer portion that is installed between the outer cylinder and inner cylinder so as to maintain the distance between the outer cylinder and inner cylinder.

In this invention, the holding body is provided with the spacer portion that is placed between the outer cylinder and inner cylinder so as to maintain the distance between the outer cylinder and inner cylinder; therefore, for example, by installing a pair of holding bodies at opposing positions on the circumferences of the outer cylinder and inner cylinder, the outer cylinder and inner cylinder are maintained in a concentric manner, and the frictional force, exerted between the spacer portion and the inner circumferential surface of the outer cylinder, makes it possible to suppress abrupt relative movements of the outer cylinder and inner cylinder, in the same manner as the braking process by the braking chamber and the friction body.

Still another telescopic member of the present invention is characterized in that the holding body is designed to be two-legged at its portion sticking inside the other cylinder so that the pillar body is held by both of the ends of the legs.

In this invention, the holding body is designed to be two-legged at its portion sticking inside the other cylinder; therefore, it is possible to efficiently suppress the rotation of the pillar body on the axis in its longitudinal direction by using a simple structure.

Still another telescopic member of the present invention is characterized in that the holding body is made of synthetic resin.

In this invention, the holding body is made of synthetic resin; therefore, for example, by providing the holding body made of nylon resin, it is possible to provide a smooth sliding motion with the pillar body and also to apply an appropriate frictional force to the pillar body. Moreover, since metal is not used at the contact portion with the pillar body, the arrangement is less susceptible to noise generation.

Still another objective of the present invention is to provide a telescopic member in which: for example, a holding member (protruding portion) for stopping the relative rotations of the outer cylinder and inner cylinder on the axis is installed so that the transmission path of a rotational moment applied to, for example, the inner cylinder is directly connected (bypassed) to the outer cylinder, or a rotary base for allowing the relative rotations between the pillar body and either the outer cylinder or inner cylinder for holding the pillar body is installed so that the rotational moment applied to, for example, the inner cylinder is not transmitted to the pillar body. With these arrangements, it is possible to effectively prevent twisting of the pillar body.

Still another telescopic member of the present invention is characterized by further having a holding member that is installed in the one of the cylinders at the opposing surface to the other cylinder along the axial direction thereof so as to support the holding body so as to freely slide in the axial direction, and also so as to hold the holding body from moving in the direction intersecting the axial direction.

In this invention, the holding member (which is different from the aforementioned holding body) is installed in the one of the cylinders at the opposing surface to the other cylinder along the axial direction thereof so that the holding member supports the holding body so as to freely slide in the axial direction and also holds the holding body from moving in the direction intersecting the axial direction; thus, the holding body secured to the other cylinder is held by the holding member from rotating on the axis, thereby making it possible to stop the relative rotations of the outer cylinder and inner cylinder and consequently to prevent twisting of the pillar body.

Moreover, another telescopic member of the present invention has an arrangement in which: an inner cylinder is inserted into an outer cylinder so as to freely slide in the axial direction; a pillar-shaped body having a plurality of engaging portions placed along the axial direction is installed in either one of the outer cylinder or inner cylinder with its longitudinal direction coincident with the axial direction; and a stopper portion for engaging the engaging portion so as to hold the relative movements between the outer cylinder and inner cylinder is installed in the other cylinder. This arrangement is characterized in that a protruding portion, which is installed in the opposing surface of at least either one of the outer cylinder or inner cylinder in a protruding fashion and engages the other cylinder so as to hold the other cylinder so as to freely slide in the axial direction and also so as to hold the cylinder other from moving in the direction intersecting the axial direction, is installed.

In this invention, in the telescopic member in which: an inner cylinder is inserted into an outer cylinder so as to freely slide in the axial direction; a pillar-shaped body having a plurality of engaging portions placed along the axial direction is installed in either one of the outer cylinder or inner cylinder with its longitudinal direction coincident with the axial direction; and a stopper portion that successively engages the engaging portion so as to hold the relative movements between the outer cylinder and inner cylinder is installed in the other cylinder. In this arrangement, a protruding portion, which is installed in the opposing surface of at least either one of the outer cylinder or inner cylinder in a protruding fashion, is allowed to engage the other cylinder so as to hold the other cylinder so is as to freely slide in the axial direction and also so as to hold the other cylinder from moving in the direction intersecting the axial direction; therefore, the relative rotations of the outer cylinder and inner cylinder are stopped by the engagement between the protruding portion and the other cylinder, thereby making it possible to prevent twisting of the pillar-shaped body.

Still another telescopic member of the present invention is characterized in that a cylindrical cover for internally supporting the outer cylinder is further installed.

In this invention, the cylindrical cover for internally supporting the outer cylinder is further installed; therefore, in the case when, for example, the aforementioned protruding portion is formed on the outer cylinder by means of pressing from the outer circumferential surface, the recessed portion in the outer circumferential surface formed by this process can be shielded from outside; thus, it is possible to maintain a good appearance.

Moreover, still another telescopic member of the present invention has an arrangement in which: an inner cylinder is inserted into an outer cylinder so as to freely slide in the axial direction; a pillar-shaped body having a plurality of engaging portions placed along the axial direction is installed in either one of the outer cylinder or inner cylinder with its longitudinal direction coincident with the axial direction; and a stopper portion for stopping the engaging portion so as to hold the relative movements between the outer cylinder and inner cylinder is installed in the other cylinder, and this arrangement is characterized in that a rotary base, which is interpolated between one of the cylinders and the pillar-shaped body so as to allow the relative rotations thereof on the axis, is installed.

In this invention, in the telescopic member in which: an inner cylinder is inserted into an outer cylinder so as to freely slide in the axial direction; a pillar-shaped body having a plurality of engaging portions placed along the axial direction is installed in either one of the outer cylinder or inner cylinder with its longitudinal direction coincident with the axial direction; and a stopper portion that successively engages the engaging portion so as to hold the relative movements of the outer cylinder and inner cylinder is installed in the other cylinder, the rotary base, which is interpolated between one of the cylinders and the pillar-shaped body so as to allow the relative rotations thereof on the axis, is installed. Thus, the rotational moment applied to, for example, the inner cylinder is not transmitted to the pillar body so that it becomes possible to effectively prevent twisting of the pillar body.

Additionally, the telescopic member of the present invention as described above can be used as a leg or its attachment of an object, such as a desk, a chair, a table or a bed, and can also be utilized as a member that requires extending and shortening, such as a support leg used as footing at construction sites and a rod member for holding sheath plates during construction of a draining ditch, etc.

The above and further objects and features of the invention will more fully be apparent from the following detailed description with accompanying drawings.

DETAILED DESCRIPTION OF THE INVENTION

Referring to Figures showing the Embodiments, the following description will discuss the present invention in detail.

Embodiment 1

Figure 4:
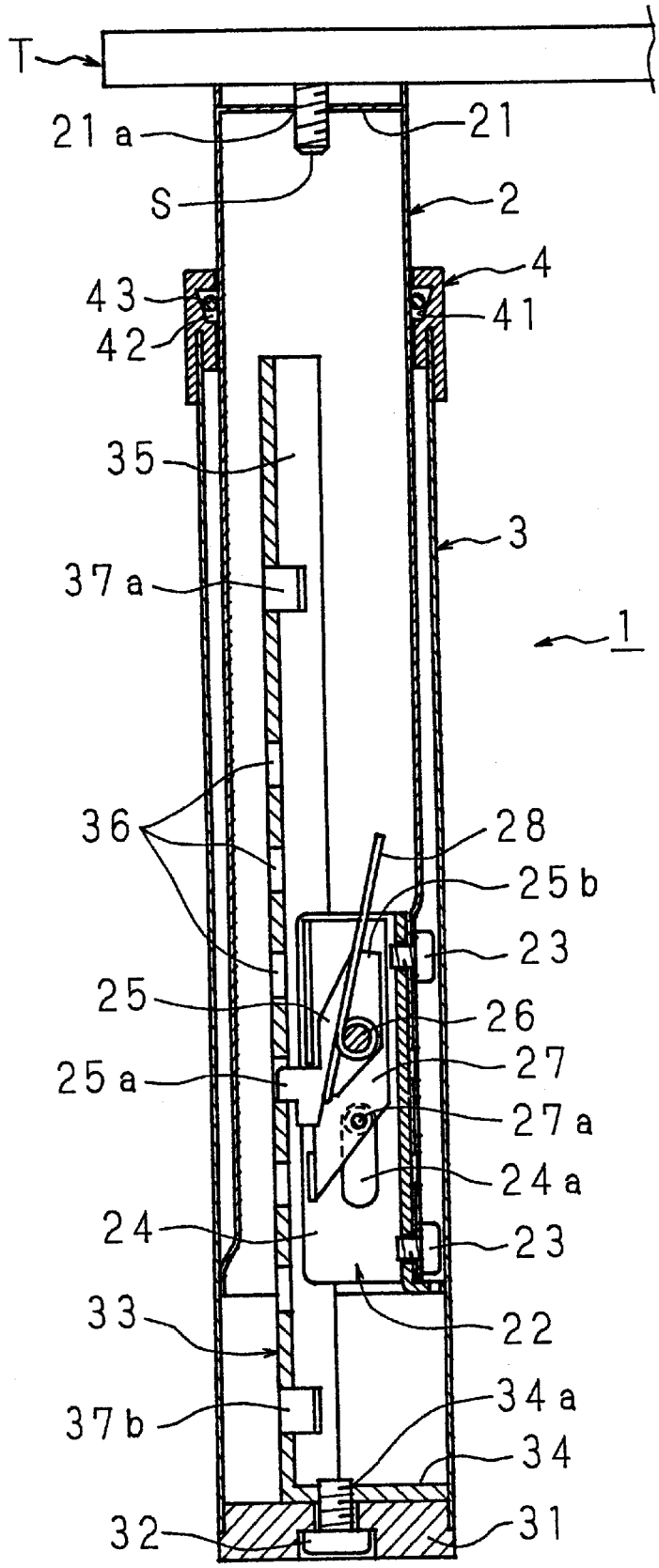
FIG. 4 is a partial longitudinal cross-sectional view that shows Embodiment 1 of the telescopic member according to the present invention.

FIG. 4 is a partial longitudinal cross-sectional view showing Embodiment 1 of a telescopic member according to the present invention. For example, the telescopic member 1 of the present embodiment is attached to a table T by threadedly engaging and securing each of screw portions S formed on the corners of the table T so as to stick out downward therefrom with its screw hole 21*a* formed in the center of a disk-shaped end cap 21 welded to the upper end of an inner cylinder 2 having a cylindrical shape.

Here, in the same manner as the aforementioned conventional configuration, the telescopic member 1 of the present invention may also be attached to a lower end portion of a leg that is preliminarily attached to the table T, without being directly attached to the table T. In the case when a comparatively high table T is desired, this arrangement eliminates the necessity for using a very long telescopic member 1. In general, since the telescopic adjustment is seldom required for the entire height of the table T, this arrangement makes it possible to apply the telescopic function to the table T at low costs.

The telescopic member 1 is provided with an outer cylinder 3 that is externally fitted to the inner cylinder 2 so as to allow it freely slide therein. A bottom cap 31 made of synthetic resin, which has a short column shape, is attached to the lower end portion of the outer cylinder 3 with its half portion in the thickness direction being fitted therein. The diameter of the rest half portion is coincident with the outer diameter of the outer cylinder 3. A screw 32 is inserted through the center portion of bottom cap 31 from the bottom, and this is engaged with a screw hole 34*a* formed in a semi-circular base portion 34 of a pillar-shaped body 33 that is inserted into the inner cylinder 2 so that the base portion 34 is secured on the upper face of the bottom cap 31.

The pillar-shaped body 33 is formed on the upper side of the base portion 34 so as to stick out therefrom, and that is allowed to freely slide in the longitudinal direction inside the inner cylinder 2 by a plurality of holding portions (not shown) sticking out from the inner circumference of the inner cylinder 2, and the upright portion 35 is provided with a plurality of engaging portions 36 in the form of holes appropriately spaced in the longitudinal direction (in the up-and-down direction in FIG. 4). Onto the inner circumference surface of the inner cylinder 2 facing these engaging portions 36 is attached a lock lever motion mechanism 22 that serves as a lock mechanism together with the engaging portions 36, with screws 23.

The lock lever motion mechanism 22 is provided with a frame body 24 having a channel shape in its cross-section viewed from above or from below with its securing face to the inner cylinder 2 to be the center portion, and the open side of the channel shape of this frame body 24 is oriented toward the upright portion 35. Inside the frame body 24, a lock lever 25, which engages the engaging portions 36, is supported by a horizontal axis 26 in the front to rear direction in FIG. 4 so as to freely swing thereon in the center thereof. In FIG. 4, a pawl portion 25*a* that is one end on the lower side of the lock lever 25 is engaged with one of the engaging portions 36. The clockwise rotation of the lock lever 25 from the engaged state shown in FIG. 4 is held by a holding portion 25*b* that is the other end of the lock lever 25 contacting the inner wall surface of the frame 24 on the securing side to the inner cylinder 2, as well as contacting one portion of a slider 27 located at upper side moving end shown in FIG. 4; thus, its engaged state is maintained. Moreover, the counterclockwise rotation of the lock lever 25 in FIG. 4 is allowed against a spring 28 that applies a pressing force toward the opposite direction.

Therefore, as the inner cylinder 2 is moved in the pull-out direction from the outer cylinder 3, that is, as the telescopic member 1 is extended, the lock lever motion mechanism 22 is relatively raised together with the inner cylinder 2 with respect to the outer cylinder 3 so that the pawl portion 25*a* of the lock lever 25 is allowed to contact the upper end of the engaging portion 36 with which it currently engages. As the inner cylinder 2 is further raised, the lock lever 25 is allowed to rotate counterclockwise in FIG. 4 against the pressing force of the spring 28, with the result that it is released from the engagement with the engaging portion 36. Then, as the pawl portion 25*a* has reached the position of another engaging portion 36 adjacent to the above-mentioned engaging portion 36 on the upper side, the pressing force of the spring 28 allows the lock lever 25 to rotate clockwise, thereby again bringing the lock lever 25 into an engaging state with the engaging portion 36.

As described above, the engagement of the lock lever 25 and the engaging portions 36 makes it possible to carry out a length adjusting operation of the telescopic member 1 based on the intervals in which the engaging portions 36 are placed. Moreover, when the lock lever motion mechanism 22 is raised beyond the uppermost engaging portion 36 together with the inner cylinder 2, the upper end portion of the slider 27 comes into contact with a control piece 37*a* that sticks out toward the lock lever motion mechanism 22 side at an appropriate position above the highest engaging portion 36. The slider 27, which has its protruding portion 27*a* in the front to rear direction in FIG. 4 fitted to an elongated hole 24*a* in the longitudinal direction formed in the end walls of the channel shape of the frame body 24 in the thickness direction (in the front to rear direction of FIG. 4), is pressed downward along the elongated hole 24*a* by the control piece 37*a*. The slider 27, when pressed to the lower end position of the elongated hole 24*a*, makes the lock lever 25 rotate counterclockwise against the pressing force of the spring 28, and is also interpolated between the pawl portion 25*a* and the engaging portion 36 so as to intervene with the engagement of them.

With this arrangement, the descend of the inner cylinder 2 together with the lock lever motion mechanism 22, that is, the movement in the push-in direction is allowed. The lock lever motion mechanism 22, lowered together with the inner cylinder 2, has its slider 27 pushed up by a control piece 37*b* that is the same as the control piece 37*a* and that sticks out at an appropriate position below the lowermost engaging portion 36 in an operation opposite to the above-mentioned operation, with the result that the engagement preventing state of the lock lever 25 by the slider 27 is released. Then, by raising the lock lever motion mechanism 22 again together with the inner cylinder 2, the lock lever 25 is allowed to engage the engaging portion 36 at the lowermost stage, thereby returning to the state as shown in FIG. 4.

Figure 5A:
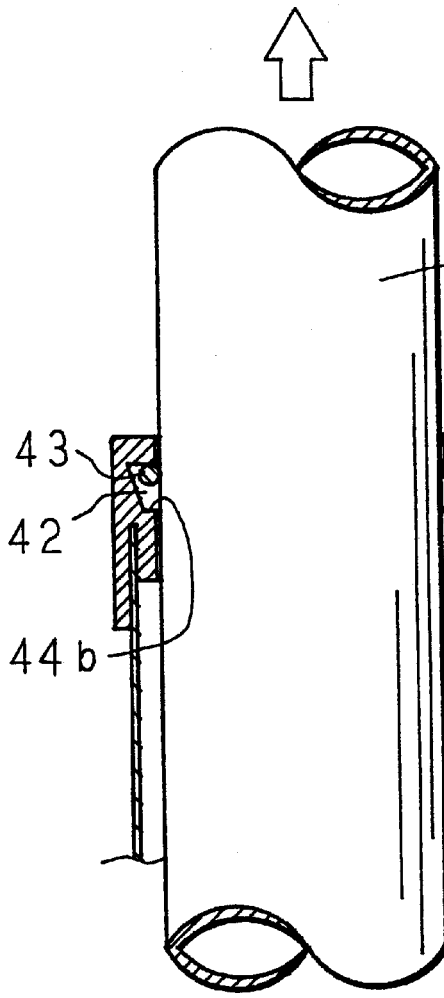
FIGS. 5A and 5B are explanatory drawings that show the movements of a friction body provided as a molded body in the telescopic member shown in FIG. 4.
Figure 5B:
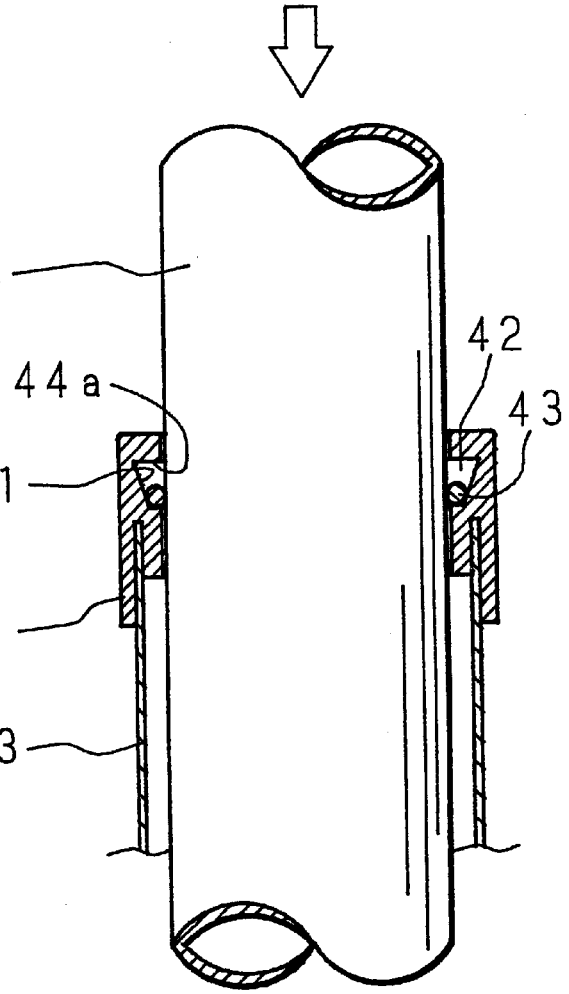

FIGS. 5A and 5B are explanatory drawings that show the movements of a friction body provided as a molded body in the telescopic member shown in FIG. 4. A holder 4, which serves as a cylindrical body whose inner circumferential surface contacts the outer circumferential surface of the inner cylinder 2, is attached to the upper end portion of the outer cylinder 3. The holder 4 supports the inner cylinder 2 in a concentric manner with respect to the outer cylinder 3 by its inner circumferential surface, and also applies frictional resistance to the movement of the inner cylinder 2 to a certain extent. Moreover, a braking chamber 42, which serves as a recess portion with a taper surface 41 facing the outer circumferential surface of the inner cylinder 2, is placed along the inner circumferential surface of the holder 4, and a friction body 43 provided as a molded body made of an O-ring is embedded in the braking chamber 42.

The braking chamber 42 of the present embodiment is formed to have a shape in which the reversed right triangle shape of the conventional configuration is modified into a reversed trapezoidal shape such as, by filling a portion thereof from the lower end. Therefore, the upper long base portion in the aforementioned cross-section is referred to as a first moving end surface 44*a* (referred to simply as the moving end surface 44 in the conventional configuration), and a second moving end surface 44*b*, which corresponds to a lower short base portion, is formed to have such a width that it does not extremely press the friction body 43 when it comes into contact with the friction body 43 together with the taper surface 41 and the outer circumferential surface of the inner cylinder 2.

Here, the degree to which it does not extremely press is defined as a state in which the friction body 43 is still allowed to roll, when the inner cylinder 2 is moved in the push-in direction into the outer cylinder 3. Additionally, from this standpoint, the braking chamber 42 is not necessarily formed into a trapezoidal shape; and for example, another alternative configuration in which a protruding portion from the taper surface 41 inward is placed at the lower position of the conventional braking chamber 42 having the reversed right triangle shape may be adopted.

Therefore, as illustrated in FIG. 5A, when the inner cylinder 2 is moved in the pull-out direction from the outer cylinder 3, the friction body 43 is moved upward inside the braking chamber 42 following the movement of the inner cylinder 2 until it comes into contact with the first moving end surface 44*a*. In this case, since the friction body 43 is in contact with the outer circumferential surface of the inner cylinder and the first moving end surface 44*a*, it is allowed to roll and does not give so much resisting force when the inner cylinder 2 is pulled out.

In contrast, as illustrated in FIG. 5B, when the inner cylinder 2 is moved in the push-in direction into the outer cylinder 3, the friction body 43 is moved following the movement of the inner cylinder 2 until it comes into contact with the second moving end surface 44*b*, and also comes into contact with the taper surface 41 almost at the same time. Consequently, the friction body 43 is properly compressed and deformed among the outer circumferential surface of the inner cylinder 2, the taper surface 41, and the second moving end surface 44*b*; however, it is allowed to roll on these pressing surfaces. This rolling movement applies an appropriate braking force (frictional force) to the further movement of the inner cylinder 2 in the push-in direction so that it is possible to suppress an abrupt movement of the inner cylinder 2 in the push-in direction when the telescopic member 1 is shortened; and in this case, since the rolling movement of the friction body 43 is maintained, it is possible to prevent the frictional force from becoming too great.

Additionally, when an attempt is made to set the above-mentioned braking force (frictional force) so as to be exerted upside down in its functioning direction, it is of course to adopt an arrangement in which the reversed trapezoidal shape of the braking chamber 42 is formed into a trapezoidal shape.

Moreover, the holder 4 provided as the cylindrical body of the present invention may be applied to a member other than the telescopic member 1. For example, an arrangement may be adopted in which it is interpolated between a simple hole serving like the inner circumferential surface of the outer cylinder 3 and a pillar body (or a cylinder body) serving like the outer circumferential surface of the inner cylinder 2. Furthermore, the friction body 43 may be solely used without using the holder 4 as the cylindrical body. In this case, a recess portion serving like the braking chamber 42 is formed in a hole side serving like the inner circumferential surface of the outer cylinder 3.

Embodiment 2

Figure 6:
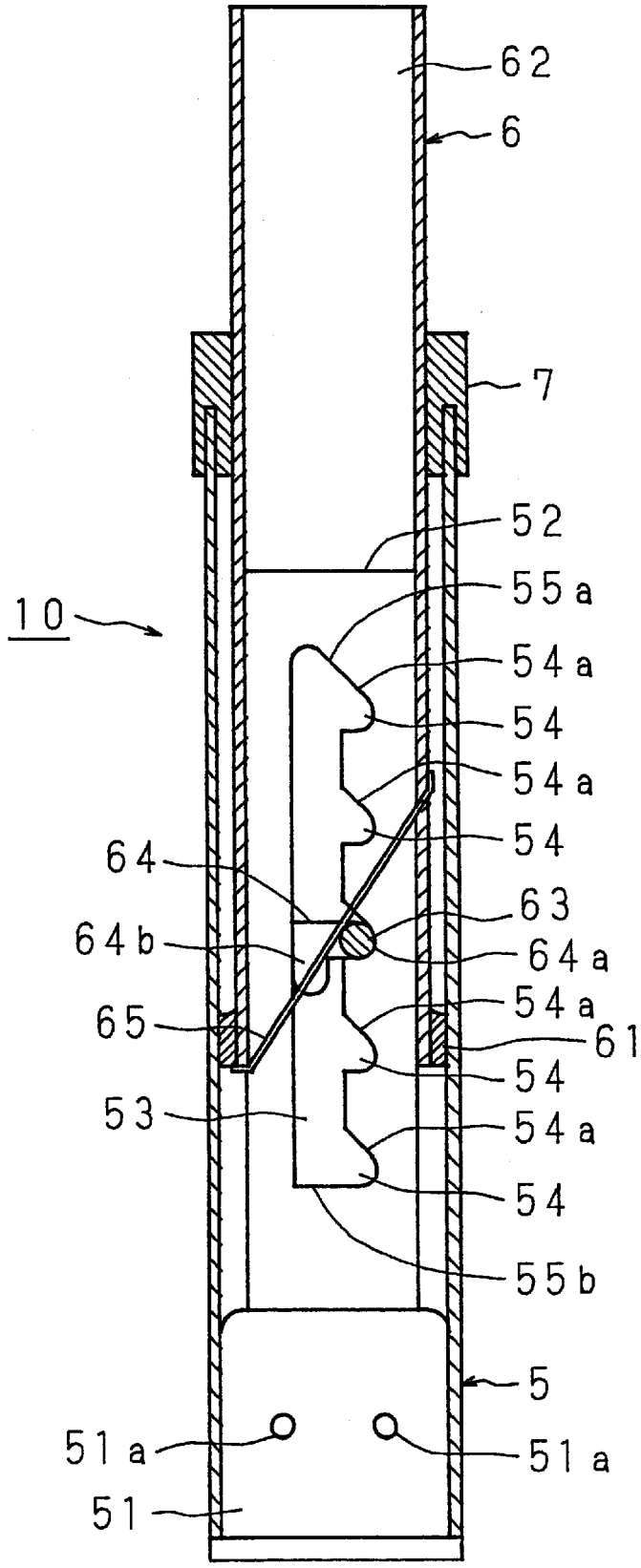
FIG. 6 is an explanatory drawing that shows the configuration and operation of Embodiment 2 of the telescopic member according to the present invention.
Figure 8:
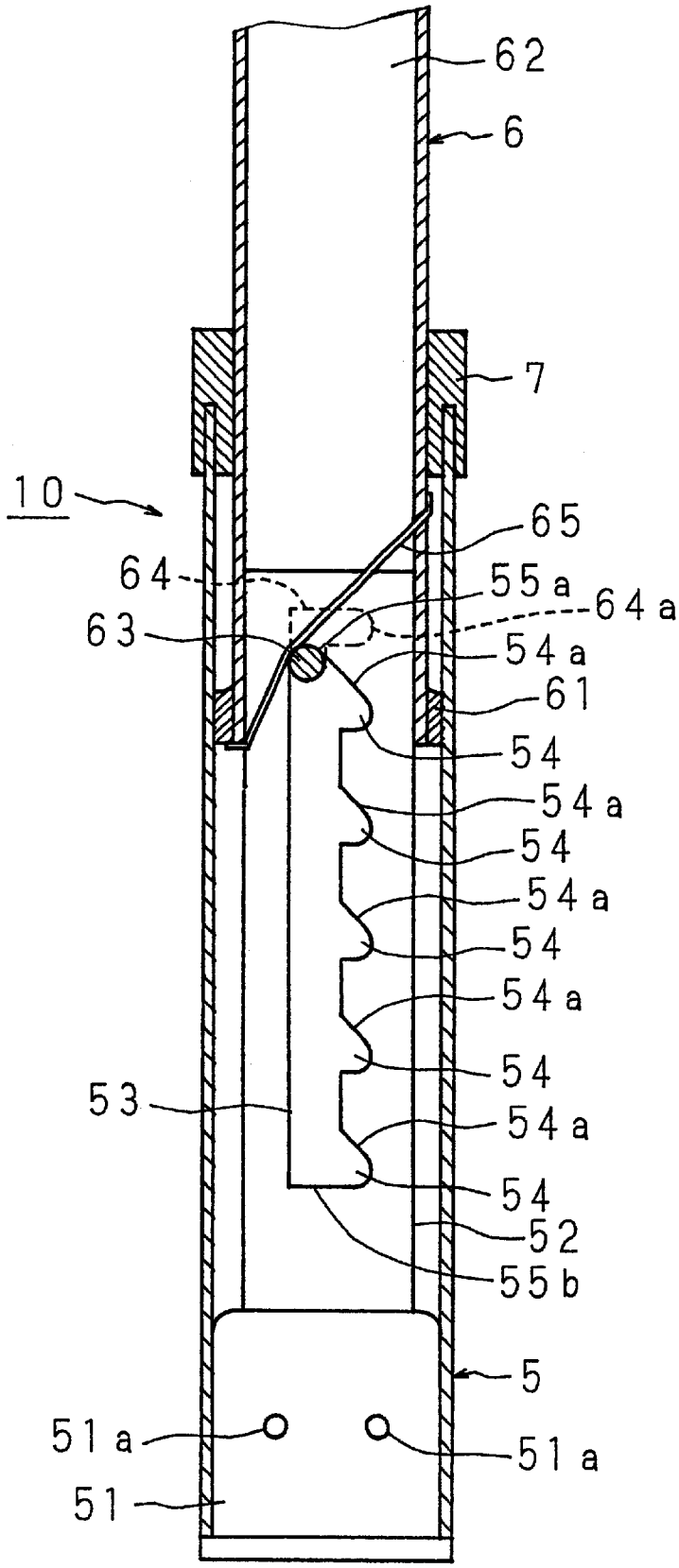
FIG. 8 is an explanatory drawing that shows the configuration and operation of Embodiment 2 of the telescopic member according to the present invention.
Figure 9:
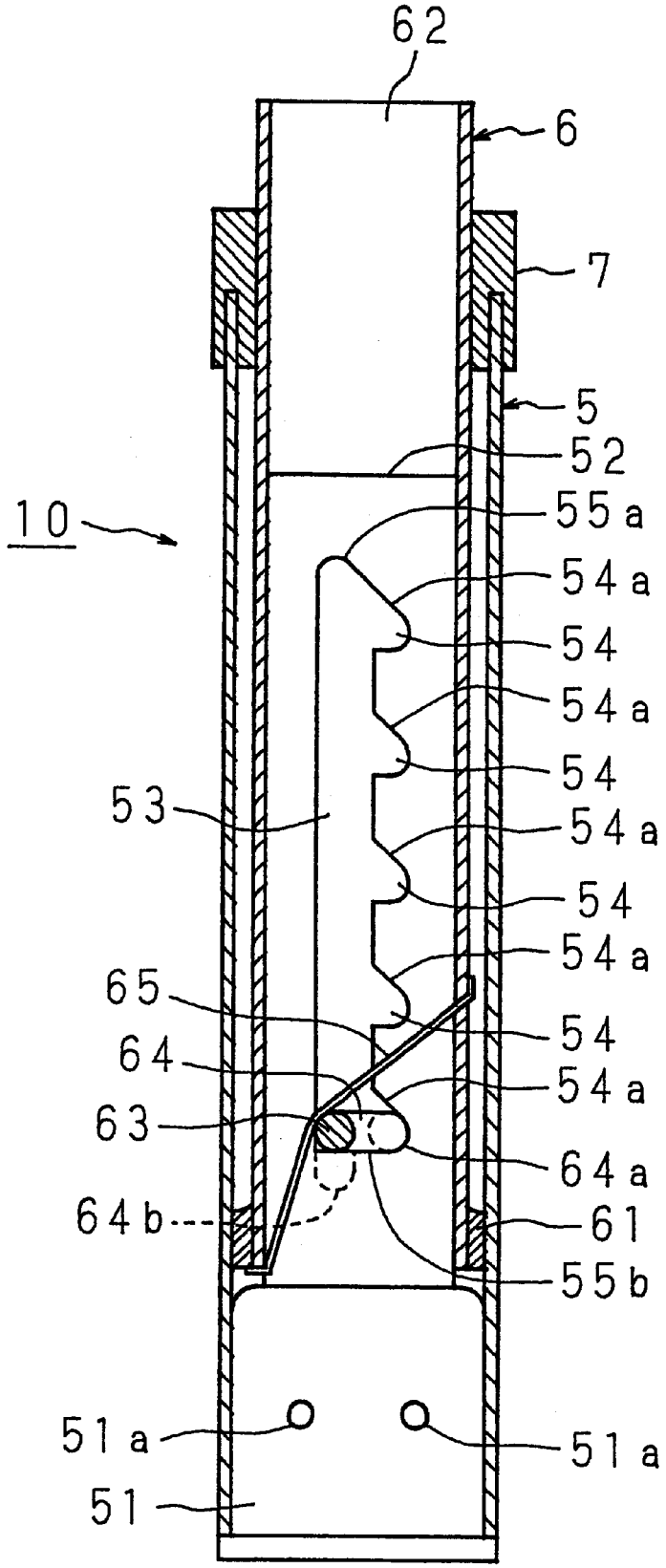
FIG. 9 is an explanatory drawing that shows the configuration and operation of Embodiment 2 of the telescopic member according to the present invention.
Figure 10:
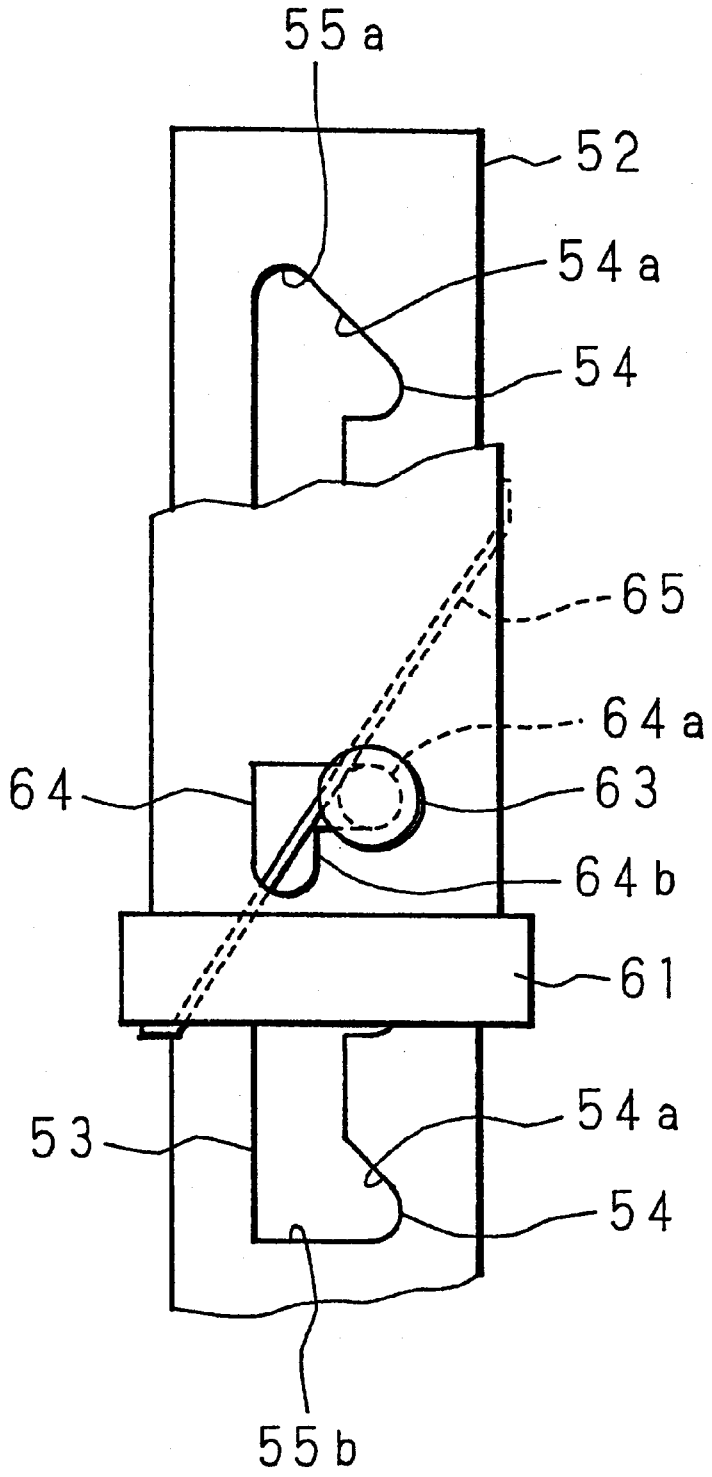
FIG. 10 is a drawing that shows the essential portion of the telescopic member in the state shown in FIG. 6.

FIGS. 6 through 9, which are partial longitudinal cross-sectional views, are explanatory drawings that show the configuration and operation of Embodiment 2 of a telescopic member according to the present invention. Moreover, FIG. 10 is a drawing that shows the essential portion of the telescopic member in the state as shown in FIG. 6. The telescopic member 10 of the present embodiment is, for example, installed in a car seat in which the height of the head rest portion is adjustable.

As illustrated in the Figures, in this telescopic member 10, into an outer cylinder 5 having an oval shape in its cross-section that has two plain surfaces 62 opposing each other in parallel with its long axis direction, an inner cylinder 6 having a shape similar to the outer cylinder 5 with a slightly smaller diameter is inserted so as to freely slide in the axial direction of the outer cylinder 5. The outer cylinder 5 is buried in the upper portion of the back rest of the seat with the inner cylinder 6 sticking up from the outer cylinder 5, and when used, the protruding upper end portion is buried into the head rest portion from lower side. In the respective Figures, only the telescopic member 10 is shown for convenience of explanation.

To the lower end portion of the outer cylinder 5, a bottom cap 51 made of a rubber material is attached with its one portion fitted thereinto, and two screws (not shown) are inserted from the outside of the outer cylinder 5 and engaged with two screw holes 51a formed in this fitting portion so that the bottom cap 51 is secured therein. Moreover, the portion of the bottom cap 51 protruding from the lower end of the outer cylinder 5 has a shape that is coincident with the outside shape of the outer cylinder 5. Here, since the telescopic member 10 of the present embodiment is provided with the bottom cap 51 of this type, it can be used in the same manner as Embodiment 1.

At the upper end portion of the bottom cap 51, a pillar-shaped body 52, which has a rectangular plate shape and protrudes upward so as to be inserted into the inner cylinder 6, is formed so as to stick out with its longitudinal direction being coincident with the longitudinal direction (the up-and-down direction in the Figures) of the outer cylinder 5 and the inner cylinder 6; thus, it is placed in the center of the outer cylinder 5 and the inner cylinder 6 with its plate face set in parallel with the major axes of the outer cylinder 5 and the inner cylinder 6 in their cross-sections.

Moreover, a slit 53 elongated in the longitudinal direction is formed in the pillar-shaped portion 52, and the slit 53 has a waveform shape on its right side as shown in the respective Figures so that the respective recess portions of the waveform form a plurality of engaging portions 54. A slanting portion 54*a*, which tilts toward upper left in the respective Figures, is formed on the upper portion of each engaging portion 54, and the lower portion is formed into a linear shape in the lateral direction in the respective Figures. The upper end portion of the slit 53, which connects to the slanting portion 54*a* of the engaging portion 54 at the uppermost stage, is formed into a first control portion 55*a* used for releasing a stopper pin 63, which will be described later, from the engaging portion 54 at the uppermost stage. Moreover, the lower end portion of the slit 53, which connects to the linear lower portion of the engaging portion 54 at the lowermost stage, is formed into a second control portion 55*b* for allowing the stopper pin 63 to return to its engagement with the engaging portion 54 at the lowermost stage.

To the lower end portion of the inner cylinder 6, a cylindrical spacer 61 is externally fitted and secured with its outside being coincident with the inner circumferential surface of the outer cylinder 5, and the lower end portion of the inner cylinder 6 is maintained by the spacer 61 in a concentric manner with respect to the outer cylinder 5, and a frictional force is applied to the relative movement of the inner cylinder 6 with respect to the outer cylinder 5 to a certain extent.

Moreover, the above-mentioned stopper pin 63 is embedded into the opposing plain surfaces 62 of the inner cylinder 6 so as to penetrate them in the front to rear direction in the respective Figures. A hole (guide hole) 64 through which the stopper pin 63 penetrates has a length covering from the left end of the slit 53 to the right end of the engaging portions 54 in the lateral direction in the Figures, and is formed into an up-side-down L-letter shape having length of both legs corresponding approximately to the diameter of the stopper pin 63, the one of the legs extends downward from the left end of the lateral portion. Here, the portion of the guide hole 64 that extends laterally is referred to as a first guide portion 64*a* and the portion that extends downward is referred to as a second guide portion 64*b*.

In FIGS. 6 and 10, the stopper pin 63 engages one of the engaging portions 54 in the middle, and also engages the first guide portion 64*a*. This engaging state is maintained by a pressing force of a U-letter shape spring 65 placed its one end contacting the portion of the spacer 61 on the side opposite to the side having the engaging portions 54, while its middle portion contacting the upper left portion of the stopper pin 63, further reaches the rear side of the inner cylinder 6 in each of the Figures, thereby forming a loop shape.

In this state, even when an attempt is made to move the inner cylinder 6 in the push-in direction into the outer cylinder 5, that is, even when an attempt is made to shorten the telescopic member 10, the movement or the shortening is not possible, since the stopper pin 63 is held between the upper end of the first guide portion 64 installed in the inner cylinder 5 and the lower end of the engaging portion 54 of the pillar-shaped body 52 installed in the outer cylinder 5.

In contrast, when the inner cylinder 6 is moved in the pull-out direction from the outer cylinder 6 from the state shown in FIGS. 6 and 10, that is, when the telescopic member 10 is extended, the stopper pin 63 engaging the guide hole 64 formed in the inner cylinder 6 is moved upward together with the inner cylinder 6. At this time, the stopper pin 63 is slidden along the slanting portion 54*a* of the engaging portion 54 with which it is currently engaged, that is, it is shifted leftward in the guide hole 64 against the pressing force of the spring 65 along the first guide portion 64*a*. This movement releases the stopper pin 63 from the engagement with the engaging portion 54, with the result that the stopper pin 63 is allowed to rise along the slit 53 together with the inner cylinder 6, and as it reaches the position of another engaging portion 54 adjacent to the former engaging portion 54 above, it is allowed to engage this engaging portion 54 by the pressing force of the spring 65, and again to return to its engaging state as shown in FIGS. 6 and 10.

Figure 7:
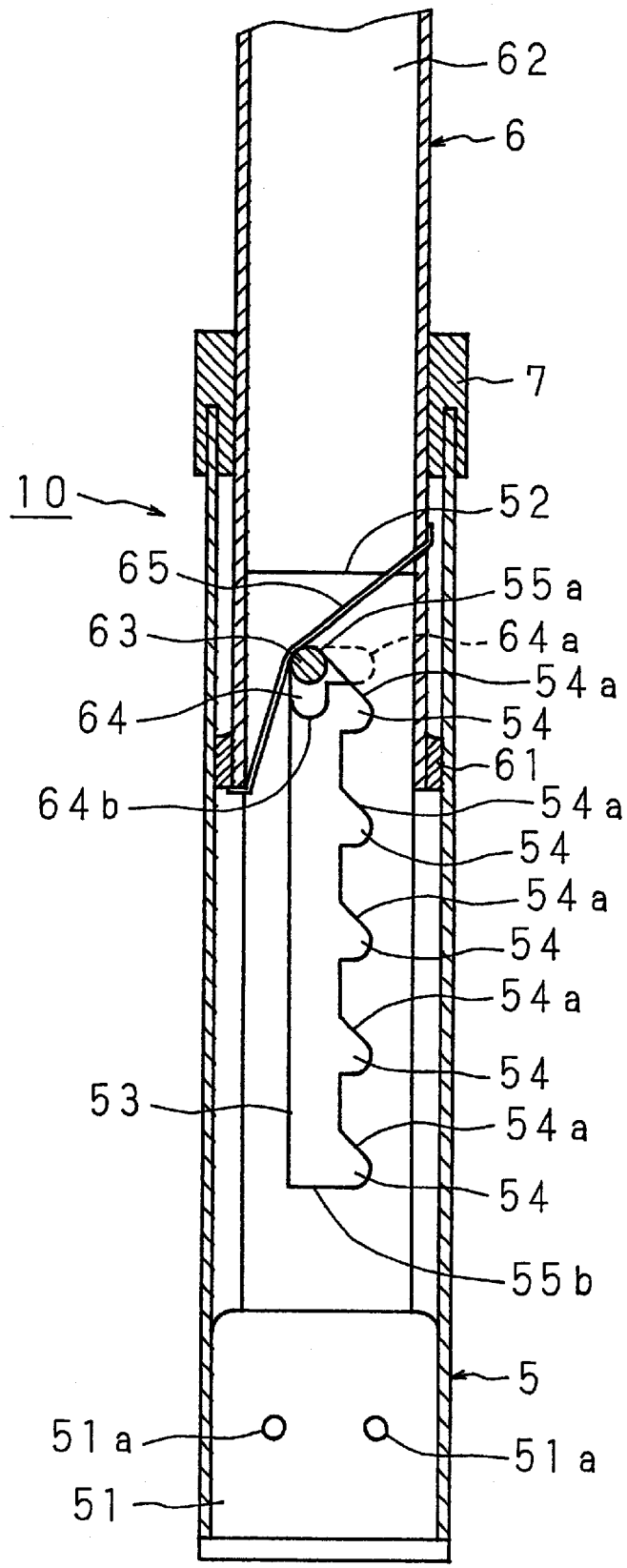
FIG. 7 is an explanatory drawing that shows the configuration and operation of Embodiment 2 of the telescopic member according to the present invention.

From a state where, after having repeated the above-mentioned operations, it engages the engaging portion 54 at the uppermost stage, as shown in FIG. 7 as the inner cylinder 6 is further moved upward, the stopper pin 63 is shifted in the first guide portion 64*a* leftward as being shifted to upper left direction along the slanting portion 54*a* of the engaging portion 54 against the pressing force of the spring 65 in the same manner as described earlier, and reaches the first control portion 55*a* of the slit 53. Then, as the inner cylinder 6 is further moved upward, the stopper pin 63 is shifted in the guide hole 64 toward the second guide portion 64*b*, as shown in FIG. 8, with the result that it is prevented from its lateral movement as shown in the present Figure.

In this held state of the stopper pin 63 from the movement in the lateral direction, the stopper pin 63 is not allowed to engage the engaging portions 54 so that the inner cylinder 6 can be moved downward, that is, the telescopic member 10 can be shortened. Then, as illustrated in FIG. 9, when the cylinder 6 is moved to the lower moving end, the stopper pin 63, located at the lower end of the second guide portion 64*b*, is allowed to contact the second control portion 55*b* that is the lower end of the slit 53, with the result that it is pushed upward along the second guide portion 64*b*. Following this action, the stopper pin 63 is released from its lateral held state so that it is shifted rightward along the first guide portion 64*a* in the present Figure, and allowed to engage the engaging portion 54 at the lowermost stage; thus, it returns to its original state as shown in FIGS. 6 and 10.

Figure 11A:
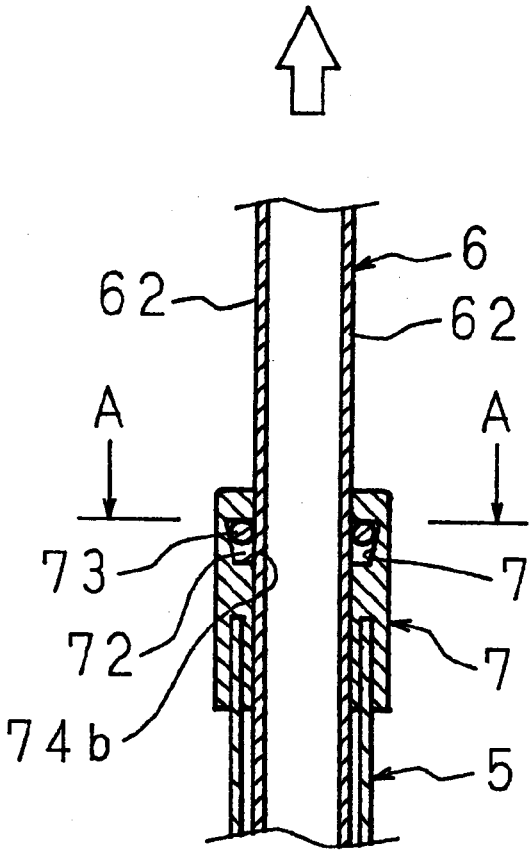
FIGS. 11A and 11B are explanatory drawings that show the movements of a friction body provided as a molded body in the telescopic member shown in FIG. 6.
Figure 11B:
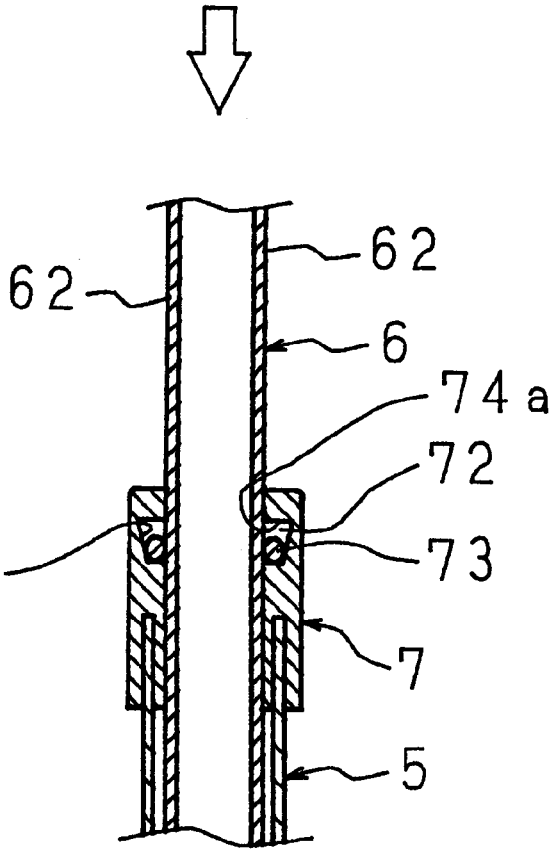
Figure 12:
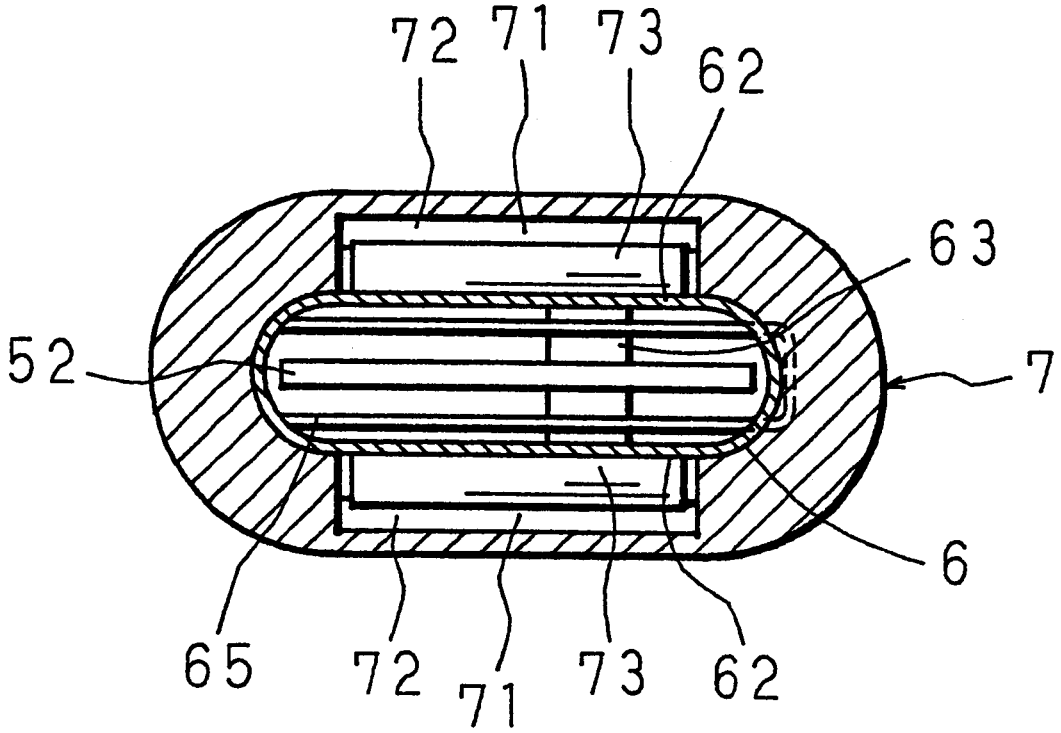
FIG. 12 is a cross-sectional view taken along line A—A in FIG. 11A.

FIGS. 11A and 11B are explanatory drawings that show the movements of a friction body provided as a molded body in the telescopic member shown in FIG. 6, and FIG. 12 is a cross-sectional view taken along line A—A in FIG. 11A. A holder 7 is attached to the upper end portion of the outer cylinder 5 as a cylindrical body having an oval cylindrical shape with its inner circumferential surface contacting the outer circumferential surface of the inner cylinder 6. This holder 7 maintains the inner cylinder 6 in a concentric manner with respect to the outer cylinder 5 by its inner circumferential surface, and also applies frictional resistance to the movement of the inner cylinder 6 to a certain extent. Moreover, as clearly shown by FIG. 12, braking chambers 72, each provided as a recess portion in its longitudinal cross-section at one side in the same manner as Embodiment 1, are respectively installed at positions of the holder 7 corresponding to the pair of opposing plain surfaces 62 of the inner cylinder 6, and each braking chamber 72 is provided with a friction body 73 provided as a molded body having a roller (column) shape, made of a rubber material.

As illustrated in FIG. 11A, when the inner cylinder 6 is moved in the pull-out direction from the outer cylinder 5, the friction body 73 is allowed to roll on the plain surface 62 of the inner cylinder 6 following the movement of the inner cylinder 6, and moves inside the braking chamber 72 until it comes into contact with the first moving end surface 74*a* on the upper side. In contrast, as illustrated in FIG. 11B, when the inner cylinder 6 is moved in the push-in direction into the outer cylinder 5, the friction body 73 is allowed to roll in the direction reversed to the above-mentioned direction on the plain surface 62 of the inner cylinder 6 following the movement of the inner cylinder 6, and soon comes into contact with the second moving end surface 74*b*, and also comes into contact with a taper surface 71 almost at the same time. With this arrangement, each of the friction bodies 73 is appropriately compressed and deformed among the plain surface 62 of the inner cylinder 6, the taper surface 71, and the second moving end surface 74*b*; however, it is allowed to roll on these pressing surfaces. This rolling movement applies an appropriate braking force (frictional force) to the further movement of the inner cylinder 6 in the push-in direction; thus, upon shortening the length of the telescopic member 10, it is possible to suppress an abrupt movement of the inner cylinder 6 in the push-in direction, and since the rolling movement of each friction body 73 is maintained, it is possible to prevent the frictional force from becoming too great.

Embodiment 3

Figures 13A, 13B:
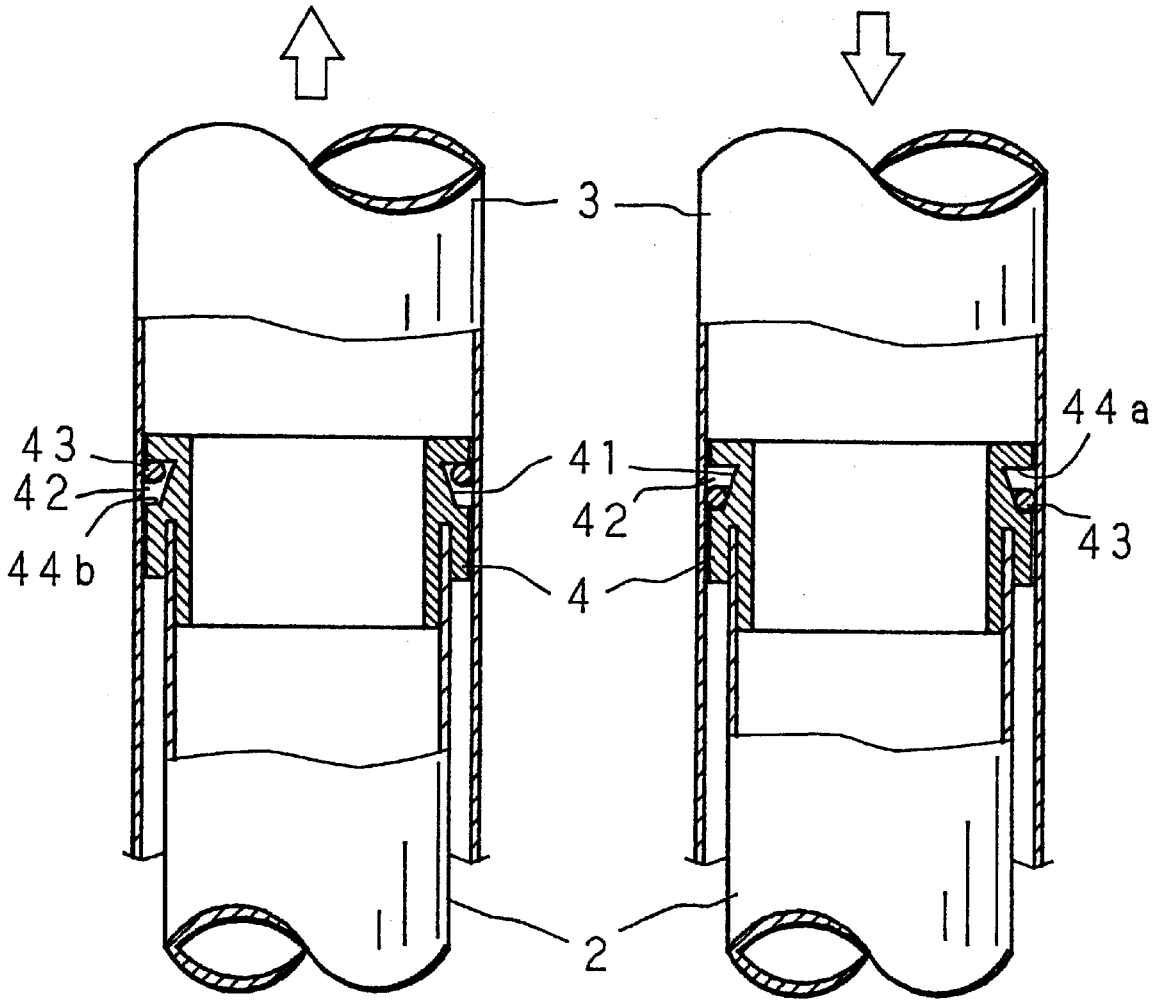
FIGS. 13A and 13B are longitudinal cross-sectional views of essential portions of the telescopic member that show still another Embodiment (Embodiment 3) of a holder provided as a cylindrical body according to the present invention.

FIGS. 13A and 13B are longitudinal cross-sectional views, each showing an essential portion of a telescopic member that shows still another Embodiment (Embodiment 3) of a holder provided as a cylindrical body according to the present invention. In the present Embodiment, a holder 4 serving as the cylindrical body is installed in the inner cylinder 2, and for this reason, the braking chamber 42 is placed on the outer circumferential surface of the holder 4. Except this arrangement, the other configurations and functions are the same as those of Embodiment 1, therefore, by using the same reference numerals, the detailed description thereof is omitted.

More specifically, the cylindrical holder 4 is attached to the upper end portion of an inner cylinder 2, with its outer circumferential surface contacting the inner circumferential surface of an outer cylinder 3. The holder 4 maintains the outer cylinder 3 in a concentric manner with respect to the inner cylinder 2 by its outer circumferential surface, and also applies frictional resistance to the movement of the outer cylinder 3 to a certain extent. Moreover, a braking chamber 42, which is a recess portion with its face opposing the inner circumferential surface of the outer cylinder 3 being shaped into a taper surface 41, is formed around the outer circumferential surface of the holder 4, and a friction body 43 provided as a molded body in the same manner as Embodiment 1 is fitted into the braking chamber 42. Here, the braking chamber 42 is oriented in the same manner as Embodiment 1.

Therefore, as illustrated in FIG. 13A, when the outer cylinder 3 is moved in the pulling-up direction, the friction body 43 is allowed to shift upward inside the braking chamber 42 until it comes into contact with the first moving end surface 44*a* on the upper side, following the movement of the outer cylinder 2. At this time, since the friction body 43 is maintained in contact with the inner circumferential surface of the outer cylinder 3 and the first moving end surface 44*a*, it is allowed to roll so that the outer cylinder 3 can be pulled up without receiving a resistant force so much.

As illustrated in FIG. 13B, when the outer cylinder 3 is moved in the push-in direction, the friction body 43 is allowed to shift until it comes into contact with the second moving end surface 44*b* on the lower side, following the movement of the outer cylinder 3, and also comes into contact with the taper surface 41. Thus, the friction body 43 is appropriately compressed and deformed among the inner circumferential surface of the outer cylinder 3, the taper surface 41, and the second moving end surface 44*b*; however, it is allowed to roll on these pressing surfaces. This rolling movement applies an appropriate braking force (frictional force) to the further movement of the outer cylinder 3 in the push-in direction, so that it is possible to prevent an abrupt movement in the push-in direction, and since the rolling movement of the friction body 43 is maintained, it is possible to prevent the frictional force from becoming too great.

Additionally, by setting the above-mentioned arrangement upside-down, it can be applied to the arrangement of Embodiment 1, as it is.

Figure 14:
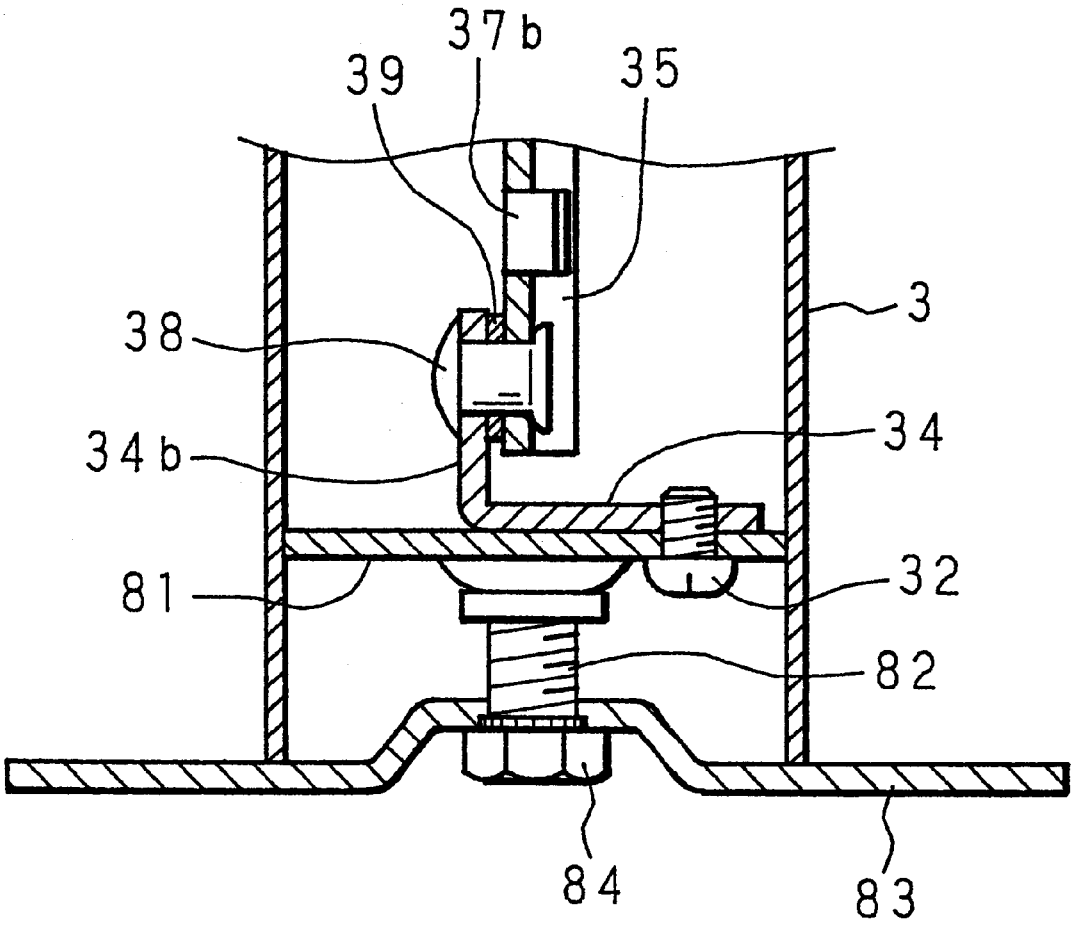
FIG. 14 is a partial longitudinal cross-sectional view that shows the essential portion of the telescopic member disclosed in the present invention.
Figure 15:
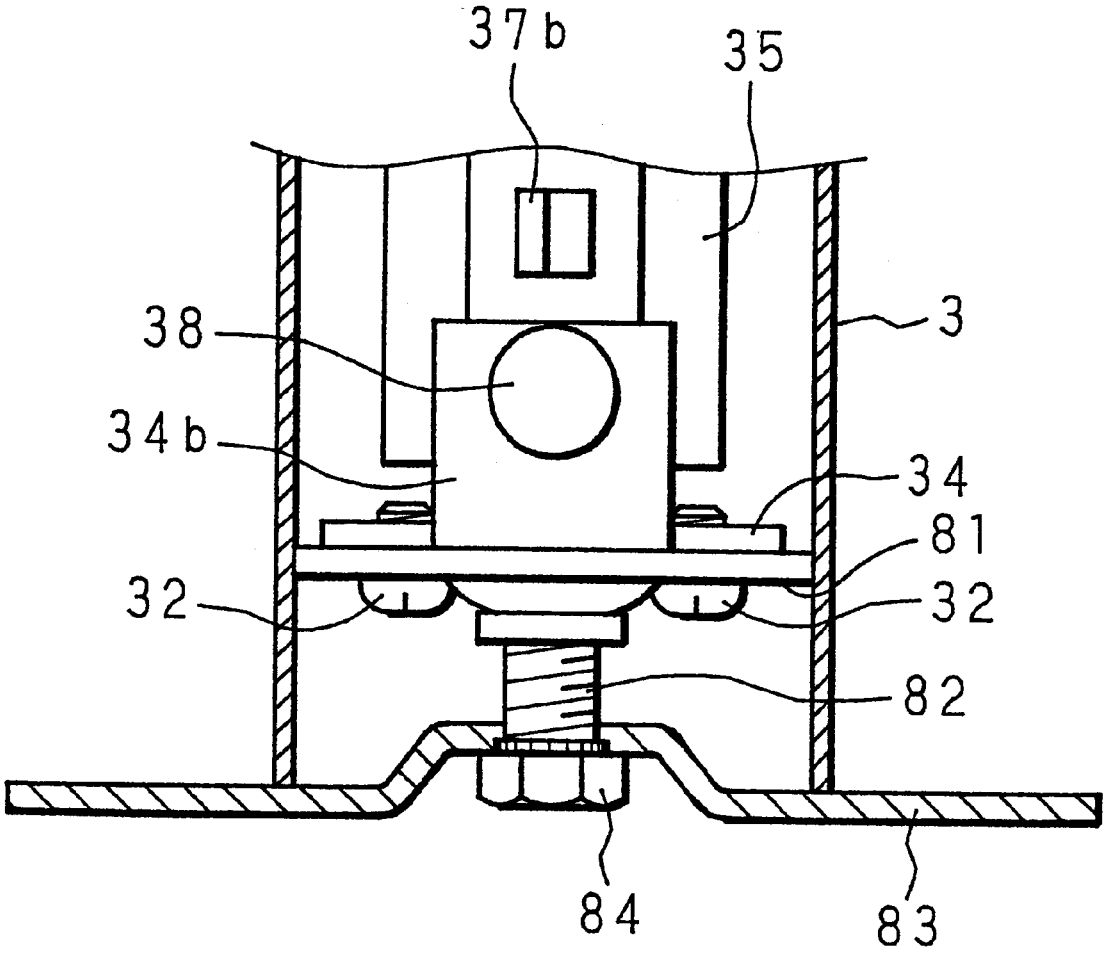
FIG. 15 is a cross-sectional side view seen from the left side of FIG. 14.

FIG. 14 is a partial longitudinal cross-sectional view that shows a portion of a telescopic member disclosed by the present invention, and FIG. 15 is a cross-sectional side view seen from the left side. In the telescopic member disclosed in the present invention, the base portion 34 and the upright portion 35 of the pillar-shaped body 33 shown in Embodiment 1 are provided as separate parts. In particular, the base portion 34 is integrally provided with a stand-up portion 34*b* along one side face of the plate-shape upright portion 35 at the end of the securing side of the upright portion 35.

Holes having the same diameter are respectively formed in the stand-up portion 34b and the lower end of the upright portion 35, and a rivet 38 is inserted through these holes so that the stand-up portion 34*b* and the upright portion 35 are connected by the rivet 38 so as to freely swing around the rivet 38. Moreover, a washer 39, made of nylon, is attached to the rivet 38 between the stand-up portion 34*b* and the upright portion 35. Here, the washer 39 may be formed by using another synthetic resin. Moreover, the washer 39 may be omitted from this configuration.

The base portion 34 is secured to a disk-shaped inner cap 81 welded to a position with a predetermined distance apart from the lower end of the outer cylinder 3, by using two screws 32. A male screw portion 82 is formed in the center of the inner cap 81 so as to stick out downward.

Moreover, an outer cap 83 made of metal having a diameter larger than that of the outer cylinder 3 is allowed to contact the lower end face of the outer cylinder 3 with its center portion formed into a recess portion dented upward, and a stepped hole is formed in this recess portion. This stepped hole is provided with a hole portion that has a large-diameter on the lower side, and a lock nut 84 is riveted into this hole portion on the larger-diameter side from below so that the male screw portion 82 of the aforementioned inner cap 81 is allowed to engage this from above.

The telescopic member of the present disclosure has the above-mentioned arrangement; and those portions that are the same as Embodiment 1 are indicated by the same reference numerals and the description thereof is omitted.

Here, the base portion 34 secured to the inner cap 81 and the upright portion 35 which is locked in its positional relationship with the inner circumferential surface of the inner cylinder 3 by the aforementioned holding portion (not shown) of the aforementioned Embodiment 1 are connected by the rivet 38; therefore, the dimensional dispersion in the individual members can be appropriately absorbed by the swinging movements around the rivet 38 as a rotational axis. Furthermore, since the washer 39 made of an elastic material is interpolated between the stand-up portion 34*b* and the upright portion 35 of the base portion 34, swinging movements in the directions orthogonal to the above-mentioned swinging directions are allowed so that the dimensional dispersion can be absorbed also in these directions.

Additionally, the arrangement of this disclosure may of course be applied to the telescopic member 1 of the aforementioned Embodiment 1, as well as to the telescopic member 100 of the conventional arrangement.

Figure 16:
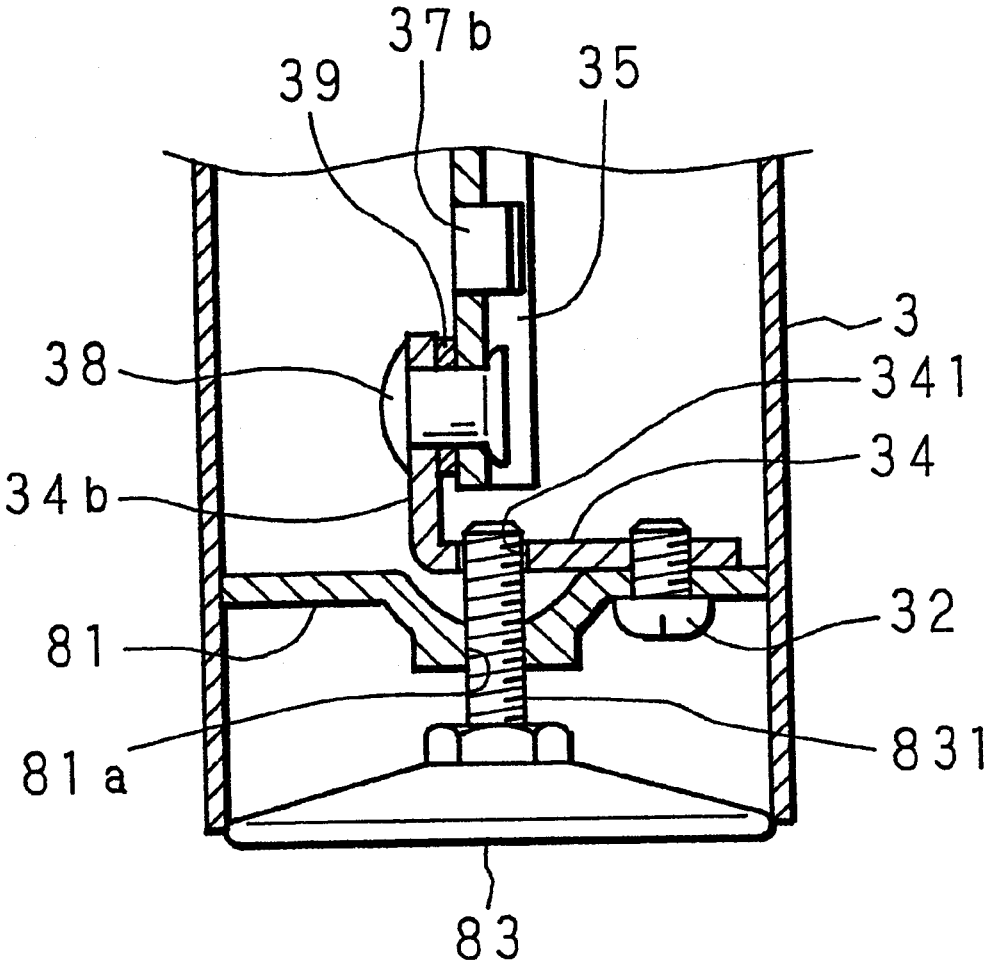
FIG. 16 is a partial longitudinal cross-sectional view that shows an essential portion of another telescopic member disclosed in the present invention.
Figure 17:
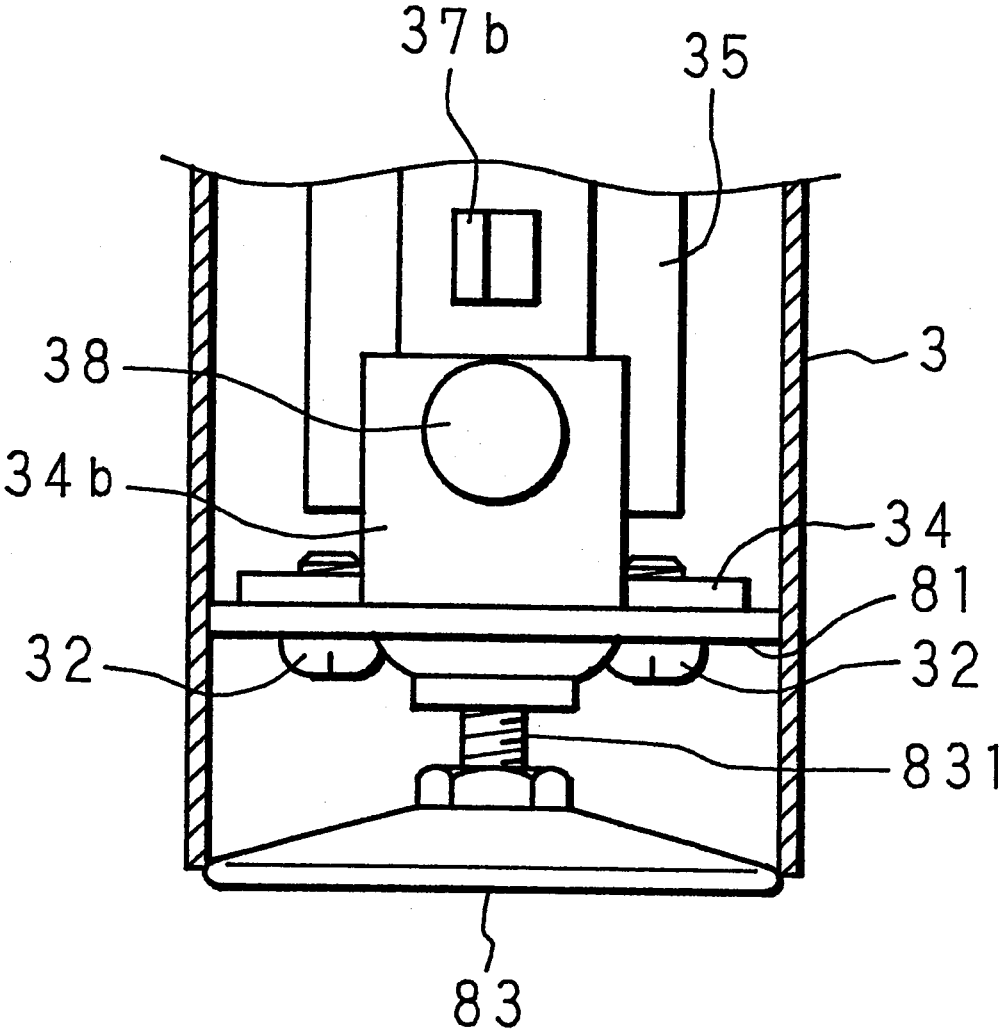
FIG. 17 is a cross-sectional side view seen from the left side of FIG. 16.

FIG. 16 is a partial longitudinal cross-sectional view that shows an essential portion of another telescopic member disclosed by the present invention, and FIG. 17 is a cross-sectional side view seen from the left side. In the telescopic member of the present disclosure, with respect to the arrangement as disclosed above, the inner cap 81 is protruded in its center portion downward by means of pressing and a female screw portion 81*a* is formed in the protruded portion.

A male screw portion 831, which sticks out from the center portion of the upper face of the outer cap 83 made of synthetic resin having a disk-shape with a flat bottom, engages the female screw portion 81*a* from below, and the tip of the engaged male screw portion 831 is inserted through a perforation 341 formed in the corresponding position of the base portion 34. The outer cap 83, which has a diameter smaller than the outer diameter of the outer cylinder 3 and slightly larger than the inner diameter of the outer cylinder 3, is formed so as to have a round shape along its circumferential edge portion. Therefore, the circumferential edge portion of the outer cap 83 has its upper half portion embedded into the inner diameter portion of the outer cylinder 3 along its entire circumference following the engagement of the male screw portion 831, so that the outer cap 83 is secured to the inner cap 81 while being closely in contact with the bottom end portion of the outer cylinder 3.

The telescopic member of the present disclosure has the above-mentioned arrangement, and those portions that are the same as the above-mentioned disclosure are indicated by the same reference numerals and the description thereof is omitted.

Figure 18:
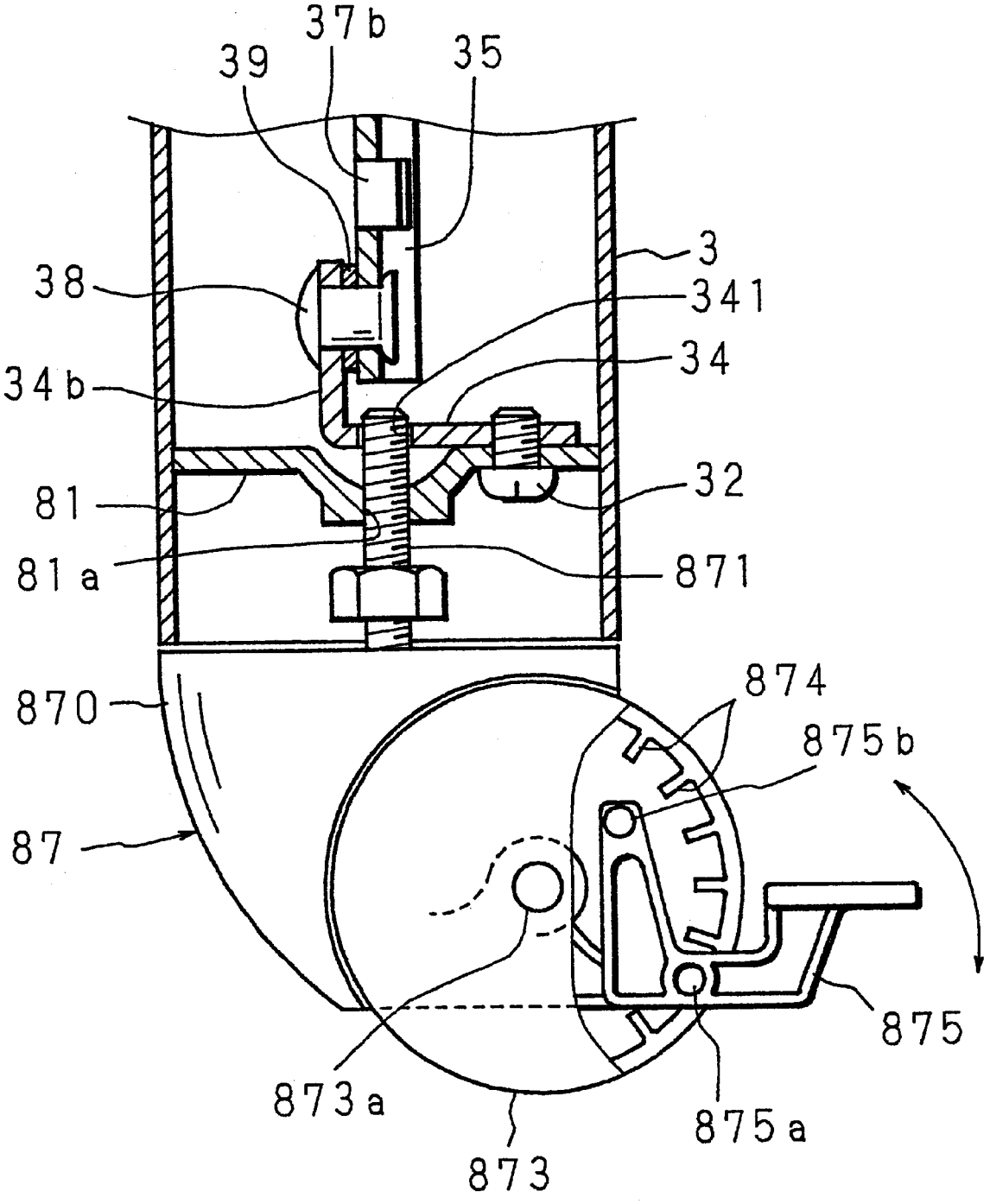
FIG. 18 is a partial longitudinal cross-sectional view that shows an essential portion of still another telescopic member disclosed in the present invention.
Figure 19:
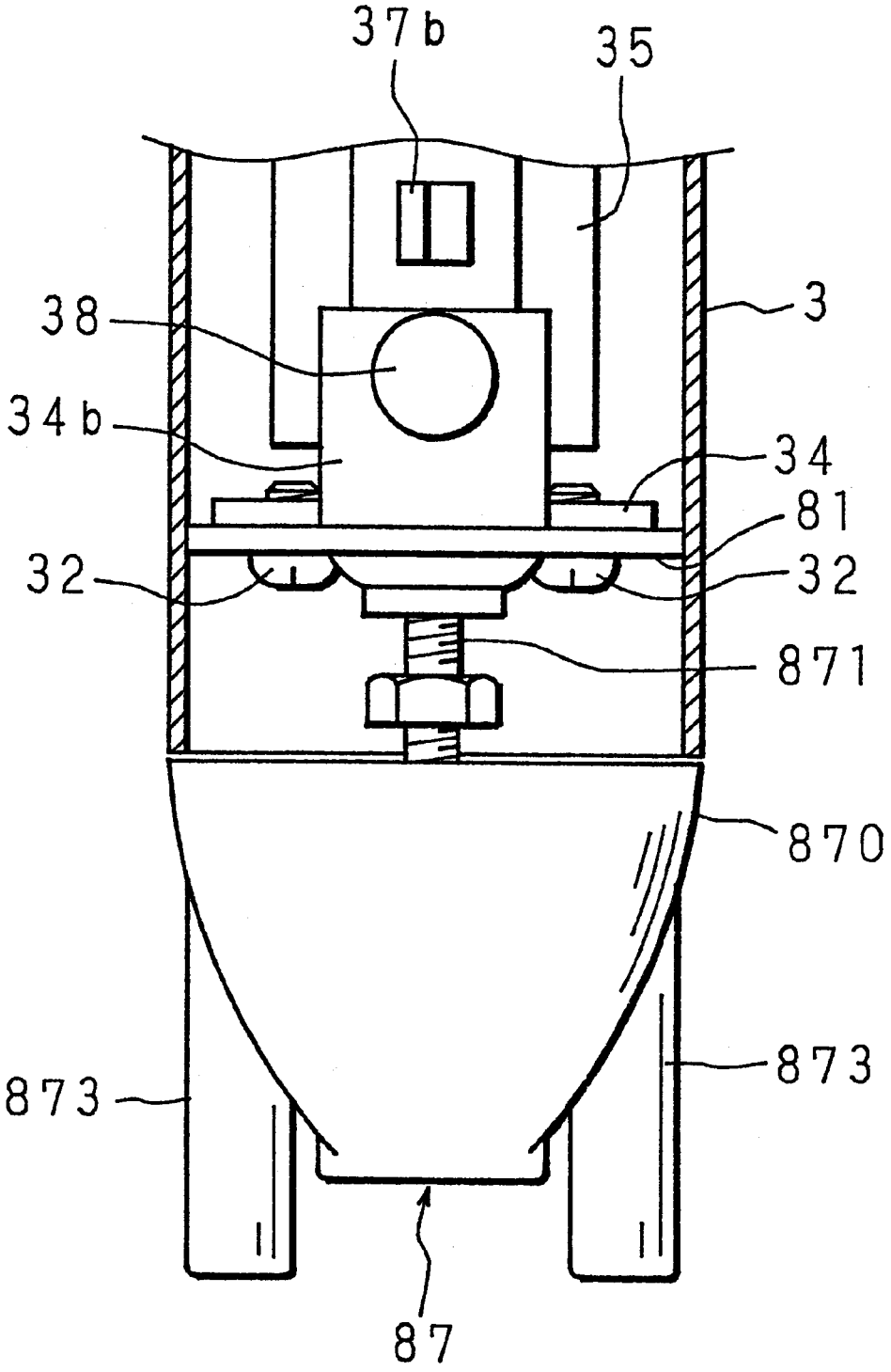
FIG. 19 is a cross-sectional side view seen from the left side of FIG. 18.

FIG. 18 is a partial longitudinal cross-sectional view that shows an essential portion of still another telescopic member disclosed by the present invention, and FIG. 19 is a cross-sectional side view seen from the left side. In this telescopic member, instead of the outer cap 83 of the above-mentioned disclosure, a caster 87 is attached thereto.

In this caster 87, its main body portion 870 has a securing portion to the inner cap 81 that is formed so as to have the same outer diameter as that of the outer cylinder 3, and the rest of the main body portion 870, which connects to the downward portion from the securing portion, is formed into a semi-spherical shape in its half portion on one side (on the left side in FIG. 18). On the other hand, the rest half portion of the main body portion 870 (on the right side in FIG. 18) is provided with recess portions for housing a pair of wheels 873, and these wheels 873 are coaxially supported on a horizontal shaft 873a in the front to rear direction in FIG. 18 so as to freely rotate.

In the main body portion 870 between the pair of wheels 873 that extends to the right side from the horizontal shaft 873*a*, a horizontal shaft 875*a* is installed in the front to rear direction, and a lever-shaped stopper 875 is formed on the horizontal shaft 875*a* so as to freely swing thereon. The stopper 875 has an operation portion that is sticks out rightward from the wheels 873, and a portion on the left side of the horizontal shaft 875*a* is formed into a bent shape upward. Moreover, a stopper pin 875*b* protruding toward both of the sides in the front to rear direction is secured to the tip of this bent shape.

Each of the pair of wheels 873 has a wheel stopping portion provided as a plurality of small members 874 placed in radially in radius directions on its circumferential portion on the side facing the other. Therefore, when the operation portion of the stopper 875 is pushed down, the stopper pin 875*b* engages one of the wheel stopping portion 874 so that the rotation of the wheels 873 are stopped. Here, when the stopper 875 is operated reversely, the wheels 873 are released from the engagement.

The securing portion of the caster 87 to the inner cap 81 is provided with a male screw portion 871 placed on the main body portion 870 so as to stick out in the center so as to freely rotate on the longitudinal axis, and this male screw portion 871 is engaged with the female screw portion 81*a* of the inner cap 81 so as to be secured thereto in the same manner as described earlier.

The telescopic member of the present disclosure has the above-mentioned arrangement; and those parts that are the same as the aforementioned disclosure are indicated by the same reference numerals, and the description thereof is omitted.

Therefore, for example, a table T to which the telescopic member having such an arrangement is attached can be freely slidden, and when used, the slide can be stopped by using the stopper 875.

Additionally, the arrangements of these three disclosures may of course be applied to the telescopic member 1 of Embodiment 1, as well as to the telescopic member 100 having the conventional arrangement.

Embodiment 4

Figure 20:
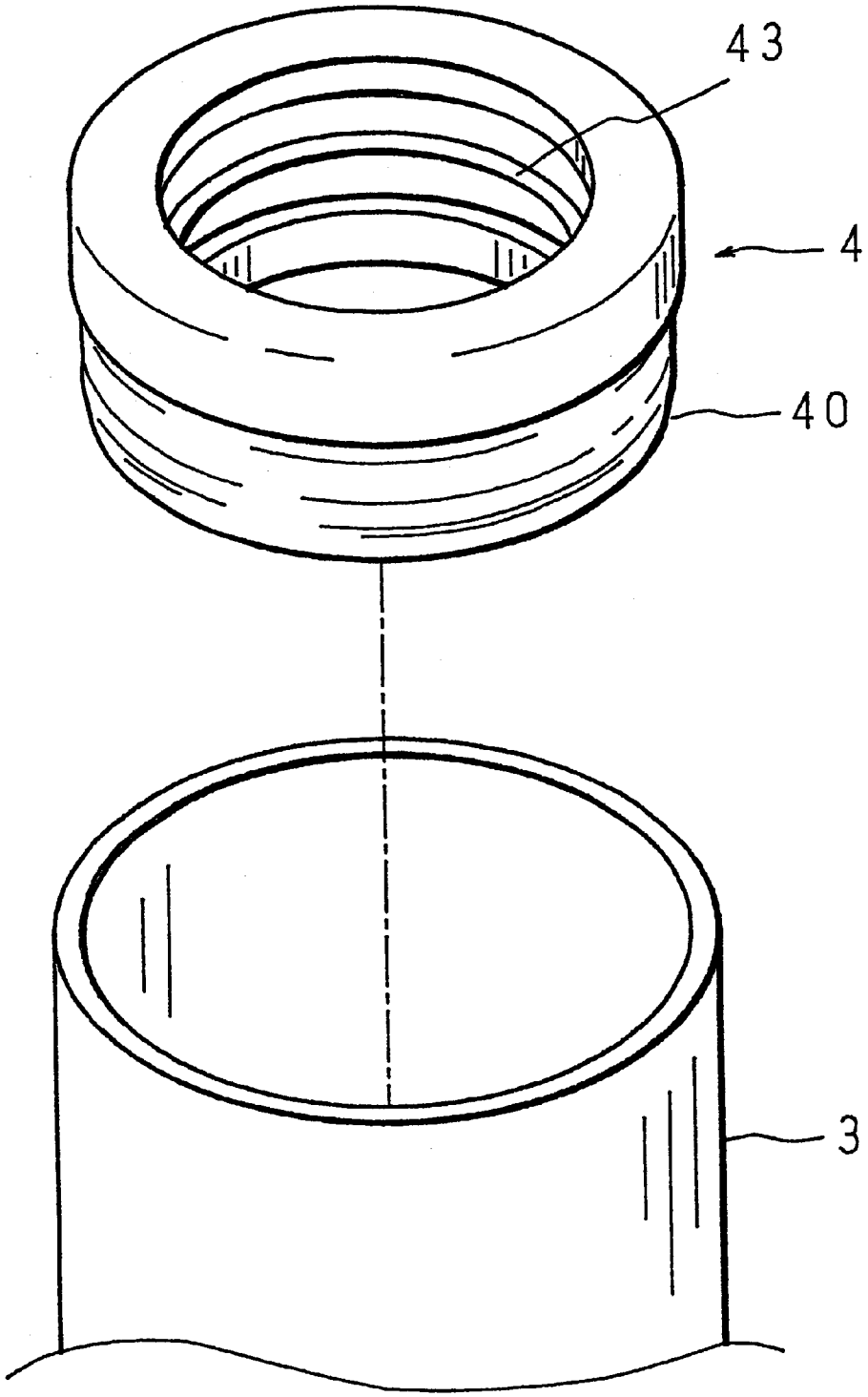
FIG. 20 is a perspective view that shows still another Embodiment (Embodiment 4) of a holder provided as a cylindrical body according to the present invention.
Figure 21:
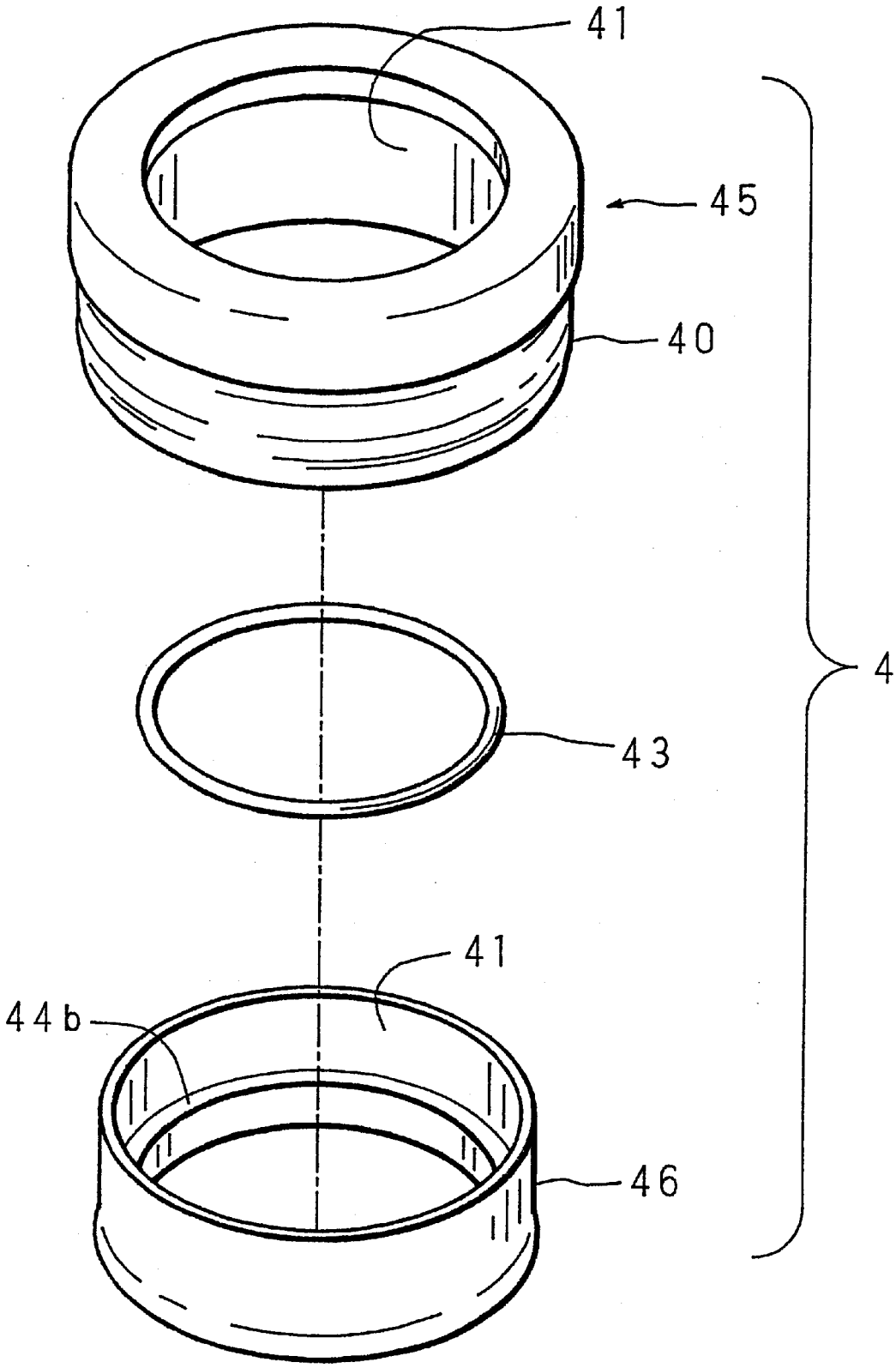
FIG. 21 is an exploded perspective view of the holder shown in FIG. 20.
Figure 22:
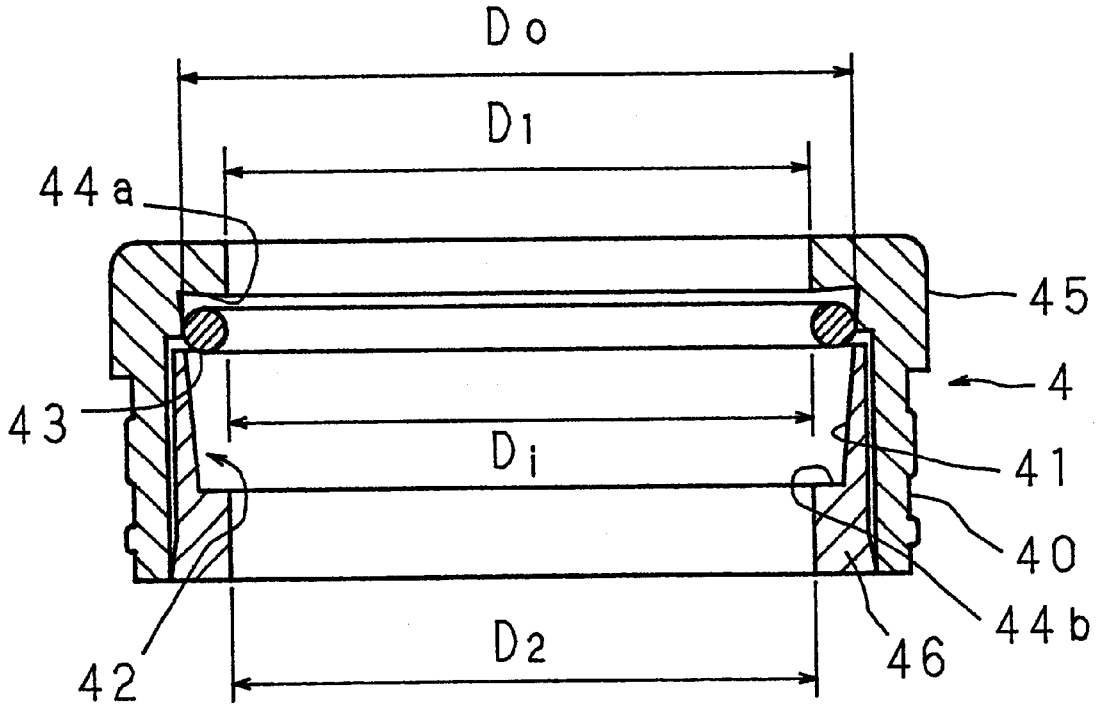
FIG. 22 is a longitudinal cross-sectional view of the holder shown in FIG. 20.

FIG. 20 is a perspective view that shows still another Embodiment (Embodiment 4) of a holder provided as a cylindrical body according to the present invention: FIG. 21 is an exploded perspective view of the holder shown in FIG. 20: and FIG. 22 is a longitudinal cross-sectional view of the holder shown in FIG. 20. The holder 4 of the present Embodiment has a modified arrangement in which the fitting portion of the holder 4 to the outer cylinder 3 of the Embodiment 1 is changed, and the holder 4 is divided at a point halfway in the longitudinal direction of the braking chamber 42 formed in the holder 4, and the shape of the braking chamber 42 is improved. Except these changes, the other arrangements and functions are the same as Embodiment 1; therefore, the same reference numerals are used, and the description thereof is omitted.

In other words, in Embodiment 1, the shape of the fitting portion of the holder 4 into the outer cylinder 3 is designed so as to sandwich the inner and outer circumferential surfaces of the outer cylinder 3; however, in the present Embodiment, the fitting portion 40 is formed so as to fit to the inner circumferential surface of the outer cylinder 3. As illustrated in FIG. 20, this fitting portion 40 is made to have an outer diameter smaller than that of the main body of the holder 4. Moreover, two protrusions, one of them wide and the other narrow, are placed on the outer circumferential surface of the fitting portion 40; thus, as illustrated in FIG. 20, the fitting portion 40 of the holder 4 to be fitted into the outer cylinder 3 is positively held on the inner circumferential surface of the outer cylinder 3 with a higher contact property.

Moreover, as shown in its perspective view of FIG. 21 and its longitudinal cross-sectional view of FIG. 22, in the holder 4 of the present embodiment, the braking chamber 42 is divided into an upper portion and a lower portion, that is, first and second holder portions 45 and 46, in the halfway of the taper surface 41. More specifically, the dividing surface of the first and second holder portions 45 and 46 reaches the end surface of the fitting portion 40 from the halfway of the taper surface 41; thus, as illustrated in FIGS. 21 and 22, the second holder portion 46 is internally fitted to the first holder portion 45.

In this manner, prior to the assembly between the first holder portion 45 including the first moving end surface 44*a* and the second holder portion 46 including the second moving end surface 44*b*, the friction body 43, contained in the half portion of the braking chamber 42 on the second holder 46 side, is pushed in until its lower face comes into contact with the lower side end surface (the second moving end surface 44*b*) of the braking chamber 42. The second holder portion 46 in this state is internally fitted to the first holder portion 45 from below so that the holder 4 of the present embodiment is completed.

With the arrangement of the holder 4 as described above, the installation of the friction body 43 into the braking chamber 42 is more easily carried out, as compared with the integral-type holder 4 as shown in Embodiment 1, and the respective portions (the first and second holder portions 45 and 46) can be molded more easily. Such a dividing structure of the holder 4 may also be applied to the configuration of Embodiment 2 having the oval cross-section.

The holder 4 thus formed is secured to the outer cylinder 3 with its fitting portion 40 being internally fitted to the inner circumferential surface of the outer cylinder 3. The inner cylinder 2, which is inserted into the outer cylinder 3 prior to or after this process, has its outer circumferential surface held by the inner circumferential surface of the first holder portion 45 positioned above the upper half portion of the braking chamber 42 and the inner circumferential surface of the second holder portion 46 positioned below the lower half portion of the braking chamber 42. Therefore, the inner diameters $D_1$ and $D_2$ of the inner circumferential surface of the former and the inner circumferential surface of the latter are made to approximately coincide with the outer diameter of the inner cylinder 2 (see FIG. 22).

In this state, the inner diameter $D_i$ of the friction body 43 is set to be coincident with $D_1$ and $D_2$ of the first and second holder portions 45 and 46 at predetermined positions in the longitudinal direction of the braking chamber 42, that is, in the moving direction of the friction body 43. More preferably, these positions are set in the vicinity of the first moving end surface 44*a* on the upper side of the braking chamber 42.

With this setting, as the inner cylinder 2 is moved in the push-in direction to the outer cylinder 3, that is, as the telescopic member 1 is shortened, the friction body 43 is pressed inward in the radial direction along the taper surface 41 of the braking chamber 42 so that the outer diameter $D_0$ becomes smaller. In other words, the above-mentioned inner diameter $D_i$ also becomes smaller accordingly so that a predetermined braking force (frictional force) is applied to the outer circumferential surface of the inner cylinder 2.

In contrast, as the inner cylinder 2 is moved in the pull-out direction from the outer cylinder 3, that is, as the telescopic member 1 is extended, the friction body 43 comes to have a larger diameter by its elasticity while shifting (rolling) along the taper surface 41 of the braking chamber 42. In other words, the above-mentioned inner diameter $D_i$ and the outer diameter $D_0$ also become larger, with the result that at the time when $D_i=D_1$ or $D_2$, the frictional force of the friction body 43 applied to the inner cylinder 2 becomes approximately zero. However, in fact, since a portion of the friction body 43 is in contact with the outer circumferential surface of the inner cylinder 2, the frictional force does not become zero.

Then, when the upper face of the friction body 43 has reached the first moving end surface 44*a*, the friction body 43 is further widened in its diameter along the tapered first moving end surface 44*a*. Therefore, since the entire portion of the friction body 43 is separated from the outer circumferential surface of the inner cylinder 2, the above-mentioned frictional force becomes zero. In this manner, the friction body 43 of the present embodiment makes it possible to apply a stable frictional force at the time of the shortening and extending operations; therefore, upon these operations, it is not necessary for the operator to apply a force greater than is required.

Figure 23:
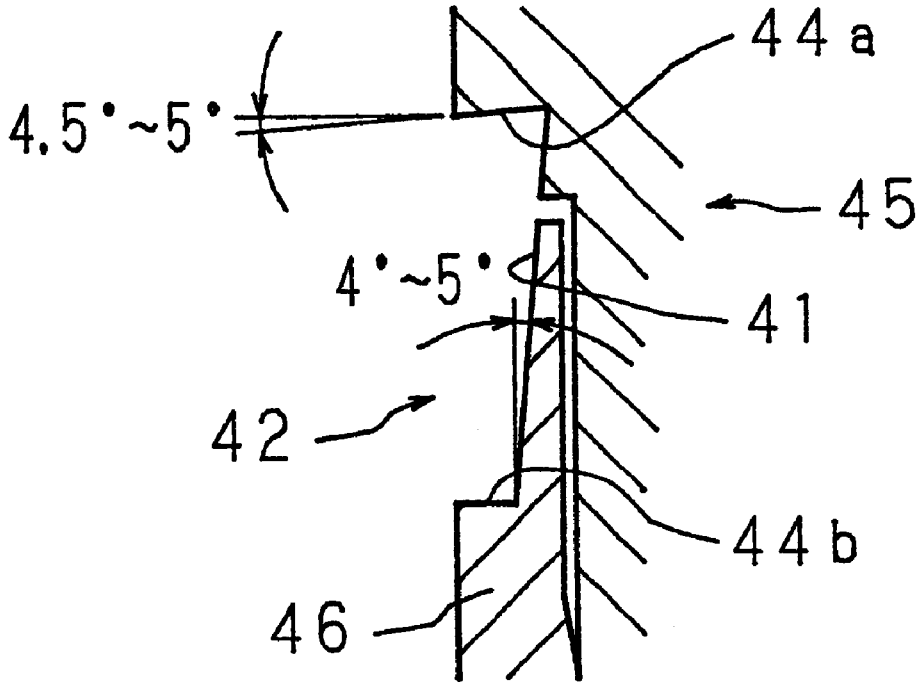
FIG. 23 is a longitudinal cross-sectional view that shows the detailed shape of a braking chamber provided as a recess portion and the vicinity thereof in Embodiment 4.

FIG. 23 is a longitudinal cross-sectional view that shows the detailed shape of a braking chamber provided as a recess portion and the vicinity thereof in Embodiment 4. The first moving end surface 44*a* is preferably allowed to tilt in the range of 4.5° to 5° with respect to the horizontal direction. In the case of the angle range greater than this, although the expanding effect of the diameter of the friction body 43 becomes greater, the separation of the friction body 43 from the upper end surface of the braking chamber 42, in contrast, becomes difficult. In the case of the angle range smaller than this, the expanding effect of the diameter of the friction body 43 becomes smaller. Here, in the same manner, the taper surface 41 is preferably allowed to tilt in the range of 4° to 5° with respect to the vertical direction.

Here, the above-mentioned tilt angles of the present embodiment may be applied to the holder 4 of Embodiment 1 and the holder 7 of Embodiment 2 having the integral-type structure.

Embodiment 5

Figure 24:
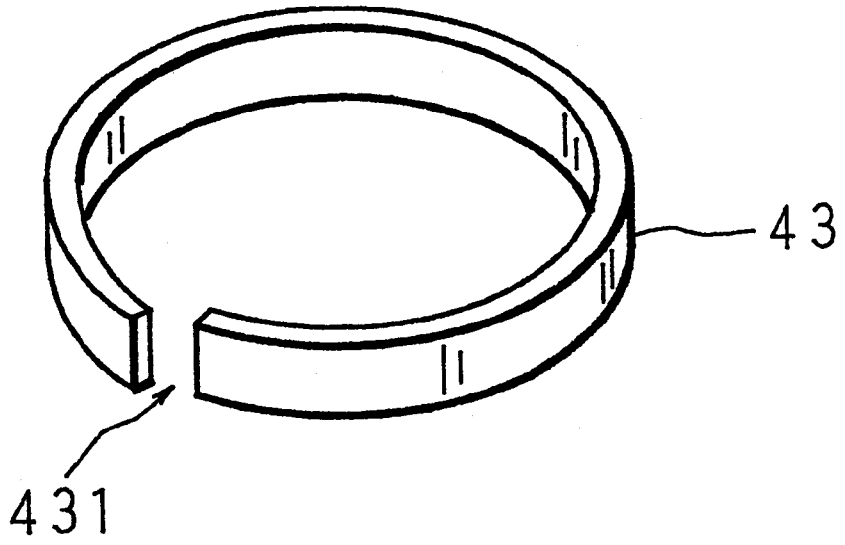
FIG. 24 is a perspective view that shows still another Embodiment (Embodiment 5) of a friction body provided as a molded body according to the present invention.
Figure 25:
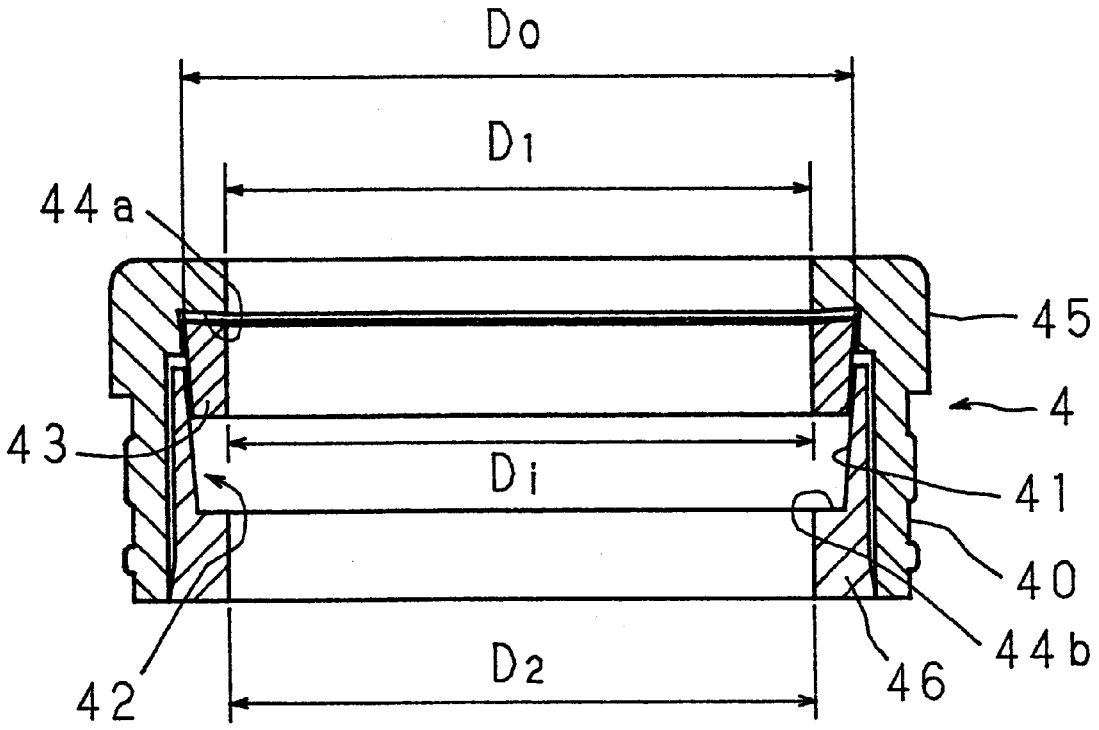
FIG. 25 is a longitudinal cross-sectional view that shows a state in which the friction body, shown in FIG. 24, is installed in the holder.

FIG. 24 is a perspective view that shows still another Embodiment (Embodiment 5) of a friction body provided as a molded body according to the present invention; and FIG. 25 is a longitudinal cross-sectional view that shows a state in which the friction body, shown in FIG. 24, is installed in the holder. The friction body 43 provided as a molded body of the present embodiment has a ring shape made of hard urethane, and it is formed into a approximately C-letter shape having a notch 431 at a position in its circumferential direction. Moreover, the cross-sectional shape of the friction body 43 is an approximately reversed trapezoidal shape that is approximately identical to a portion of the corresponding cross-sectional shape of the braking chamber 42 in the holder 4 shown in FIG. 4.

In the cross-sectional view of FIG. 25, the longer base side (upper side in the Figure) of the friction body 43 upwardly tapered as it goes to outside in the radial direction. Moreover, the inner diameter $D_i$ of the friction body 43 is set by its notch width so that it is coincident with $D_1$ and $D_2$ of the first and second holder portions 45 and 46 as it is at predetermined positions in the longitudinal direction of the braking chamber 42, that is, in the moving direction of the friction body 43. Preferably, it is set in the vicinity of the first moving end surface 44*a* on the upper side of the braking chamber 42.

With this getting, as the inner cylinder 2 is moved in the push-in direction to the outer cylinder 3, that is, as the telescopic member 1 is shortened, the friction body 43 has its outer circumferential surface pressed inward in the radial direction along the taper surface 41 of the braking chamber 42 so that the outer diameter $D_0$ becomes smaller. In other words, the aforementioned inner diameter $D_i$ also becomes smaller correspondingly so that a predetermined braking force (frictional force) can be applied to the outer circumferential surface of the inner cylinder 2.

However, different from the O-ring as shown in Embodiment 1, the friction body 43 has the approximately trapezoidal cross-section; therefore, even when sandwiched between the outer circumferential surface of the inner cylinder 2 and the taper surface 41, its cross-sectional shape is less susceptible to a deformation, thereby making it possible to maintain an appropriate size of the contact surface stably. In other words it is possible to obtain a stable frictional force. Moreover, different from the O-ring, since it is not allowed to roll, the shape of the friction body 43 of the present embodiment further contributes to the stability of the frictional force.

In contrast, as the inner cylinder 2 is moved in the pull-out direction from the outer cylinder 3, that is, as the telescopic member 1 is extended, the friction body 43 comes to have a greater diameter by its elasticity while shifting along the taper surface 41 of the braking chamber 42. In other words, the above-mentioned inner diameter $D_i$ and the outer diameter $D_0$ also become longer, with the result that at the time when $D_i=D_1$ or $D_2$, the frictional force of the friction body 43 applied to the inner cylinder 2 becomes approximately zero. However, in fact, since a portion of the inner circumferential surface of the friction body 43 is in contact with the outer circumferential surface of the inner cylinder 2, the frictional force does not become zero.

Then, when the upper face of the friction body 43 has reached the first moving end surface 44*a*, the friction body 43 is further extended in its diameter along the tapered first moving end surface 44*a*. Therefore, since the entire portion of the friction body 43 is separated from the outer circumferential surface of the inner cylinder 2, the above-mentioned frictional force becomes zero. In this manner, the friction body 43 of the present embodiment makes it possible to apply a stable frictional force at the time of the shortening and extending operations; therefore, upon these operations, it is not necessary for the operator to apply a force greater than is required.

Figure 26:
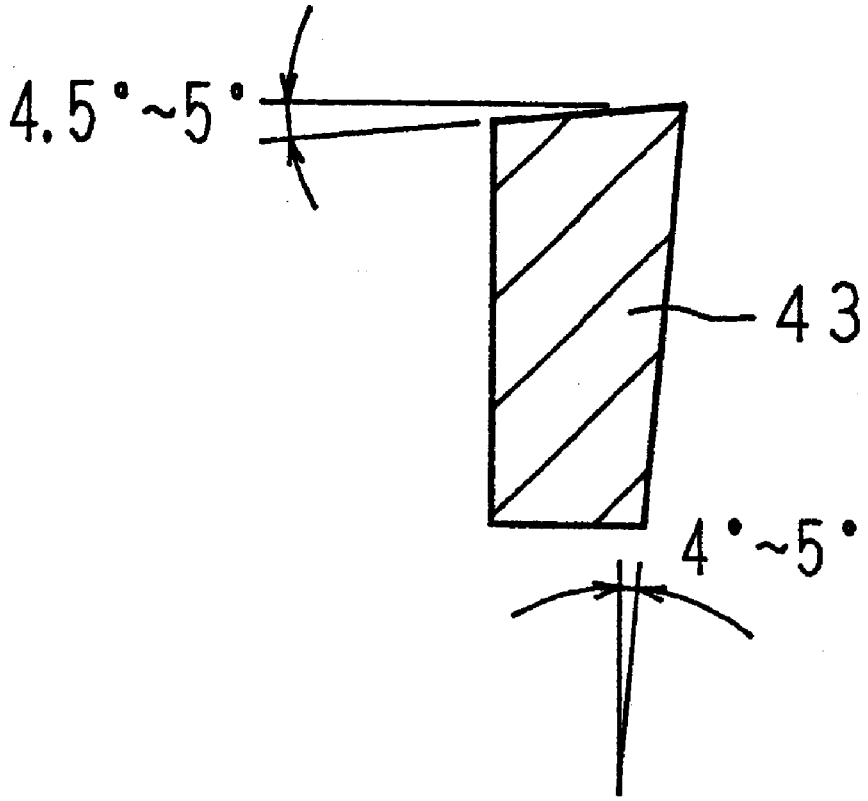
FIG. 26 is a longitudinal cross-sectional view that shows a detailed shape of the friction body of Embodiment 5.

FIG. 26 is a longitudinal cross-sectional view that shows a detailed shape of a friction body of Embodiment 5. In accordance with the first moving end surface 44*a* tilted in the range of 4.5° to 5° with respect to the horizontal direction, the upper face of the friction body 43 is also preferably tilted by 4.5° to 5°. In the case of the angle range greater than this range, although the extending effect of the diameter of the friction body 43 becomes greater, the separation of the friction body 43 from the upper end surface of the braking chamber 42, in contrast, becomes difficult. In the case of the angle range smaller than this, the extending effect of the diameter of the friction body 43 becomes smaller.

Moreover, the friction body 43 of the present embodiment may also be applied to the holder 4 having un-divided structure (in this case, it is not necessary to have the taper of 4.5° to 5° on the upper surface) in Embodiment 1. Furthermore, a friction body 73 as disclosed in Embodiment 2 may be formed by using the cross-sectional shape of the friction body 43 of the present embodiment.

Here, it is also possible to utilize the friction body 43 of the present embodiment in the holder 4 in the conventional configuration (in this case, it is not necessary to have the above-mentioned taper of 4.5° to 5° ) In this case, since the friction body 43 of the present embodiment is less susceptible to a deformation in its cross-sectional shape as compared with the O-ring as described earlier, the chamber size of the braking chamber 42 having the conventional arrangement is prevented from being inserted into the small area beyond the necessary amount, thereby making it possible to stabilize the frictional force.

Embodiment 6

Figure 27A:
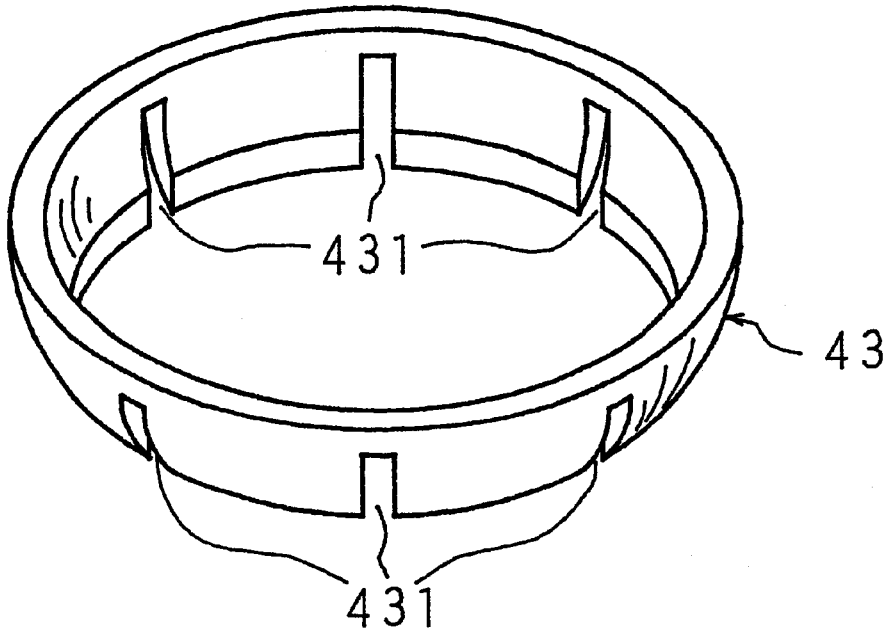
FIG. 27A is a perspective view seen from above that shows still another Embodiment (Embodiment 6) of a friction body provided as a molded body according to the present invention.
Figure 27B:
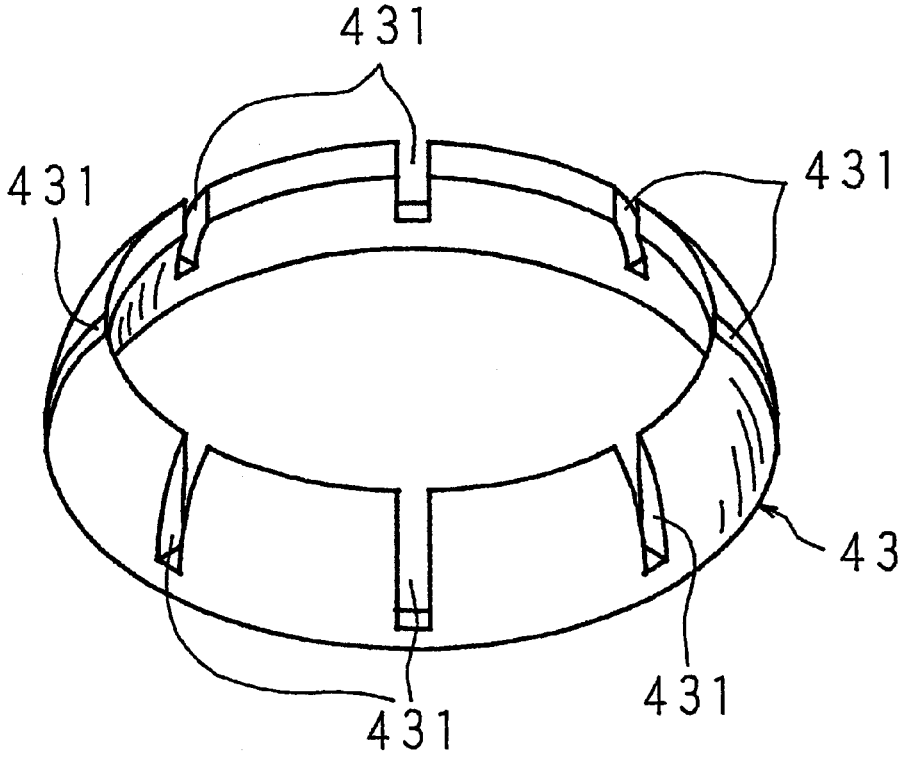
FIG. 27B is a perspective view seen from below that shows still another Embodiment (Embodiment 6) of a friction body provided as a molded body according to the present invention.

FIG. 27A is a perspective view seen from above that shows still another Embodiment (Embodiment 6) of a friction body provided as a molded body according to the present invention; and FIG. 27B is a perspective view seen from below that shows still another Embodiment (Embodiment 6) of a friction body provided as a molded body according to the present invention. In the present embodiment, only the configuration of the notch 431 of the friction body 43 having the similar cross-sectional shape described in Embodiment 5is modified. Except this, the other arrangements and functions are the same as those of Embodiment 5; therefore, the same reference numerals are used and the detailed description thereof is omitted.

As illustrated in FIGS. 27A and 27B, the friction body 43 of the present embodiment has notches 431 that are made by notching a plurality of positions thereof in the circumferential direction to an extent so as not to separate them. With this arrangement, the diameter contracting operation can be carried out by using a comparatively small force, and it becomes possible to use a harder material as compared with the friction body 43 of Embodiment 5.

Here, in FIGS. 27A and 27B, the friction body 43 has an entire shape which looks as if a hollow spherical body was sliced; however, it may have a ring shape having a trapezoidal cross-section as shown in Embodiment 5.

Embodiment 7

Figure 28A:
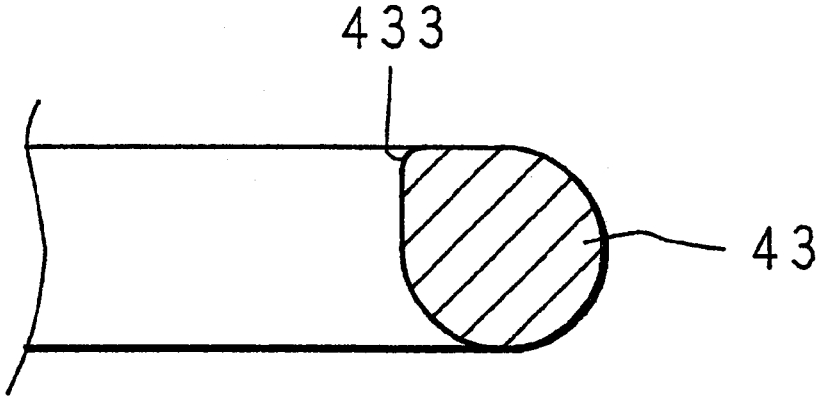
FIGS. 28A and 28B are longitudinal cross-sectional views of one side that show still another Embodiment (Embodiment 7) of a friction body provided as a molded body according to the present invention.
Figure 28B:
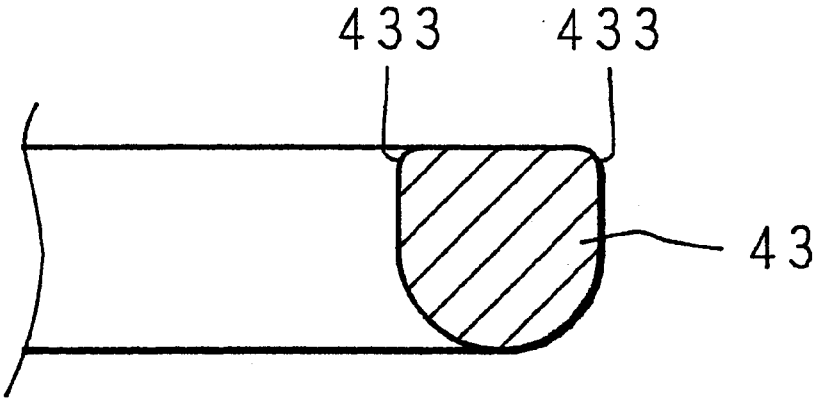
Figure 29A:
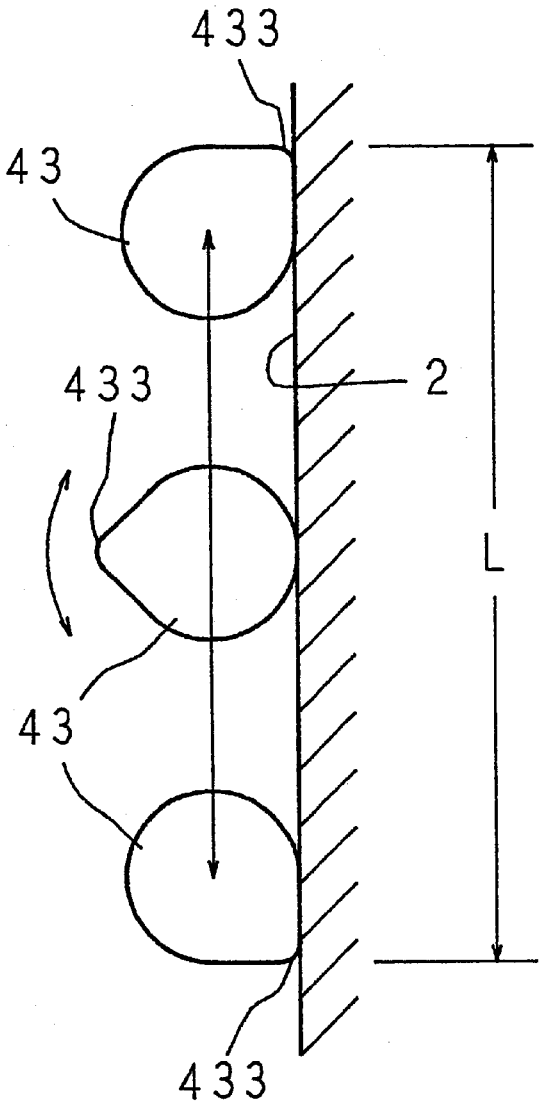
FIGS. 29A and 29B are explanatory drawings that show the functions of the friction body shown in FIGS. 28A and 28B.
Figure 29B:
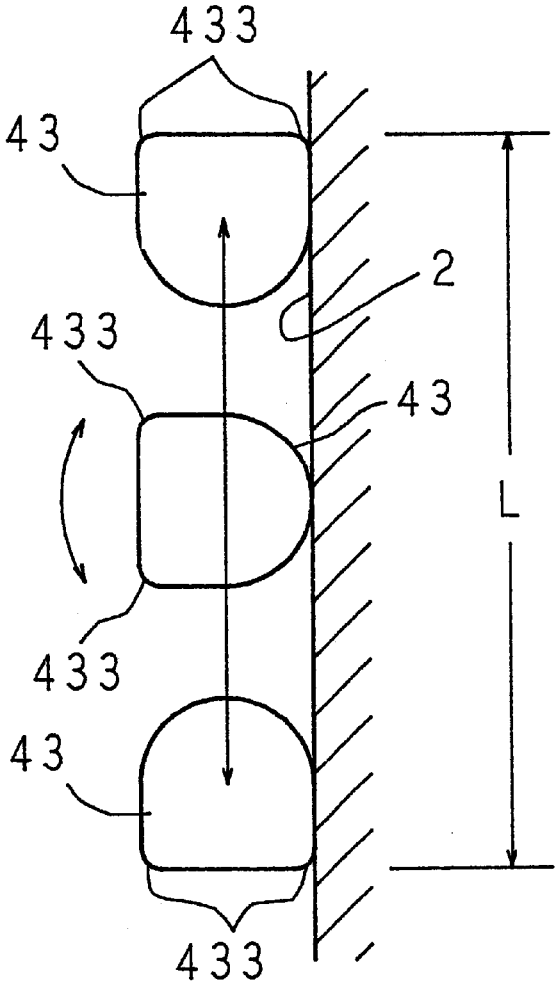

FIGS. 28A and 28B are longitudinal cross-sectional views of one side that show still another Embodiment (Embodiment 7) of a friction body provided as a molded body according to the present invention; and FIGS. 29A and 29B are explanatory drawings that show the functions of the friction body shown in FIGS. 28A and 28B. In the present embodiment, only the cross-sectional shape of the friction body 43 made of an O-ring is modified. Except this, the other arrangements and functions are the same as those of Embodiment 1; therefore, the same reference numerals are used, and the detailed description thereof is omitted.

As illustrated in FIG. 28A, the former friction body 43 of the present embodiment has an arrangement in which a protruding portion 433 is placed at a portion in the cross-section of the friction body 43 of Embodiment 1. More specifically, the protruding portion 433 having a predetermined rounded shape is formed on the upper inside portion of the cross-section, and both sides of the protruding portion 433 are connected to the rest of the rounded portion of the friction body 43 by tangent lines thereof.

Moreover, as illustrated in FIG, 28B, the latter friction body 43 has an arrangement in which the half portion on the upper side of the friction body 43 of Embodiment 1 is formed into an approximately rectangular shape, and the corner portions on the inside and outside thereof are provided as two protruding portions 433 having a predetermined rounded shape.

Next, an explanation will be given of functions of these friction bodies 43. First, as illustrated in FIG. 29A, it is supposed that the friction body 43 is in contact with the outer circumferential surface of the inner cylinder 2 in a state as shown on the upper portion of the Figure. In this state, even when an attempt is made to push the inner cylinder 2 into the outer cylinder 3, it is not possible to further push this in because of the protruding portion 433, unless a force is applied to such an extent that the friction body 43 would be allowed to roll over this protruding portion 433 and be moved. In contrast, when an attempt is made to pull-out the inner cylinder 2 from the outer cylinder 3, the friction body 43 is allowed to roll as described in Embodiment 1, and after passing through the state shown in the middle portion of the Figure, stopped with its protruding portion 433 contacting the outer circumferential surface of the inner cylinder 2, as illustrated on the lower portion of the Figure. In order to further draw the inner cylinder 2 from the outer cylinder 3 from this state, it is necessary to apply a force to such an extent as to allow the friction body 43 to roll over the protruding portion 433.

As described above, even in the case when, for example, the engagement between the pawl portion 25*a* the lock lever motion mechanism 22 and the engaging portion 36 is released, the friction body 43, after having rolled a predetermined distance (indicated by reference numeral L in the Figure), exerts a frictional force in accordance with the size, shape, etc. of the protruding portion 433, with respect to both of the push-in direction of the inner cylinder 2 into the outer cylinder 3 and the pull-out direction of the inner cylinder 2 from the outer cylinder 3. The setting of such a rolling distance L is made by taking into consideration the backlash between the pawl portion 25*a* of the lock lever motion mechanism 22 and the engaging portion 36, etc., and based upon the set rolling distance L, the radius dimension of the rounded portion and the circumferential length of the rounded portion in the cross-section of the friction body 43 are set. Moreover, the size and shape of the protruding portion 433 are set by taking into consideration the size and shape of the rounded portion based upon the magnitude of the aforementioned resistant force, etc.

Moreover, as illustrated in FIG. 29B, the latter friction body 43 has the same functional principle so that the detailed description thereof is omitted. However, by providing two protruding portions 433, the rolling distance L thereof is of course shortened, even in the case of the same radius dimension of the round portion as the former friction body 43.

Embodiment 8

Figure 30A:
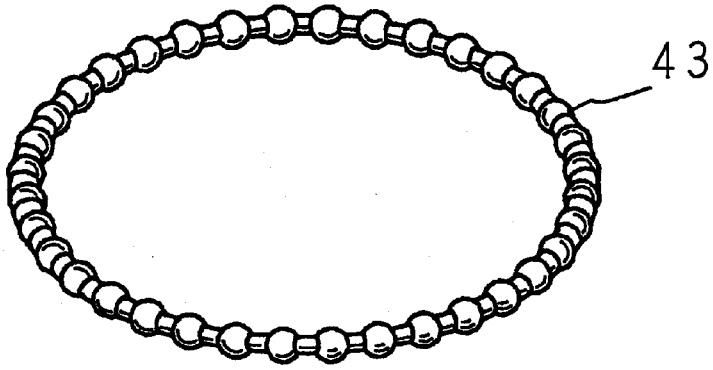
FIG. 30A is a perspective view that shows still another Embodiment (Embodiment 8) of a friction body provided as a molded body according to the present invention.
Figure 30B:
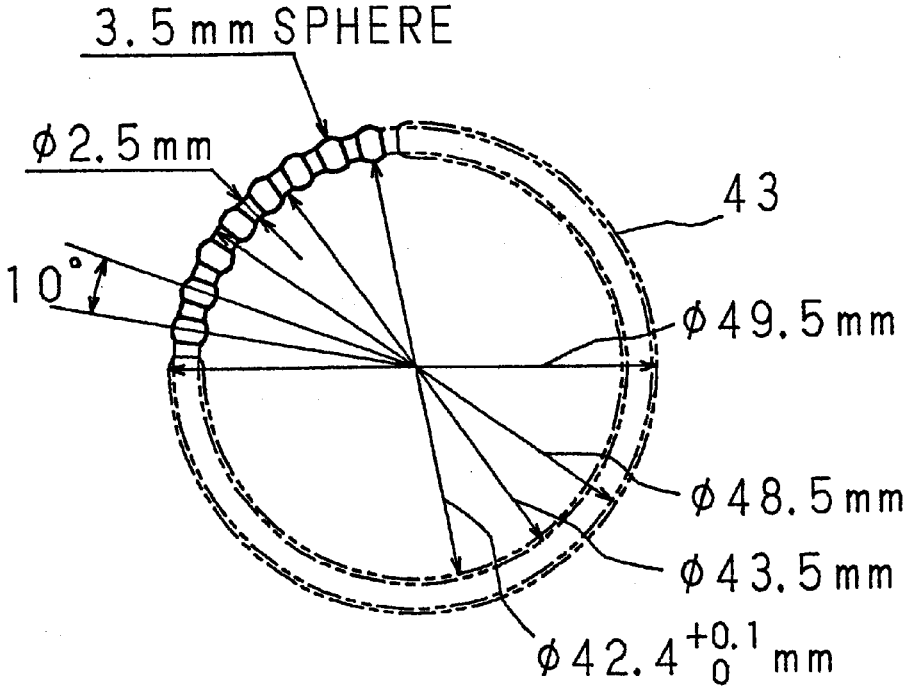
FIG. 30B is a plan view of FIG. 30A.

FIG. 30A is a perspective view that shows still another Embodiment (Embodiment 8) of a friction body provided as a molded body according to the present invention; and FIG. 30B is a plan view of FIG. 30A. As illustrated in FIGS. 30A and 30B, the friction body 43 of the present embodiment has an arrangement in which a plurality of spherical bead bodies are connected by a plurality of short column-shaped portions having a diameter smaller than the diameter of the bead body so that, as a whole, a ring-shaped configuration is formed.

In the case when the friction body 43 of the present embodiment is installed in the holder 4, the entire dimensions of the outer and inner diameters thereof are set in the same manner as those of the friction body 43 of the other embodiments. Therefore, the diameter of the respective bead bodies are inevitably determined in that case.

In this case, as illustrated in FIG. 30B, the entire outer diameter ($D_O$) is set at ϕ 49.5 mm, the entire inner diameter ($D_i$) is set at ϕ 42.4 mm to 42.5 mm, the diameter of each bead body is set at 3.5 mm, and the diameter of the column-shaped portion connecting the bead bodies is set at ϕ 2.5 mm; thus, the respective bead bodies are placed with pitches of 10°, and as a whole, 36 bead bodies are installed.

By arranging the friction body 43 in this manner, the friction body 43 is allowed to approximately make point contacts with the outer circumferential surface of the inner cylinder 2 and the taper surface 41 through the bead bodies; consequently, even in the case of application of a harder material as compared with the friction body 43 made of an O-ring as used in Embodiment 1, it is possible to obtain a greater amount of deformation and a stable braking force (frictional force). Moreover, by using a harder material, it becomes possible to improve the durability against repeated use.

More specifically, urethane resin was used as a main material of the friction body 43 of the present embodiment. The hardness of the friction body 43 with the above-mentioned dimensions is preferably set to approximately 85±2 in "A" code of Japan Industrial Standard (JIS).

Embodiment 9

Figure 31A:
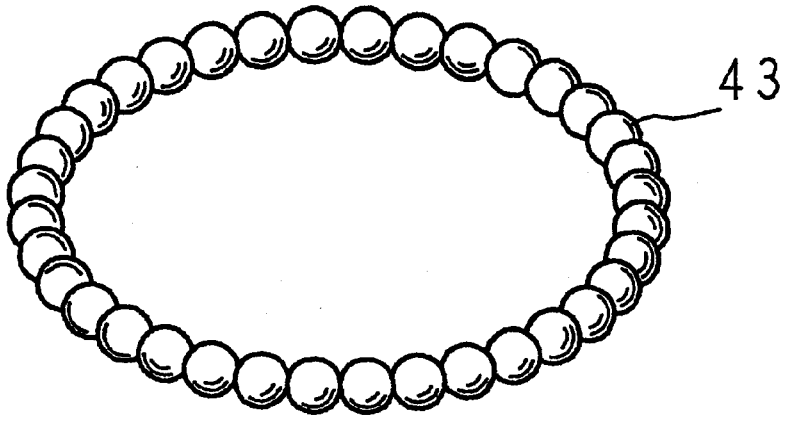
FIG. 31A is a perspective view that shows still another Embodiment (Embodiment 9) of a friction body provided as a molded body according to the present invention.
Figure 31B:
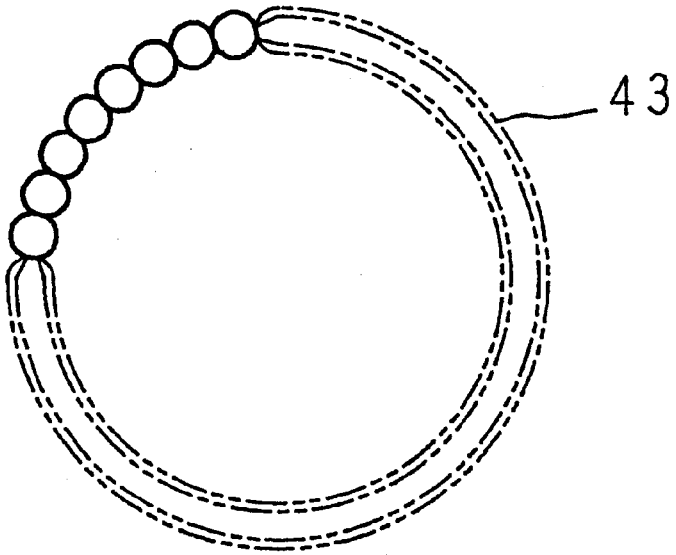
FIG. 31B is a plan view of FIG. 31A.

FIG. 31A is a perspective view that shows still another Embodiment (Embodiment 9) of a friction body provided as a molded body according to the present invention; and FIG. 31B is a plan view of FIG. 31A. As illustrated in FIGS. 31A and 31B, the friction body 43 of the present embodiment has an arrangement in which a plurality of spherical bead bodies are directly connected to each other so as to form a ring shape as a whole. Except this, the other arrangements and functions are the same as those of Embodiment 8.

In the case when the friction body 43 of the present embodiment is installed in the holder 4, the entire dimensions of the outer and inner diameters thereof are set in the same manner as those of the friction body 43 of the other embodiments. Therefore, the diameter of the respective bead bodies are inevitably determined in that case.

In other words, although not shown in FIG. 31B, the diameter of each bead body should be set at the same value as the diameter of the bead body of Embodiment 8. Accordingly, the number of the bead bodies will increase.

As described above, the friction body 43 of the present embodiment has a greater number of the bead bodies as compared with the friction body 43 of Embodiment 8; therefore, the compressing force, applied by the outer circumferential surface of the inner cylinder 2 and the taper surface 41 to the bead bodies, is dispersed so that the bead bodies are less susceptible to a deformation. Consequently, as compared with the friction body 43 used in Embodiment 8, it is possible to obtain a stable braking force (frictional force) even in the case of the application of a softer material.

Embodiment 10

Figure 32A:
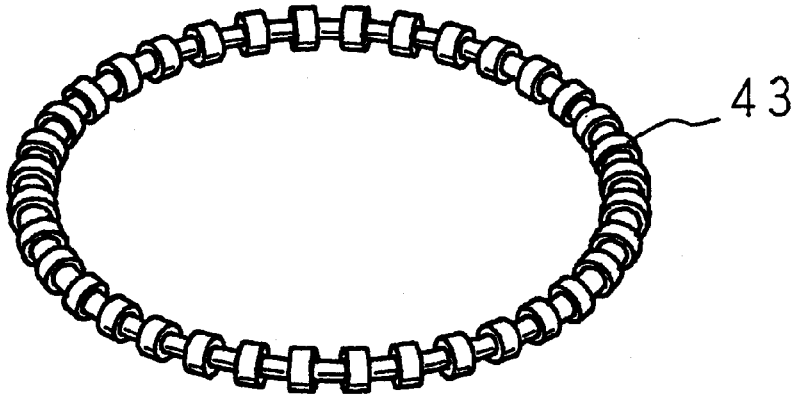
FIG. 32A is a perspective view that shows still another Embodiment (Embodiment 10) of a friction body provided as a molded body according to the present invention.
Figure 32B:
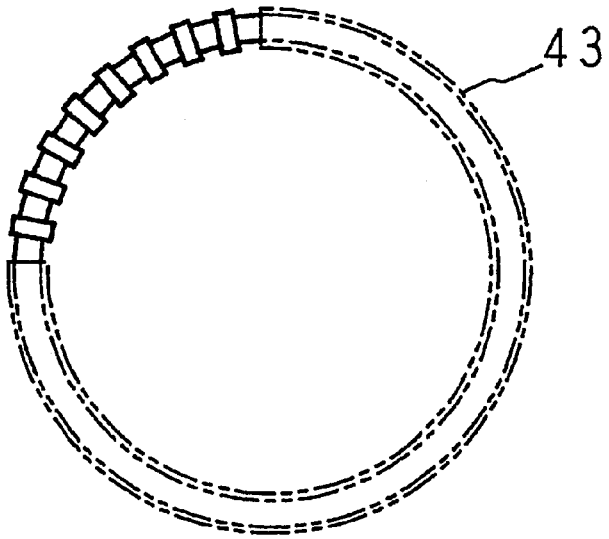
FIG. 32B is a plan view of FIG. 32A.

FIG. 32A is a perspective view that shows still another Embodiment (Embodiment 10) of a friction body provided as a molded body according to the present invention; and FIG. 32B is a plan view of FIG. 32A. As illustrated in FIGS. 32A and 32B, the friction body 43 of the present embodiment has an arrangement in which a plurality of short column-shaped bead bodies are connected by using a short column-shaped portions having a diameter smaller than the diameter thereof so that a ring-shaped configuration is formed as a whole. Except this, the other arrangements and functions are the same as those of Embodiment 8.

In the case when the friction body 43 of the present embodiment is installed in the holder 4, the entire dimensions of the outer and inner diameters thereof are set in the same manner as those of the friction body 43 of the other embodiments. Therefore, the diameter of the respective bead bodies are inevitably determined in that case.

However, since the length of each bead body can be altered to a certain extent, the length may be adjusted by taking into consideration the number of the bead bodies so that it is possible to easily obtain an appropriate contact area for providing an appropriate braking force (frictional force) to the outer circumferential surface of the inner cylinder 2 and the taper surface 41.

Embodiment 11

Figure 33:
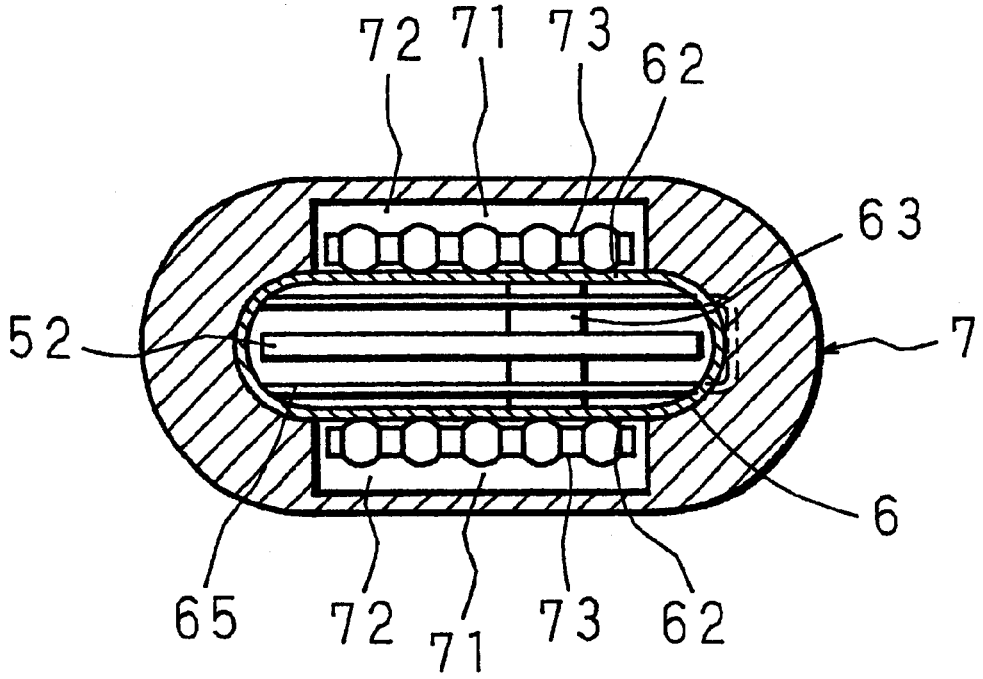
FIG. 33 is a lateral cross-sectional view that shows still another Embodiment (Embodiment 11) of a telescopic member according to the present invention.

FIG. 33 is a lateral cross-sectional view that shows still another Embodiment (Embodiment 11) of a telescopic member according to the present invention. The telescopic member 10 of the present embodiment has an arrangement in which the pillar-shaped friction body 73 used in Embodiment 2 is modified into a bead shape as shown in Embodiment 8. Except this, the other arrangements and functions are the same as those of Embodiment 2; therefore, the same reference numerals are used, and the detailed description is omitted.

In the friction body 73 of the present embodiment, a plurality of spherical bead bodies are connected by using a plurality of short column-shaped portions having a diameter smaller than the diameter thereof so that a pillar-shaped configuration is formed as a whole. Therefore, the functions as described in Embodiment 8 can be obtained in the telescopic member 10 having the arrangement of Embodiment 2.

Embodiment 12

Figure 1:
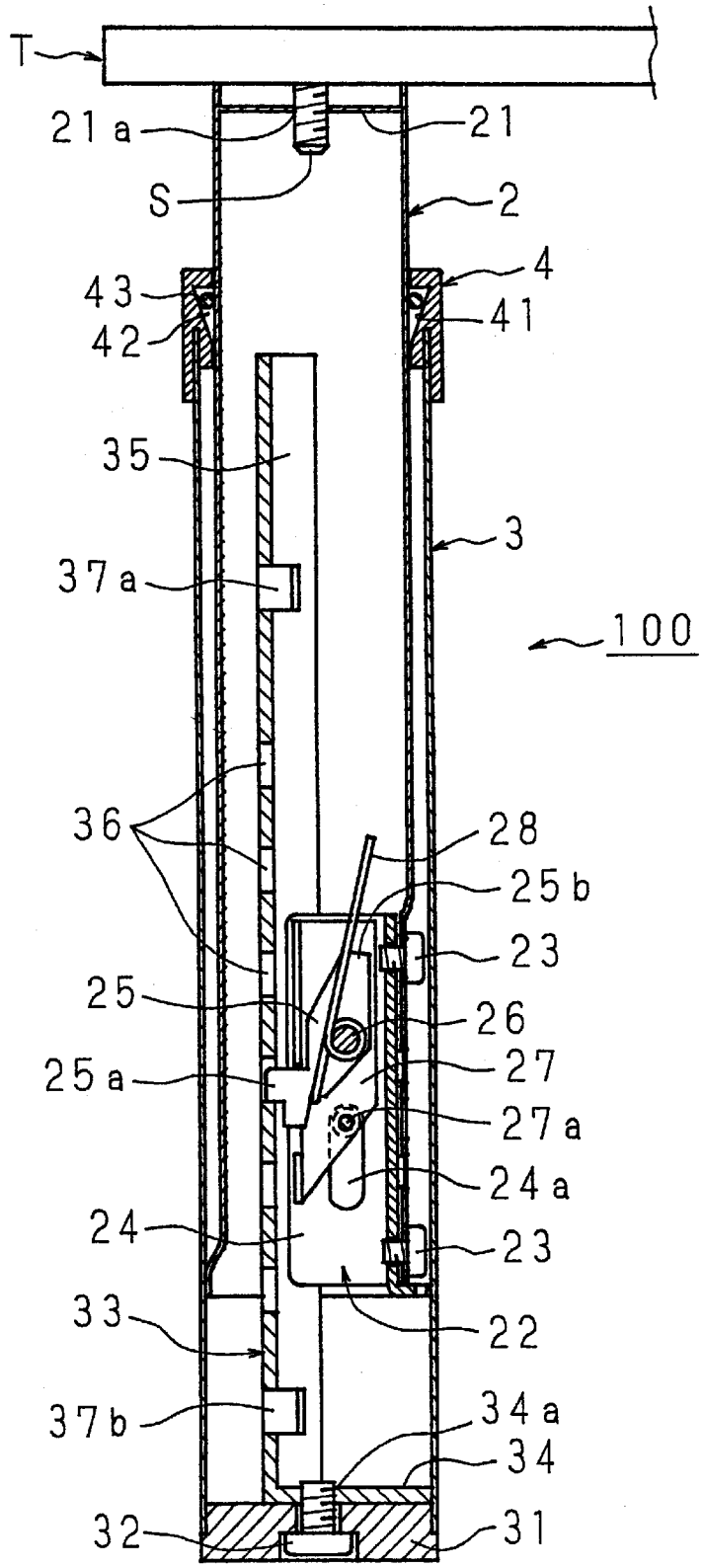
FIG. 1 PRIOR ART
FIG. 1 is a partial longitudinal cross-sectional view that shows the configuration of a conventional telescopic member.
Figures 2A, 2B, 2C:
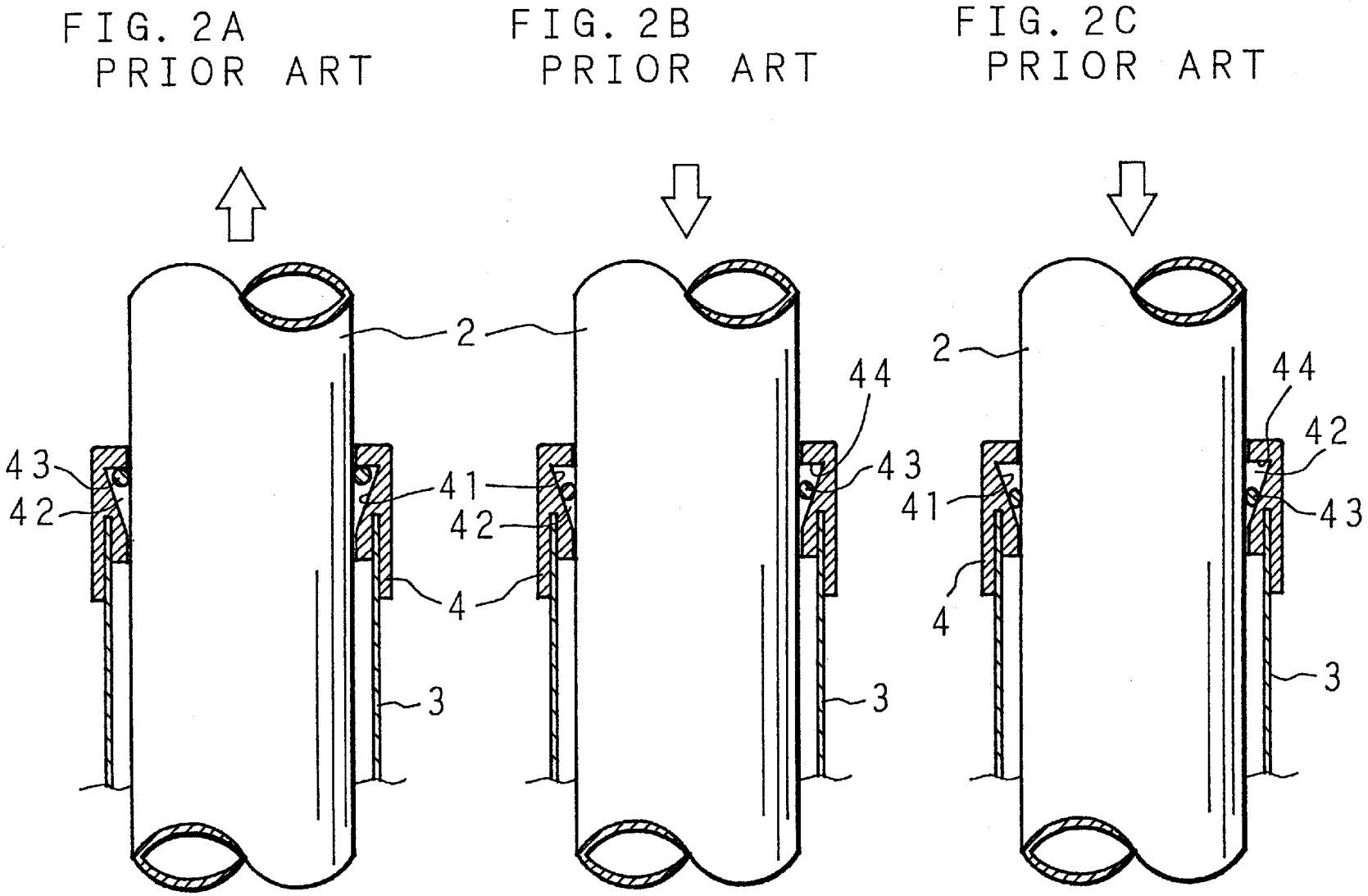
FIG. 2A PRIOR ART
FIG. 2B PRIOR ART
FIG. 2C PRIOR ART
FIGS. 2A, 2B, and 2C are explanatory drawings that show the movements of a friction body in the conventional telescopic member.
Figure 3A:
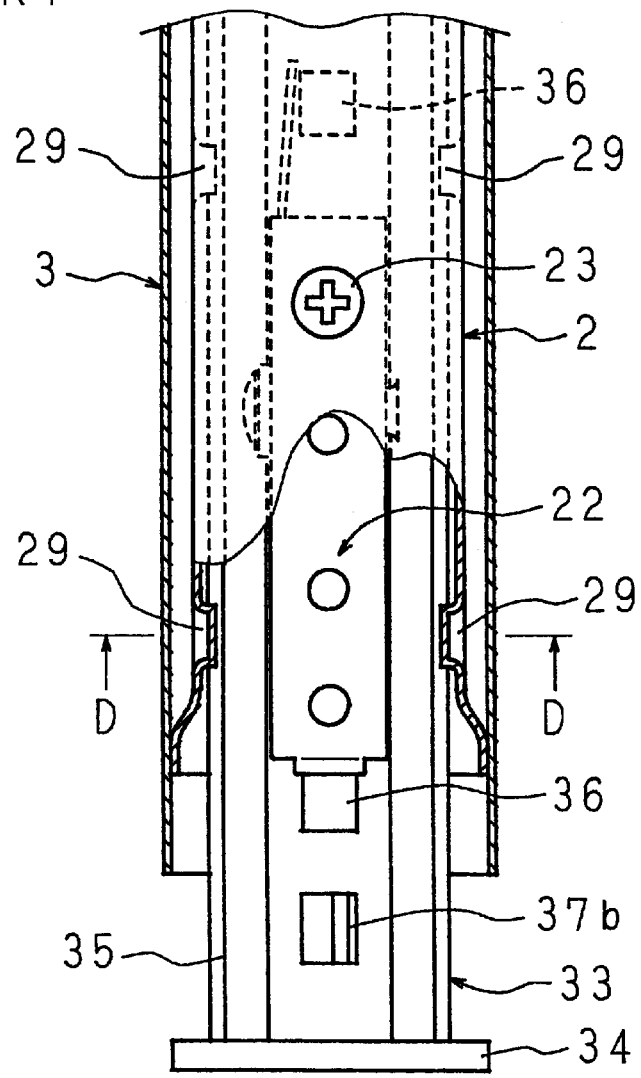
FIG. 3A PRIOR ART
FIG. 3A is a partial longitudinal cross-sectional view, seen from the right side of FIG. 1, that shows a holding portion for holding a pillar-shaped body.
Figure 3B:
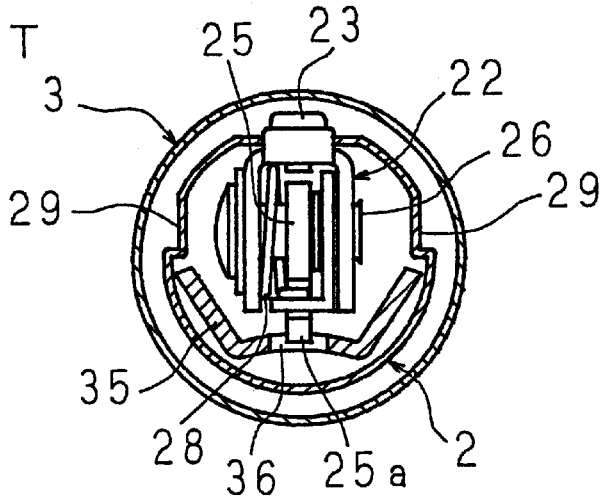
FIG. 3B PRIOR ART
FIG. 3B is a partial cross-sectional view taken along line D—D in FIG. 3A.
Figure 34A:
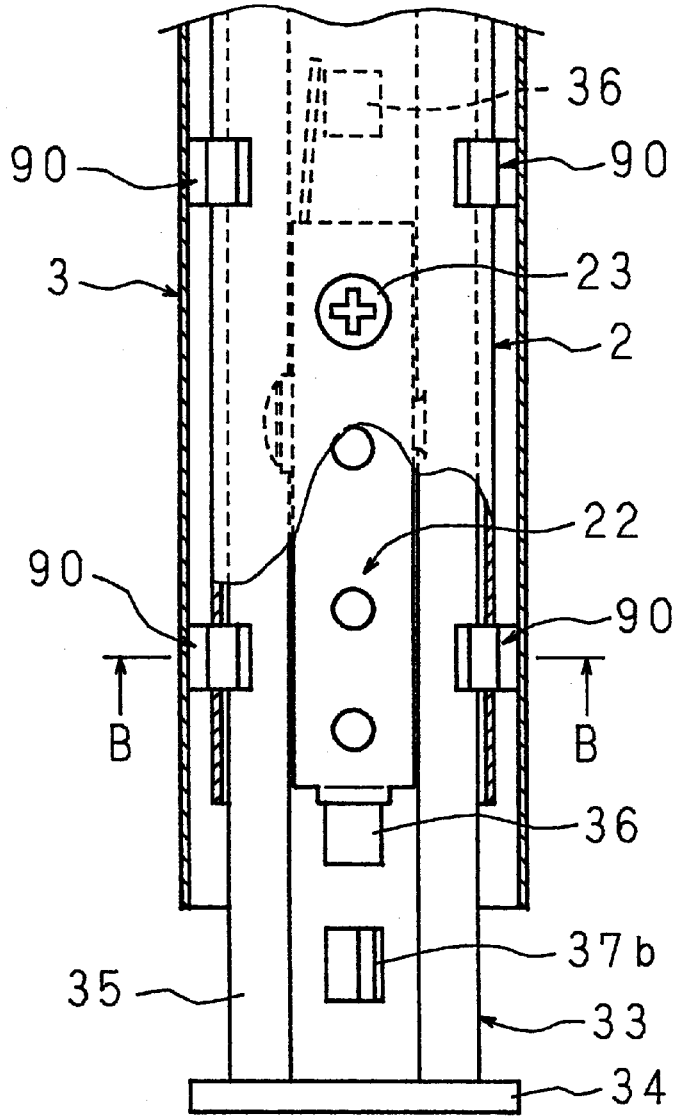
FIG. 34A, which shows Embodiment 12 of the configuration of a telescopic member according to the present invention, is a partial longitudinal cross-sectional view seen from the right, which corresponds to FIG. 3A.
Figure 34B:
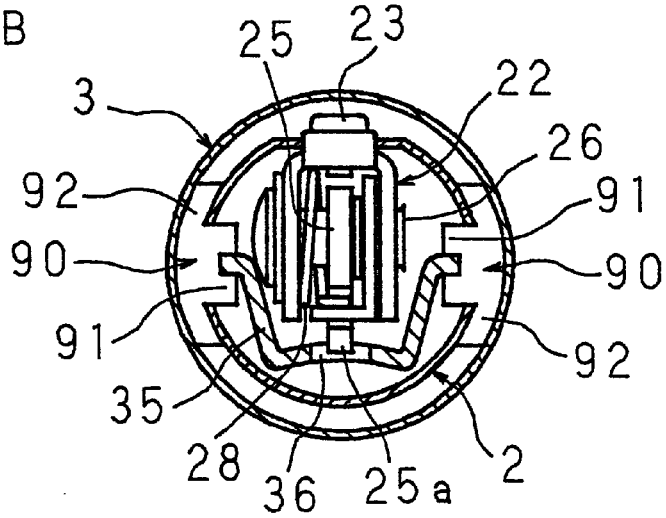
FIG. 34B is a partial cross-sectional view taken along line B—B of FIG. 34A.

FIG. 34A, which shows Embodiment 12 of the configuration of a telescopic member according to the present invention, is a partial longitudinal cross-sectional view seen from the right, which corresponds to FIG. 3A; and FIG. 34B is a partial cross-sectional view taken along line B—B of FIG. 34A. The telescopic member of the present embodiment has an arrangement in which the holding portions 29, installed integrally with the inner cylinder 2 of the conventional configuration, are provided as separate members from the inner cylinder 2 as holding bodies 90. Accordingly, the upright portion 35 of the pillar-shaped body 33 is modified in its lateral cross-section. Except this, the other arrangements and functions are the same as those of Embodiment 1; therefore, the same reference numerals are used and the detailed description thereof is omitted.

As illustrated in FIG. 34A, at positions appropriately spaced in the longitudinal direction of the inner cylinder 2, the holding bodies 90, which penetrate the circumferential wall of the inner cylinder 2 from outside, are formed so as to face each other at corresponding positions in the longitudinal direction; thus, four of them are placed. As illustrated in FIG. 34B, each holding body 90, in its secured state, has a short pillar shape having an approximately T-letter shape when viewed from above or from below. A web portion of the T-letter shape forms a holding portion 91, and a flange portion forms a spacer portion 92 respectively. The holding portion 91 has a short square pillar shape with its protruding direction from the spacer portion 92 being coincident with its axial direction, and a slit having a predetermined length from the tip in the longitudinal direction is formed so as to be tow-legged. The gap between the leg portions is coincident with the thickness of the upright portion 35; thus, the upright portion 35 having an approximately W-letter shape in its lateral cross-section are supported with its both ends sandwiched by them. With this arrangement, the rotation of the pillar-shaped body 33 secured by a screw 32 (see FIG. 4) on the axis in the longitudinal direction is regulated so that the pawl portion 25*a* and the engaging portion 36 are held in positions providing easy engagements between them. Moreover, each holding body 90 is made of nylon resin so that no noise is generated at contact portions with the upright portion 35.

Moreover, the spacer portion 92 is curved into a concave shape toward the side bearing the holding portion 91 so that its rounded shape on the outer side is coincident with the inner circumferential surface of the outer cylinder 3 while its rounded shape on the inner side is coincident with the outer circumferential surface of the inner cylinder 2, so as to allow them to be respectively fitted thereto; thus, between the outer cylinder 3 and the inner cylinder 2 that are moved relatively, the curved surface on the outside of the spacer 92 is allowed to slide along the inner circumferential surface of the outer cylinder 3, with the result that a frictional force, exerted between these surfaces, is allowed to impart an appropriate resistant force to the relative movements, and also to maintain the inner cylinder 2 at the center position of the outer cylinder 3 in a concentric manner.

Here, the application of these spacer portions 92 can replace the concentric-state maintaining function with respect to the outer cylinder 3 and the inner cylinder 2 carried out by the diameter-expanding portion located on the lower end portion of the inner cylinder 2 in the aforementioned conventional telescopic member 100, thereby making it possible to eliminate the diameter-expanding portion that tends to cause noise from its sliding along the inner circumferential surface of the outer cylinder 3.

Embodiment 13

Figure 35:
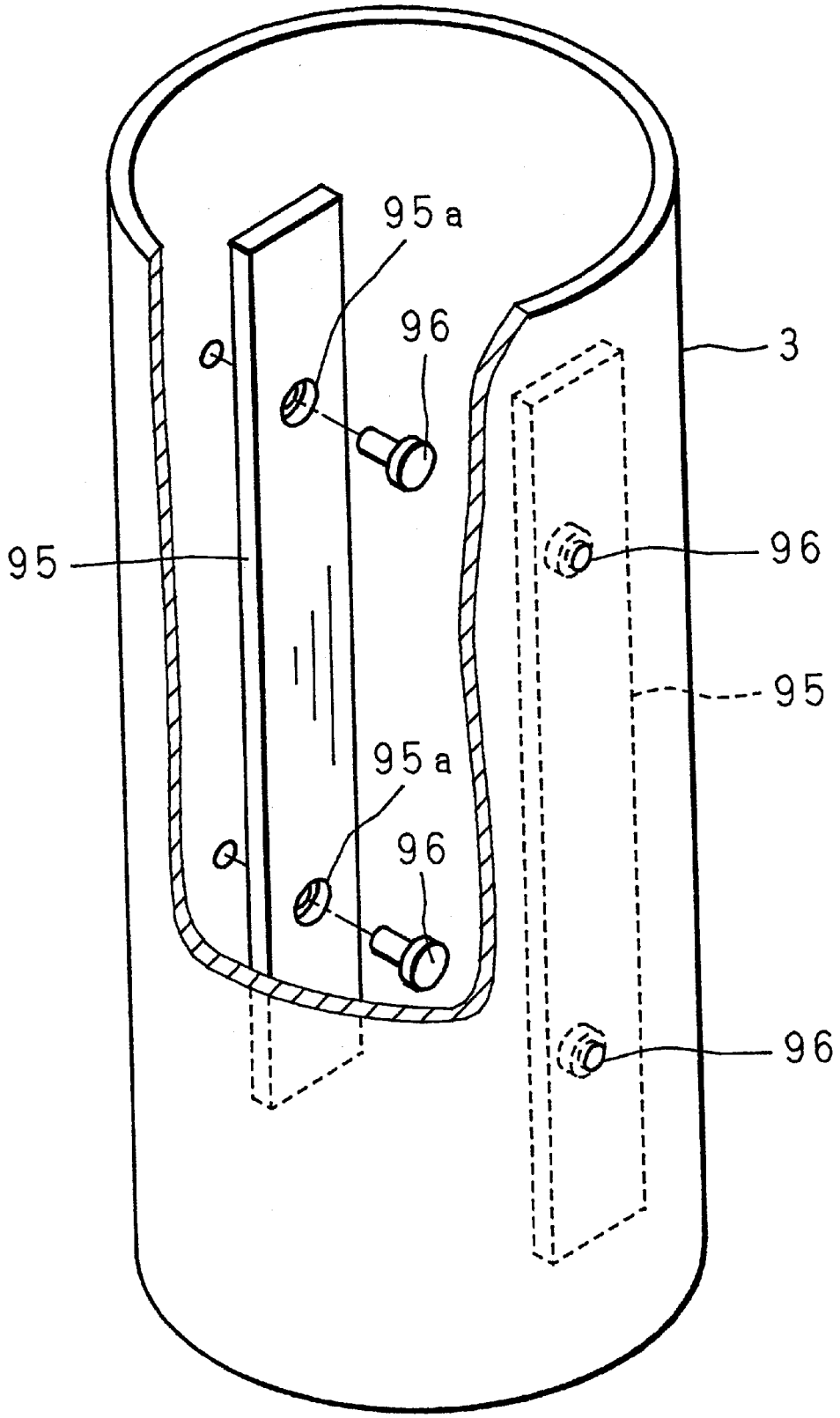
FIG. 35 is a perspective view that shows the essential portion of still another Embodiment (Embodiment 13) of a telescopic member according to the present invention.

FIG. 35 is a perspective view that shows the essential portion of still another Embodiment (Embodiment 12) of a telescopic member according to the present invention. In the present embodiment, guide rails 95 serving as holding members by engaging the holding bodies 90 are attached to positions corresponding to the holding bodies 90 on the inner circumferential surface of the outer cylinder 3 of Embodiment 12. Except this fact, the other arrangements and functions are the same as those of the conventional configuration and Embodiment 12; therefore, the same reference numerals are used, and the detailed description thereof is omitted.

More specifically, as illustrated in FIG. 35, a pair of guide rails 95 are placed on opposing positions on the inner circumferential surface of the outer cylinder 3 along the longitudinal direction. Each guide rail 95 is constituted by a plate-shape or rod-shape member that is elongated in the longitudinal direction, and stepped holes 95*a* are formed in two appropriate portions thereof so that they are secured on the inner circumferential surface of the outer cylinder 3 by screws 96 from inside through these stepped holes 95*a*.

Here, in addition to the securing by the screws 96, the upper and lower ends of the guide rail 95 may be welded to the inner circumferential surface of the outer cylinder 3; however, the present invention does not intend to limit the securing method of the guide rail 95, and any method may be used as long as it provides a sufficient strength that is resistant to a rotational moment that will be described later.

Figure 36:
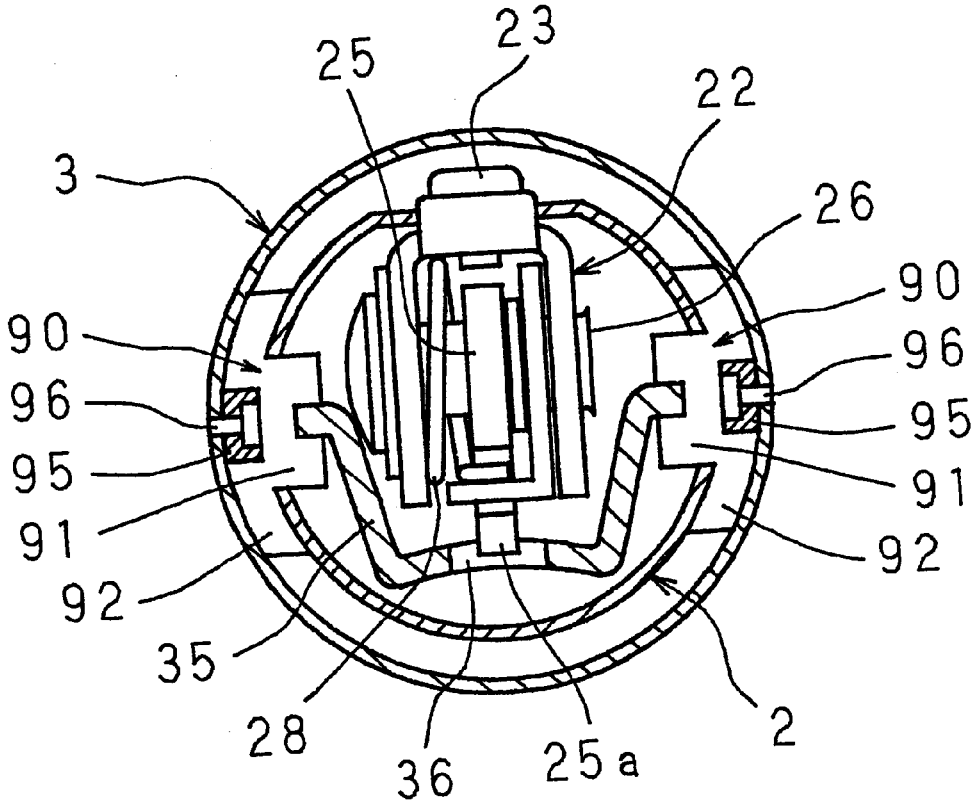
FIG. 36 is a lateral cross-sectional view that shows the telescopic member of Embodiment 13 that is constituted by an outer cylinder in which a guide rail is assembled as a holding member.

FIG. 36 is a lateral cross-sectional view that shows the telescopic member of Embodiment 13 that is constituted by an outer cylinder in which a guide rail is assembled as a holding member. As illustrated in FIG. 36, each guide rail 95 has a width smaller than the width of the holding portion 91 of the holding body 90, and is embedded along a groove formed in the outer side face of the spacer portion 92 in the longitudinal direction.

In other words, one guide rail 95 is embedded to two holding bodies 90 aligned in the longitudinal direction so that the inner cylinder 2 is held from its rotation on the axis by the outer cylinder 3 together with the holding body 90. Therefore, for example, the rotational moment on the axis, applied to the inner cylinder 2 through the table T, is transmitted not to the pawl portion 25*a* of the lock lever motion mechanism 22 so as not to twist the pillar-shaped body 33 engaging this, but to guide rails 95 through the holding bodies 90 formed so as to penetrate the inner cylinder 2, and consequently to the outer cylinder 3.

Embodiment 14

Figure 37A:
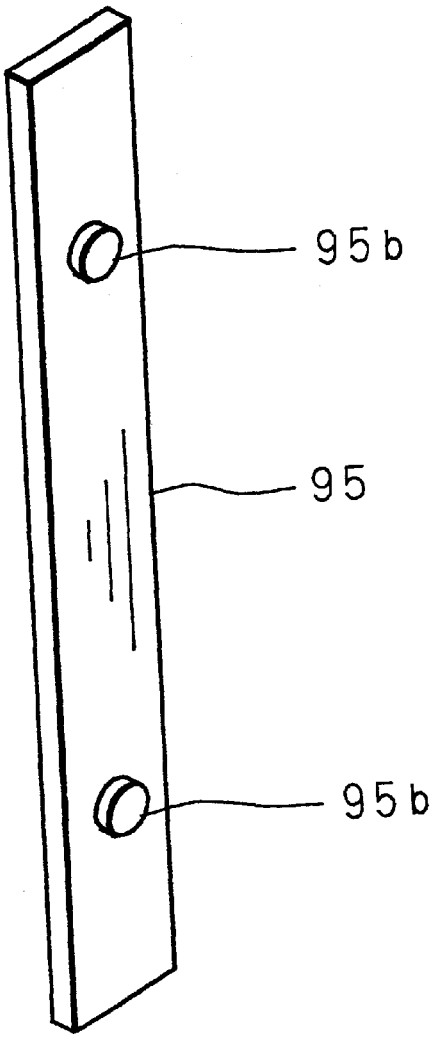
FIGS. 37A and 37B are perspective views that show the essential portion of still another Embodiment (Embodiment 14) of a telescopic member according to the present invention.
Figure 37B:
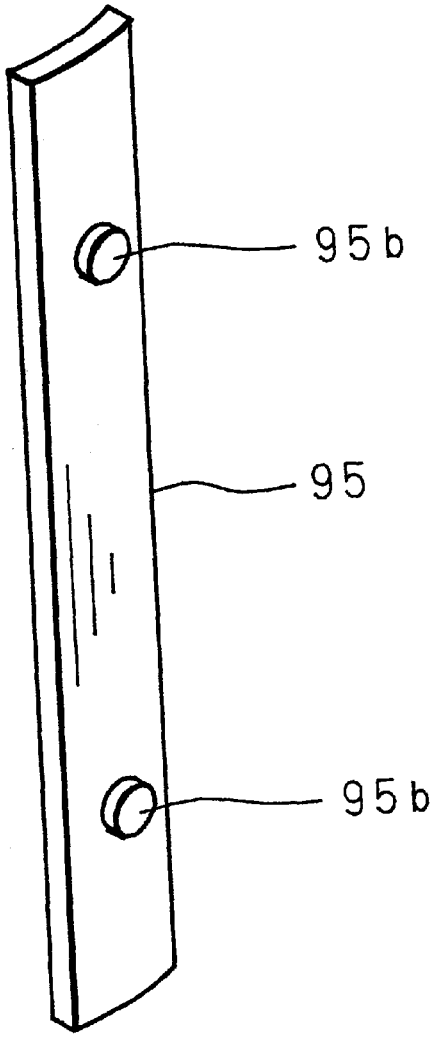

FIGS. 37A and 37B are perspective views that show the essential portion of still another Embodiment (Embodiment 14) of a telescopic member according to the present invention. In the present embodiment, the secured state and the shape of the guide rail 95 of Embodiment 13 to the outer cylinder 3 is modified. Except this fact, the other arrangements and functions are the same as those of the conventional configuration and Embodiment 13; therefore, the same reference numerals are used, and the detailed description thereof is omitted.

In the present embodiment, as illustrated in FIGS. 37A and 37B, each guide rail 95 is not secured to the inner circumferential surface of the outer cylinder 3 by the screws 96; instead of this, positioning pins 95*b* are respectively formed so as to stick out at the positions at which the stepped holes 95*a* are to be formed. Therefore, the securing process of the guide rail 95 to the inner circumferential surface of the outer cylinder 3 is made only by welding. In this case, since the tightening work for the screws 96 which is a comparatively difficult task in terms of space inside the outer cylinder 3 can be eliminated, it is possible to make the securing process easier.

Moreover, in FIG. 37A, although the guide rail 95 is shown as a flat-plate shape member in its entire shape in the same manner as Embodiment 13, it may be formed into an arc shape in its lateral cross-section that is aligned along the inner circumferential surface of the outer cylinder 3, for example, as illustrated in FIG. 37B; thus, various shapes may be adopted as the guide rail 95.

Embodiment 15

Figure 38A:
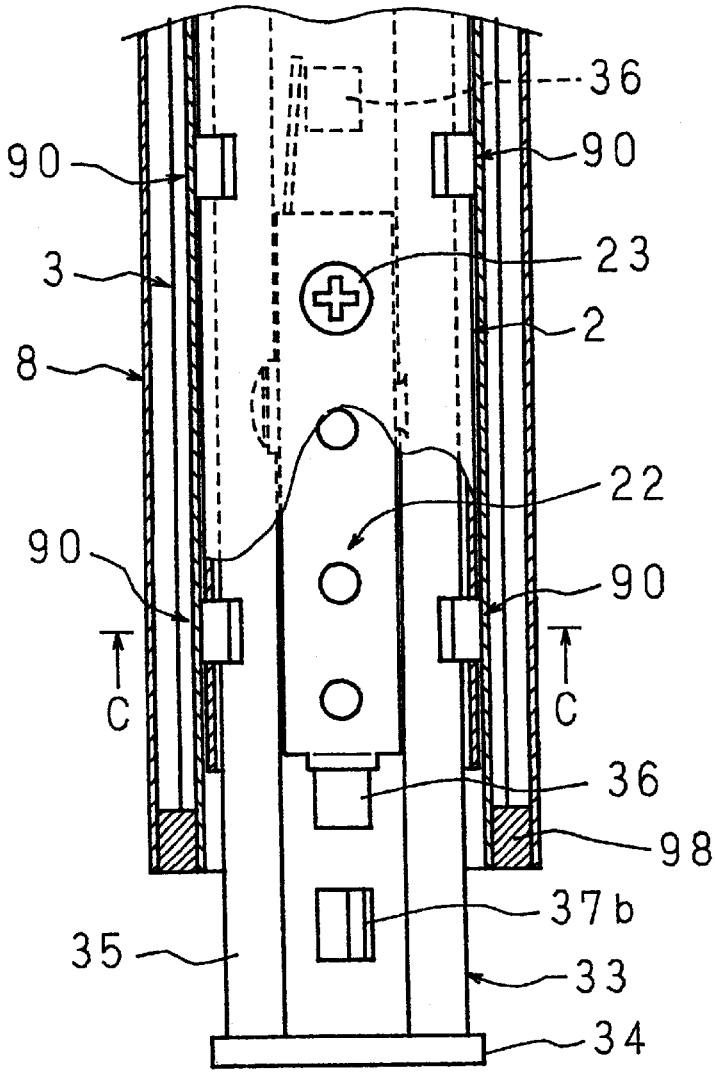
FIG. 38A, which shows the essential portion of still another Embodiment (Embodiment 15) of a telescopic member according to the present invention, is a partial longitudinal cross-sectional view seen from the right, which corresponds to FIG. 3A.
Figure 38B:
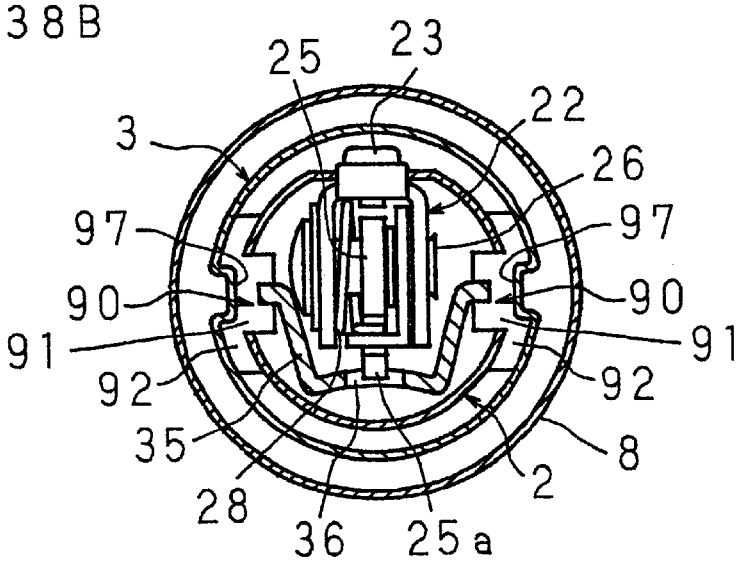
FIG. 38B is a partial cross-sectional view taken along line C—C of FIG. 38A.

FIG. 38A, which shows the essential portion of still another Embodiment (Embodiment 15) of a telescopic member according to the present invention, is a partial longitudinal cross-sectional view seen from the right, which corresponds to FIG. 3A; FIG. 38B is a partial cross-sectional view taken along line C—C of FIG. 38A. In the present embodiment, a holding member, which is installed as a separate member from the outer cylinder 3 like the guide rails 95 in Embodiment 14, is constituted integrally with the outer cylinder 3. Except this fact, the other arrangements and the functions are the same as those of the conventional configuration and Embodiment 14; therefore, the same reference numerals are used, and the detailed description thereof is omitted.

In other words, in the present embodiment, protruding portions 97 are formed on the inner surface of the outer cylinder 3 in its length direction by means of stamping, etc. applied from the outside thereof, and by using these, the rotation of the holding bodies 90 is regulated in the same manner as the guide rails 95 of Embodiment 8.

For the same reasons as the holding portions 29 installed in the inner cylinder 2 of the conventional configuration, the forming precision of pressing is comparatively low; therefore, in order to suppress instability in the rotational direction, it is more advantageous to provide the guide rails 95 as separate members from the outer cylinder 3, as shown in Embodiments 13 and 14.

Moreover, in the present embodiment, since the groove in the longitudinal direction on the outer circumferential surface of the outer cylinder 3 resulting from the formation of the protruding portions 97 tends to impair the appearance of the telescopic member, the outer cylinder 3 is covered with a cylindrical cover 8. This cover 8 is secured by a ring-shaped body, made of synthetic resin, interpolated in the gap to the outer cylinder 3 in a concentric manner with respect to the outer cylinder 3. Moreover, not shown in the Figures, by providing a shape in which the upper end portion has its fitting portion 40 also fitted to the gap between the outer cylinder 3 and the cover 8, the upper and lower end portions may be secured in a concentric manner with respect to the outer cylinder 3.

Embodiment 16

Figure 39:
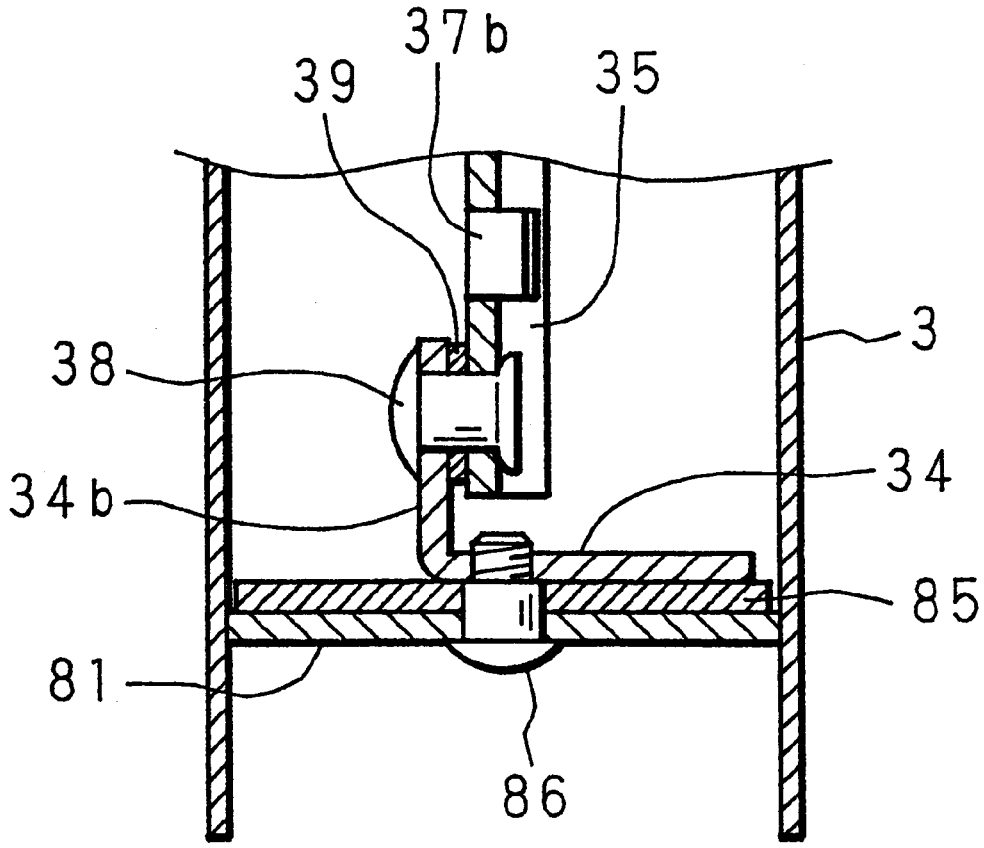
FIG. 39 is a partial cross-sectional view that shows still another Embodiment (Embodiment 16) of a telescopic member according to the present invention.

FIG. 39 is a partial cross-sectional view that shows still another Embodiment (Embodiment 16) of a telescopic member according to the present invention. In the present embodiment, the secured state of the base portion 34 to the inner cap 81, as shown in FIG. 14, is improved. Except this fact, the other arrangements and functions are the same as those of the conventional configuration or Embodiment 14; therefore, the same reference numerals are used, and the detailed description is omitted.

More specifically, instead of the two screws 32 for securing the base portion 34 having a semi-circular plate shape to the inner cap 81, it is secured to the inner cap 81 by one stepped screw 86 from below the inner cap 81 at the center of the rounded shape of the base portion 34, that is, at the center axis of the outer cylinder 3. The stepped screw 86, which penetrates the inner cap 81 at a portion on the large-diameter side that is not threaded, also penetrates the rotary base 85 interpolated between the base portion 34 and the inner cap 81, and is threadedly engaged with the base portion 34 at the tip portion on the small-diameter side that is threaded.

The rotary base 85, which has a disk shape with a penetration hole for the stepped screw 86 in the center, is formed from a material having an appropriate lubricating properties, such as a synthetic resin. With this arrangement, the base portion 34 and the inner cap 81 are connected so as to freely rotate relatively on the axis of the outer cylinder 3. In other words, the pillar-shaped body 33 is allowed to release the rotational moment applied thereto through the relative rotation at this connecting portion, and free from twisting.

Additionally, instead of the above-mentioned inner cap 81, the stepped screw 86 is used to connect the bottom cap 31 and the base portion 34 shown in FIG. 4 in Embodiment 1 so that the rotary base 85 is placed between them; this arrangement may of course be adopted.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A telescopic member, comprising:

an outer cylinder;

an inner cylinder slidably fitted into the outer cylinder in the axial direction;

a lock mechanism, placed between the outer cylinder and inner cylinder, for locking relative movements therebetween;

a braking chamber provided in either one of the outer cylinder or inner cylinder opposing to the other, the braking chamber having a taper surface providing a space that becomes narrower toward the relative sliding direction of the other cylinder; and a friction body, placed in the braking chamber, and which, when the other cylinder is relatively slidden, is allowed to move in the relative sliding direction with respect to the one cylinder, so that it is fitted between the taper surface and the other cylinder so as to apply a braking force to the relative movements between the cylinders, wherein the braking chamber is formed so that, when the friction body reaches a moving end in the relative sliding direction inside the braking chamber, it is allowed to roll between the taper surface and the other cylinder.

2. The telescopic member according to claim 1, wherein the braking chamber has two moving end surfaces at both of the moving ends of the friction body that are oriented in a direction intersecting the circumferential surface of the other cylinder, and is formed by at least the two moving end surfaces, the taper surface, and the circumferential surface of the other cylinder.

3. The telescopic member according to claim 2, wherein the friction body is an O-ring.

4. The telescopic member according to claim 2, wherein the friction body has a ring shape, and at least a portion of its cross-section intersecting an axis along the circumferential direction of the ring shape is formed into a portion of circular shape.

5. The telescopic member according to claim 2, wherein each of the outer cylinder and inner cylinder has an oval cross-section with opposing linear portions lying along its major-axis direction, and they are fitted with their major-axes coincident with each other, and a pair of the braking chambers and the friction bodies are placed at the opposing linear portions.

6. The telescopic member according to claim 1, wherein the friction body is an O-ring.

7. The telescopic member according to claim 1, wherein the friction body has a ring shape, and at least a portion of its cross-section intersecting an axis along the circumferential direction of the ring shape is formed into a portion of circular shape.

8. The telescopic member according to claim 1, wherein each of the outer cylinder and inner cylinder has an oval cross-section with opposing linear portions lying along its major-axis direction, and they are fitted with their major-axes coincident with each other, and a pair of the braking chambers and the friction bodies are placed at the opposing linear portions.

9. The telescopic member according to claim 5, wherein the friction body has a column shape.

10. A telescopic member, comprising:

an outer cylinder;

an inner cylinder slidably fitted into the outer cylinder in the axial direction;

a lock mechanism, placed between the outer cylinder and inner cylinder, for locking relative movements therebetween; and a cylindrical body that is secured to either one of the outer cylinder or inner cylinder, and that allows its inner circumferential surface or outer circumferential surface to slide on the circumferential surface of the other cylinder so that a braking force is applied to the relative movements of the outer cylinder and inner cylinder, wherein the cylindrical body is provided with a recess portion that faces the circumferential surface of the other cylinder and that holds a molded body so as to allow it to roll on the circumferential surface of the other cylinder, and the recess portion is provided with at least a taper surface that narrows a space toward the relative sliding direction of the other cylinder, and two surfaces that are spaced with a predetermined distance in the relative sliding direction and formed so as to intersect the taper surface.

11. The telescopic member according to claim 10, wherein the cylindrical body is provided with one portion having one of the two surfaces and the other portion having the other surface as separate portions.

12. The telescopic member according to claim 11, wherein one of the two surfaces on the side of a larger space is formed to be tapered so that it is gradually separated from the other surface on the side of a smaller space as it proceeds in the separating direction from the circumferential surface of the other cylinder.

13. The telescopic member according to claim 11, wherein the molded body is an O-ring.

14. The telescopic member according to claim 11, wherein the molded body has a ring shape, and at least a portion of its cross-section intersecting an axis along the circumferential direction of the ring shape is formed into a portion of circular shape.

15. The telescopic member according to claim 11, wherein the molded body is formed by connecting a plurality of ball-shaped bodies or roller-shaped bodies, and a braking force is applied to the relative movements of the outer cylinder and inner cylinder by allowing these bodies to roll on the circumferential surface of the other cylinder.

16. The telescopic member according to claim 15, wherein the molded body is made of urethane resin.

17. The telescopic member according to claim 16, wherein the molded body has a pillar shape.

18. The telescopic member according to claim 17, wherein each of the outer cylinder and inner cylinder has an oval cross-section with opposing linear portions lying along its major-axis direction, and they are fitted with their major-axes coincident with each other, and a pair of the braking chambers and the friction bodies are placed at the opposing linear portions.

19. The telescopic member according to claim 16, wherein the molded body has a ring shape.

20. The telescopic member according to claim 15, wherein the molded body has a ring shape.

21. The telescopic member according to claim 15, wherein the molded body has a pillar shape.

22. The telescopic member according to claim 10, wherein one of the two surfaces on the side of a larger space is formed to be tapered so that it is gradually separated from the other surface on the side of a smaller space as it proceeds in the separating direction from the circumferential surface of the other cylinder.

23. The telescopic member according to claim 22, wherein the molded body is an O-ring.

24. The telescopic member according to claim 22, wherein the molded body has a ring shape, and at least a portion of its cross-section intersecting an axis along the circumferential direction of the ring shape is formed into a portion of circular shape.

25. The telescopic member according to claim 22, wherein the molded body is formed by connecting a plurality of ball-shaped bodies or roller-shaped bodies, and a braking force is applied to the relative movements of the outer cylinder and inner cylinder by allowing these bodies to roll on the circumferential surface of the other cylinder.

26. The telescopic member according to claim 25, wherein the molded body has a ring shape.

27. The telescopic member according to claim 25, wherein the molded body has a pillar shape.

28. The telescopic member according to claim 25, wherein the molded body is made of urethane resin.

29. The telescopic member according to claim 28, wherein the molded body has a ring shape.

30. The telescopic member according to claim 28, wherein the molded body has a pillar shape.

31. The telescopic member according to claim 30, wherein each of the outer cylinder and inner cylinder has an oval cross-section with opposing linear portions lying along its major-axis direction, and they are fitted with their major-axes coincident with each other, and a pair of the braking chambers and the friction bodies are placed at the opposing linear portions.

32. The telescopic member according to claim 10, wherein the molded body is an O-ring.

33. The telescopic member according to claim 10, wherein the molded body has a ring shape, and at least a portion of its cross-section intersecting an axis along the circumferential direction of the ring shape is formed into a portion of circular shape.

34. The telescopic member according to claim 10, wherein the molded body is formed by connecting a plurality of ball-shaped bodies or roller-shaped bodies, and a braking force is applied to the relative movements of the outer cylinder and inner cylinder by allowing these bodies to roll on the circumferential surface of the other cylinder.

35. The telescopic member according to claim 34, wherein the molded body is made of urethane resin.

36. The telescopic member according to claim 35, wherein the molded body has a ring shape.

37. The telescopic member according to claim 35, wherein the molded body has a pillar shape.

38. The telescopic member according to claim 37, wherein each of the outer cylinder and inner cylinder has an oval cross-section with opposing linear portions lying along its major-axis direction, and they are fitted with their major-axes coincident with each other, and a pair of the braking chambers and the friction bodies are placed at the opposing linear portions.

39. The telescopic member according to claim 34, wherein the molded body has a ring shape.

40. The telescopic member according to claim 34, wherein the molded body has a pillar shape.

41. A telescopic member comprising:

an outer cylinder;

an inner cylinder slidably fitted into the outer cylinder in the axial direction;

a lock mechanism, placed between the outer cylinder and inner cylinder, for locking relative movements therebetween;

a braking chamber provided in either one of the outer cylinder or inner cylinder opposing to the other, the braking chamber having a taper surface providing a space that becomes narrower toward the relative sliding direction of the other cylinder; and a friction body, placed in the braking chamber, and which, when the other cylinder is relatively slidden, is allowed to move in the relative sliding direction with respect to the one cylinder, so that it is fitted between the taper surface and the other cylinder so as to apply a braking force to the relative movements between the cylinders, wherein the friction body has such a shape that it allows to fill a portion of the braking chamber when it is located at a predetermined position in the relative sliding direction.

42. The telescopic member according to claim 41, wherein the friction body is a ring-shaped elastic member having a notch at a position in the circumferential direction of the ring shape, and is elastically deformed so as to allow both ends of the notch to contact each other so that its inner diameter or outer diameter is adjusted.

43. The telescopic member according to claim 42, wherein the braking chamber is formed so that, when the friction body is located at the moving end on the side opposite to the slidably, it is separated from the circumferential surface of the other cylinder.

44. The telescopic member according to claim 41, wherein the braking chamber is formed so that, when the friction body is located at the moving end on the side opposite to the slidably, it is separated from the circumferential surface of the other cylinder.

45. A telescopic member comprising:

an outer cylinder;

an inner cylinder slidably fitted into the outer cylinder in the axial direction;

a pillar-shaped body installed in either one of the outer cylinder or inner cylinder with its longitudinal direction being coincident with the axial direction, the pillar-shaped body having a plurality of engaging portions placed along the axial direction;

a stopper portion, installed in the other cylinder, for stopping the respective engaging portion so as to hold the relative movements between the outer cylinder and inner cylinder; and a holding body, provided to the other cylinder so as to penetrate the circumferential wall of the other cylinder, for slidably holding the pillar-shaped body in the axial direction as well as for holding the pillar-shaped body so as not to move in a direction intersecting the axial direction of the pillar-shaped body.

46. The telescopic member according to claim 45, wherein the holding body includes a spacer portion that is installed between the outer cylinder and inner cylinder so as to maintain a distance between the cylinders.

47. The telescopic member according to claim 46, wherein the holding body is designed to be two-legged its portion protruding inside the other cylinder so that the pillar-shaped body is held between the legged portions.

48. The telescopic member according to claim 46, wherein the holding body is made of synthetic resin.

49. The telescopic member according to claim 46, further comprising:

a holding member, installed in the one cylinder at the circumferential surface facing the other cylinder along the axial direction, for slidably supporting the holding body in the axial direction, and for holding the holding body from moving in a direction intersecting the axial direction.

50. The telescopic member according to claim 45, wherein the holding body is designed to be two-legged its portion protruding inside the other cylinder so that the pillar-shaped body is held between the legged portions.

51. The telescopic member according to claim 50, wherein the holding body is made of synthetic resin.

52. The telescopic member according to claim 50, further comprising:

a holding member, installed in the one cylinder at the circumferential surface facing the other cylinder along the axial direction, for slidably supporting the holding body in the axial direction, and for holding the holding body from moving in a direction intersecting the axial direction.

53. The telescopic member according to claim 45, wherein the holding body is made of synthetic resin.

54. The telescopic member according to claim 53, further comprising:

a holding member, installed in the one cylinder at the circumferential surface facing the other cylinder along the axial direction, for slidably supporting the holding body in the axial direction, and for holding the holding body from moving in a direction intersecting the axial direction.

55. The telescopic member according to claim 45, further comprising:

a holding member, installed in the one cylinder at the circumferential surface facing the other cylinder along the axial direction, for slidably supporting the holding body in the axial direction, and for holding the holding body from moving in a direction intersecting the axial direction.

56. A telescopic member comprising:

an outer cylinder;

an inner cylinder slidably fitted into the outer cylinder in the axial direction;

a pillar-shaped body installed in either one of the outer cylinder or inner cylinder with its longitudinal direction being coincident with the axial direction, the pillar-shaped body having a plurality of engaging portions placed along the axial direction;

a stopper portion, installed in the other cylinder, for stopping the respective engaging portion so as to hold the relative movements between the outer cylinder and inner cylinder; and a protruding portion, protruded on the respective opposing surface of at least either one of the outer cylinder or inner cylinder, for slidably engaging the other cylinder so as to hold the other cylinder in the axial direction and also so as to hold the other cylinder from moving in a direction intersecting the axial direction.

57. The telescopic member according to claim 56, further comprising: a cylindrical cover for covering the outer cylinder.

58. A telescopic member comprising:

an outer cylinder;

an inner cylinder slidably fitted into the outer cylinder in the axial direction;

a pillar-shaped body installed in either one of the outer cylinder or inner cylinder with its longitudinal direction being coincident with the axial direction, the pillar-shaped body having a plurality of engaging portions placed along the axial direction;

a stopper portion, installed in the other cylinder, for stopping the respective engaging portion so as to hold the relative movements between the outer cylinder and inner cylinder; and a rotary base, interpolated between the one cylinder and the pillar-shaped body, for allowing the relative rotations therebetween on the axis.

59. A cylindrical body, secured to either one of a hole or a pillar body that is fitted into the hole in the axial direction so as to relatively move freely therein and which applies a braking force to the relative movements of the hole and pillar body by allowing its inner circumferential surface or outer circumferential surface to slide on the circumferential surface of the other, comprising:

a recess portion, which faces the circumferential surface of the other and which holds a molded body so as to allow it to roll on the circumferential surface of the other, wherein the recess portion being provided with at least a taper surface that narrows a space toward the relative sliding direction of the other and two surfaces that are spaced with a predetermined distance in the relative sliding direction and formed so as to intersect the taper surface.

60. The cylindrical body according to claim 59, wherein the cylindrical body is provided with one portion having one of the two surfaces and the other portion having the other surface as separate portions.

61. The cylindrical body according to claim 60, wherein one of the two surfaces on the side of a larger space is formed to be tapered so that it is gradually separated from the other surface on the side of a smaller space as it proceeds in the separating direction from the circumferential surface of the other cylinder.

62. The cylindrical body according to claim 59, wherein one of the two surfaces on the side of a larger space is formed to be tapered so that it is gradually separated from the other surface on the side of a smaller space as it proceeds in the separating direction from the circumferential surface of the other cylinder.

63. A molded body, interpolated between a hole and a pillar body to be fitted into the hole in the axial direction so as to relatively move freely therein, for applying a braking force to the relative movements of the hole and pillar body, wherein the molded body is made by connecting a plurality of ball-shaped bodies or roller-shaped bodies.

64. The molded body according to claim 63, wherein the molded body has a ring-shape connected structure.

65. The molded body according to claim 64, wherein the molded body is made of urethane resin.

66. The molded body according to claim 63, wherein the molded body has a pillar shape.

67. The molded body according to claim 63, wherein the molded body is made of urethane resin.

68. The molded body according to claim 65, wherein the molded body is made of urethane resin.

* * * * *